US007448618B2

(12) United States Patent
Inoue et al.

(10) Patent No.: US 7,448,618 B2
(45) Date of Patent: Nov. 11, 2008

(54) SHEET TRANSPORT APPARATUS, IMAGE READING APPARATUS INCLUDING SAME, AND IMAGE FORMING APPARATUS INCLUDING SAME THAT ALIGNS VARIOUS SHEET TYPES

(75) Inventors: Kiyoshi Inoue, Nara (JP); Takao Fukuda, Yamatokoriyama (JP); Osamu Fujimoto, Yamatokoriyama (JP); Kenji Kitami, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 356 days.

(21) Appl. No.: 10/936,636

(22) Filed: Sep. 9, 2004

(65) Prior Publication Data

US 2005/0067752 A1 Mar. 31, 2005

(30) Foreign Application Priority Data

Sep. 10, 2003 (JP) ..... 2003-318817
Mar. 18, 2004 (JP) ..... 2004-079262

(51) Int. Cl.
*B65H 31/00* (2006.01)

(52) U.S. Cl. ..... 271/207; 271/258.01

(58) Field of Classification Search ..... 271/207, 271/213, 214, 215, 256, 258.01, 258.02, 271/258.04, 259

See application file for complete search history.

(56) References Cited

U.S. PATENT DOCUMENTS 4,231,561 A * 11/1980 Kaneko et al. ..... 271/3.04
4,629,311 A * 12/1986 Kaneko et al. ..... 399/84
4,632,377 A * 12/1986 Browse ..... 271/9.08
4,787,616 A * 11/1988 Sasaki et al. ..... 271/3.03
5,132,741 A * 7/1992 Kitajima et al. ..... 399/370
5,241,353 A * 8/1993 Maeshima et al. ..... 399/405
5,515,150 A 5/1996 Yoshie et al.
5,563,699 A * 10/1996 Tsukamoto ..... 399/370
5,749,569 A * 5/1998 Atsumi et al. ..... 271/10.11
5,790,922 A * 8/1998 Takano ..... 399/94
6,149,149 A * 11/2000 Gammerler et al. ..... 271/218
6,988,723 B2 * 1/2006 Kitami et al. ..... 271/127

FOREIGN PATENT DOCUMENTS

JP 62-63262 U 4/1987
JP 63-091650 A 4/1988
JP 1-197234 8/1989
JP 03-147682 A 6/1991
JP 4-055259 A 2/1992
JP 06135617 A * 5/1994
JP 7-221915 A 8/1995
JP 8-268569 A 10/1996
JP 9-258615 A 10/1997

* cited by examiner

*Primary Examiner*—Patrick Mackey
*Assistant Examiner*—Gerald W McClain
(74) *Attorney, Agent, or Firm*—Birch, Stewart, Kolasch & Birch, LLP

(57) ABSTRACT

A sheet transport apparatus of the present invention is arranged so that a first eject tray is located at a position to which sheets are ejectable in such a manner that front and back surfaces of the sheets are not reversed after the sheets are subjected to predetermined processing. Further, the sheet transport apparatus of the present invention is provided with a first eject tray operation section for aligning leading edges of the sheets ejected to the first eject tray by changing a positional relation in a vertical direction between an upstream side and a downstream side of the first eject tray in a sheet transporting direction.

28 Claims, 44 Drawing Sheets

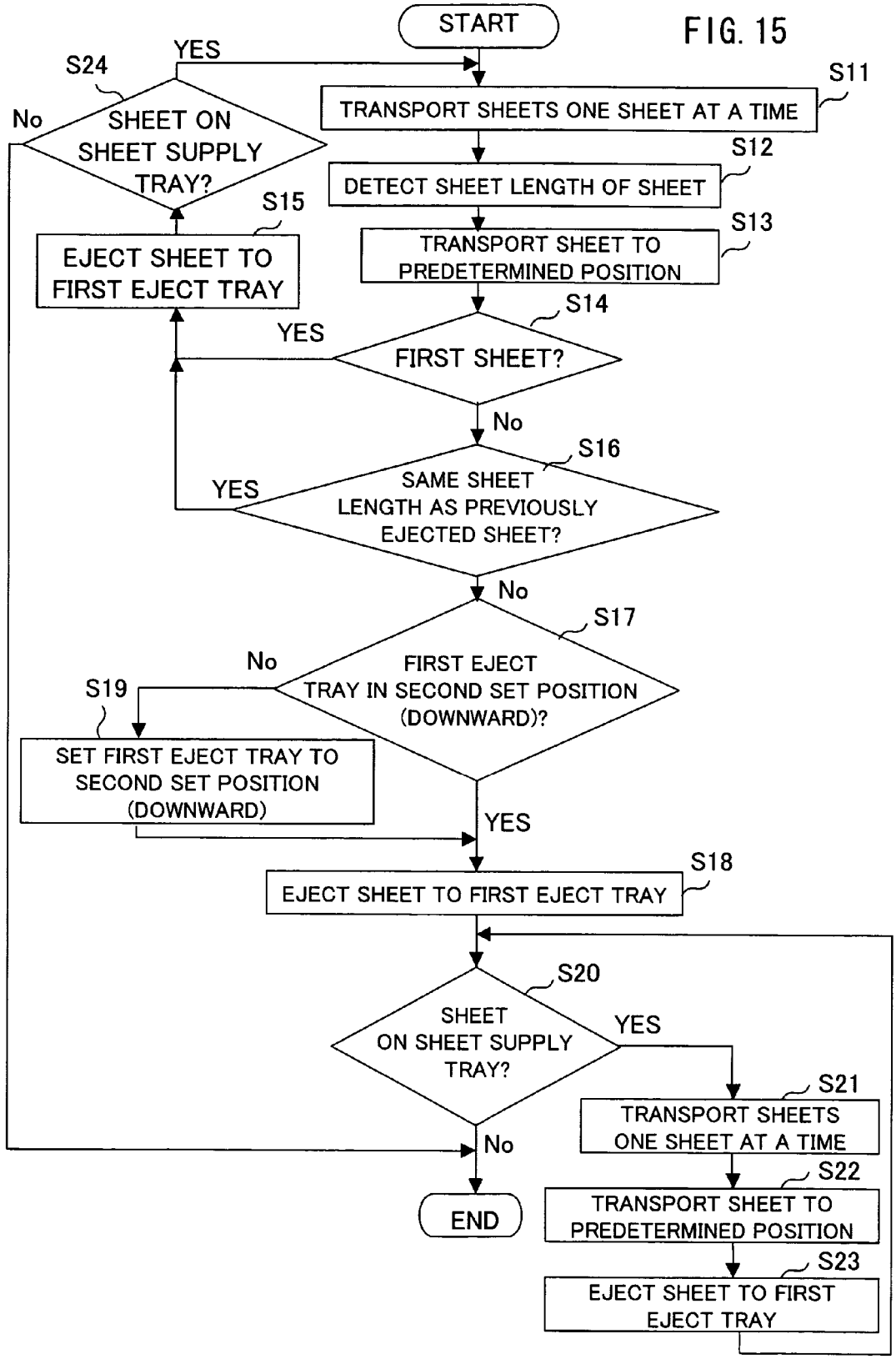
FIG. 15
START
S11
TRANSPORT SHEETS ONE SHEET AT A TIME
S12
DETECT SHEET LENGTH OF SHEET
S13
TRANSPORT SHEET TO PREDETERMINED POSITION
S14
FIRST SHEET?
YES
No
S15
EJECT SHEET TO FIRST EJECT TRAY
S16
SAME SHEET LENGTH AS PREVIOUSLY EJECTED SHEET?
YES
No
S17
FIRST EJECT TRAY IN SECOND SET POSITION (DOWNWARD)?
No
S19
SET FIRST EJECT TRAY TO SECOND SET POSITION (DOWNWARD)
YES
S18
EJECT SHEET TO FIRST EJECT TRAY
S20
SHEET ON SHEET SUPPLY TRAY?
YES
No
S21
TRANSPORT SHEETS ONE SHEET AT A TIME
S22
TRANSPORT SHEET TO PREDETERMINED POSITION
S23
EJECT SHEET TO FIRST EJECT TRAY
S24
SHEET ON SHEET SUPPLY TRAY?
YES
No
END

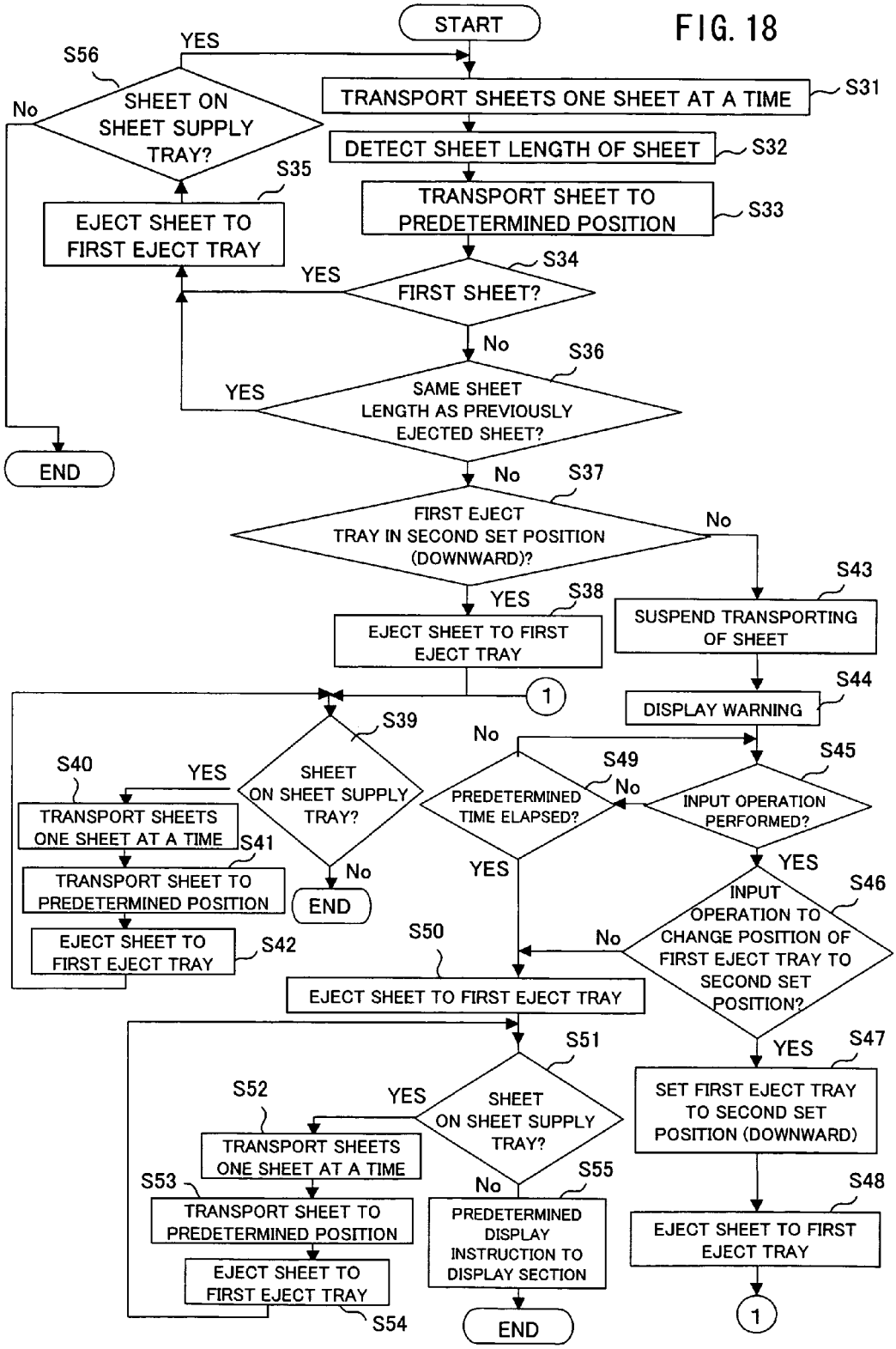
FIG. 18
START
TRANSPORT SHEETS ONE SHEET AT A TIME
S31
DETECT SHEET LENGTH OF SHEET
S32
TRANSPORT SHEET TO PREDETERMINED POSITION
S33
FIRST SHEET?
S34
YES
No
SAME SHEET LENGTH AS PREVIOUSLY EJECTED SHEET?
S36
YES
No
FIRST EJECT TRAY IN SECOND SET POSITION (DOWNWARD)?
S37
No
YES
EJECT SHEET TO FIRST EJECT TRAY
S38
SUSPEND TRANSPORTING OF SHEET
S43
DISPLAY WARNING
S44
1
SHEET ON SHEET SUPPLY TRAY?
S39
YES
No
TRANSPORT SHEETS ONE SHEET AT A TIME
S40
TRANSPORT SHEET TO PREDETERMINED POSITION
S41
EJECT SHEET TO FIRST EJECT TRAY
S42
END
PREDETERMINED TIME ELAPSED?
S49
No
YES
INPUT OPERATION PERFORMED?
S45
YES
INPUT OPERATION TO CHANGE POSITION OF FIRST EJECT TRAY TO SECOND SET POSITION?
S46
No
EJECT SHEET TO FIRST EJECT TRAY
S50
SET FIRST EJECT TRAY TO SECOND SET POSITION (DOWNWARD)
S47
EJECT SHEET TO FIRST EJECT TRAY
S48
1
SHEET ON SHEET SUPPLY TRAY?
S51
YES
No
TRANSPORT SHEETS ONE SHEET AT A TIME
S52
TRANSPORT SHEET TO PREDETERMINED POSITION
S53
EJECT SHEET TO FIRST EJECT TRAY
S54
PREDETERMINED DISPLAY INSTRUCTION TO DISPLAY SECTION
S55
END
SHEET ON SHEET SUPPLY TRAY?
S56
YES
No
EJECT SHEET TO FIRST EJECT TRAY
S35
END

CONVENTIONAL ART

CONVENTIONAL ART

CONVENTIONAL ART

CONVENTIONAL ART

CONVENTIONAL ART

CONVENTIONAL ART

SHEET TRANSPORT APPARATUS, IMAGE READING APPARATUS INCLUDING SAME, AND IMAGE FORMING APPARATUS INCLUDING SAME THAT ALIGNS VARIOUS SHEET TYPES

This Nonprovisional application claims priority under 35 U.S.C. § 119(a) on Patent Application No. 79262/2004 filed in Japan on Mar. 18, 2004 and Patent Application No. 318817/2003 filed in Japan on Sep. 10, 2003, the entire contents of which are hereby incorporated by reference.

FIELD OF THE INVENTION

The present invention relates to a sheet transport apparatus for transporting sheets in order to allow reading of images recorded on the sheets or formation of images on the sheets; an image reading apparatus including the sheet transport apparatus; and an image forming apparatus including the image reading apparatus.

BACKGROUND OF THE INVENTION

A conventionally known sheet transport apparatus sequentially transports originals in sheet form (hereinafter referred to as sheets) as reading object placed on a sheet supply tray to a reading section of an image reading apparatus, and then ejects the sheets to an eject tray. Further, by providing the sheet transport apparatus to an image reading apparatus, the image reading apparatus can realize efficient reading of sheets. Further, by providing to an image forming apparatus, the image reading apparatus provided with the sheet transport apparatus as described above, the image forming apparatus can realize efficient image formation.

Further, in accordance with recent advancement of digital technology, speed for reading sheets, speed for converting the read sheets into electronic data, and speed for forming images from the electronic data have improved. This realizes prompt processing of sheets in larger quantities.

Further, in accordance with technological advancement of the sheet transport apparatus, the type of sheets that can be transported has diversified. For example, it is possible to perform processing for reading sheets even if sheets placed on the sheet supply tray have different sheet lengths in a transporting direction.

When a group of sheets in which sheets having different sheet lengths in the sheet transporting direction are mixed is read as described above, the following problems will occur. The problems will be explained with reference to FIGS. 34 and 35. Note that, in the following explanation, the sheet length in the sheet transporting direction will be simply described as sheet length.

FIG. 34 is a cross-sectional view of a sheet transport apparatus 101 that sequentially transports sheets in order from the bottom, in a case where two sheets ($P_1$ and $P_2$) respectively having different sheet lengths are placed on a sheet supply tray 102. Further, FIG. 35 is a cross-sectional view of the sheet transport apparatus 101 in a case where the two sheets ($P_1$ and $P_2$) respectively having different sheet lengths are ejected to an eject tray 103.

As shown in FIGS. 34 and 35, when the two sheets ($P_1$ and $P_2$) respectively having different sheet lengths are read in order from the lower sheet $P_2$ (when read in order from the later page), the sheets ($P_1$ and $P_2$) are ejected to the eject tray 103 in such a manner the page order of the sheets is retained.

However, there arises a problem that leading edges of the sheets ($P_1$ and $P_2$) are not aligned with each other, as shown in FIG. 35. Note that, the leading edge of the sheet $P_1$ is indicated by the white triangle mark and the leading edge of the sheet $P_2$ is indicated by the black triangle mark in FIGS. 34 and 35.

In particular, if sheets having different sheet lengths are kept in a file, for example, the sheets are generally kept in such a manner that left edges of the sheets as a reference are aligned. Accordingly, after taking out the read sheets ($P_1$ and $P_2$) from the eject tray 103, the user is required to align the leading edges of the sheets ($P_1$ and $P_2$).

Further, in a sheet transport apparatus that sequentially transports sheets in order from an upper sheet, the sheets are ejected to the eject tray after the page order of the sheets is reversed.

Moreover, the problem that the leading edges are not aligned occurs not only when the sheets are read, but also occurs in an image forming apparatus provided with an inkjet line head 104' as shown in FIG. 36. Namely, in a case where information is recorded using the inkjet line head 104' on recording sheets ($P_{1'}$ and $P_{2'}$) transported by a sheet transport apparatus 101' and the recorded sheets ($P_{1'}$ and $P_{2''}$) are ejected to an eject tray 103', the leading edges of the sheets are not aligned if the sheets ($P_{1''}$ and $P_{2'}$) have different sheet lengths.

Further, the problem that the leading edges are not aligned as described above may occur in a case where the sheets to be transported include a sheet $P_{2''}$ with an index (tab) (namely, sheet partly having a protrusion), as shown in FIG. 42.

FIG. 43 is a cross-sectional view of the sheet transport apparatus 101 in a case where a normal sheet $P_{1''}$ without a protrusion and the sheet $P_{2''}$ with an index are placed on the sheet supply tray 102. Note that, hereinafter the normal sheet $P_{1''}$ without a protrusion is simply referred to as sheet $P_{1''}$. Further, FIG. 44 is a cross-sectional view of the sheet transport apparatus 101 in a case where the sheet $P_{1''}$ and the sheet $P_{2''}$ with an index are ejected to the eject tray 103.

In this case, when the sheet $P_{1''}$ and the sheet $P_{2''}$ with an index are sequentially read in order from the sheet $P_{2''}$ with an index on the lower side as shown in FIGS. 43 and 44, the sheets ($P_{1''}$ and $P_{2''}$) are ejected to the eject tray 103 in such a manner that the page order of the sheets ($P_{1''}$ and $P_{2''}$) is retained.

However, there arises a problem that the leading edges of the sheets ($P_{1''}$ and $P_{2''}$) are not aligned, as shown in FIG. 44. This is because the index section of the sheet $P_{2''}$ with an index is on the side of a placing reference of the eject tray 103. Note that, the leading edge of the sheet $P_1$ is indicated by the white triangle mark and the leading edge of the sheet $P_2$ is indicated by the black triangle mark in FIGS. 43 and 44.

Further, FIG. 46 is a cross-sectional view of a sheet transport apparatus 101" that sequentially transports sheets in order from an upper sheet, in a case where the sheet $P_{1''}$ and the sheet $P_{2''}$ with an index are placed on a sheet supply tray 102". Further, FIG. 47 is a cross-sectional view of the sheet transport apparatus 101" in a case where the sheet $P_{1''}$ and the sheet $P_{2''}$ with an index are ejected to an eject tray 103".

As shown in FIGS. 46 and 47, when the sheets ($P_{1''}$ and $P_{2''}$) are read in order from the upper sheet $P_{1''}$ (when read in order from the former page), the sheets ($P_{1''}$ and $P_{2''}$) are ejected to the eject tray 103" in such a manner that the page order of the sheets is retained.

However, in the sheet transport apparatus 101", there also arises the problem that the leading edges of the sheets ($P_{1''}$ and $P_{2''}$) are not aligned with each other, as shown in FIG. 47. Note that, the leading edge of the sheet $P_{1''}$ is indicated by the white triangle mark and the leading edge of the sheet $P_{2''}$ is indicated by the black triangle mark in FIGS. 46 and 47.

Further, the sheets may be transported in such a manner that the edges of the sheets on the index side are set as the leading edges. In this case, however, the following problems will occur.

A sheet with an index has a protrusion on a part of the sheet, as described above. Further, a position of the protrusion may differ from one sheet to another. Therefore if the sheets are transported with the index side being set as the leading edges, the sheets get easily caught in a transport path. As a result, the sheets may be transported in an inclined manner (in a slanted state), or a so-called jam may occur. Further, since the sheets are transported with the index side being set as the leading edges, the slanted state cannot be corrected even if resist means is used.

Therefore there is a problem that it is difficult to achieve the transporting correctly and stably, compared with a case where only normal sheets with no protrusion are transported.

Accordingly, for example, Patent Document 1 (Japanese Unexamined Patent Publication No. 3-147682 (Katajima, et al. 3-147682), published on Jun. 24, 1991) describes a sheet transport apparatus that can align leading edges of sheets after the sheets are read and ejected to a tray, even if the sheets have different sizes (sheet lengths).

The sheet transport apparatus 111 described in Patent Document 1 performs the following processing when transporting sheets having different sheet lengths. First, a pickup roller picks up a lowermost sheet $P_Z$. Next, the sheet $P_Z$ is transported to a predetermined sheet reading position through a first path 113. After the sheet is read, the sheet $P_Z$ is ejected to a sheet supply tray 112 through a second path 114.

After the sheet $P_Z$ is ejected to the sheet supply tray 112, a lowermost sheet $P_{Z-1}$ is ejected to the sheet supply tray 112 through a path similar to that of the sheet $P_Z$. Here, the sheet $P_{Z-1}$ is placed on the sheet $P_Z$. Then, similar processing is performed with respect to the other sheets.

By ejecting the sheets to the sheet supply tray 112 as described above, it is possible to align the leading edges of the ejected sheets as shown in FIG. 37. With this, the user does not need to align the leading edges.

Further, Patent Document 2 (Japanese Unexamined Patent Publication No. 8-268569, (Tokukaihei 8-268569), published on Oct. 15, 1996) discloses a sheet transport apparatus that can change a destination to which sheets having different sizes are ejected, according to size, after the sheets are copied.

Further, Patent Document 3 (Japanese Unexamined Patent Publication No. 4-55259, (Tokukaihei 4-55259), published on Feb. 21, 1992) discloses a facsimile apparatus that can switch the direction of outputting sheets, so as to select either a structure that does not change the outputting direction or a structure that reverses the outputting direction.

Further, Patent Document 4 (Japanese Unexamined Patent Publication No. 9-258615, (Tokukaihei 9-258615), published on Oct. 3, 1997) discloses an image forming apparatus that supplies a sheet with a tab and copies an original onto the supplied sheet when the image forming apparatus judges that the original to be copied has a tab.

However, in a case of Patent Document 1 where the sheet transport apparatus 111 sequentially reads large quantities of sheets placed on the sheet supply tray 112, the following problems will occur.

Namely, when the pickup roller attempts to sequentially pick up the sheets one sheet at a time in order from the later page, if large quantities of sheets are stacked on a sheet to be picked up, the sheet to be picked up is subject to the weight of the other sheets. Therefore it is difficult to pick up the desired sheet. Namely, in this case, the pickup roller may simultaneously pick up a plurality of sheets.

Further, if the arrangement of the sheet transport apparatus 111 is modified so that the pickup roller of the sheet transport apparatus 111 sequentially picks up the sheets one sheet at a time in order from the former page, the sheets are ejected to the sheet eject tray 112 after the page order of the sheets is reversed.

Moreover, in order to prevent the page order of the sheets from being reversed as described above, it is necessary to eject a sheet under the sheet that has been already ejected to the sheet supply tray 112. Therefore the sheet transport apparatus needs to be separately provided with a complicated mechanism for lifting the already ejected sheet from the sheet supply tray 112 each time a sheet is ejected, for example. If such a complicated mechanism is provided, it is difficult to improve the reading speed.

Further, since the read sheets are ejected to the sheet supply tray 112, sheet(s) are always placed on the sheet supply tray 112. Therefore the user cannot easily judge whether or not the reading of all the sheets has been complete.

Further, if the description in Patent Document 1 is applied to the case where the inkjet line head 104' is used to record information on the recording sheets ($P_1$ and $P_2$), similar problems as in the case of the reading of the sheets occur such that a plurality of sheets are simultaneously picked up.

SUMMARY OF THE INVENTION

In view of the foregoing problems, the present invention has an objective to provide a sheet transport apparatus in a simple arrangement that can align leading edges of sheets after the sheets are ejected, even if the sheets have different sheet lengths; an image reading apparatus including the sheet transport apparatus; and an image forming apparatus including the image reading apparatus.

In order to solve the foregoing problems, a sheet transport apparatus of the present invention which includes a sheet supply section capable of supplying a plurality of sheets whose leading edges are aligned, one sheet at a time from a leading edge; a sheet transport section for transporting the sheets supplied from the sheet supply section; and a first eject tray to which the sheets are ejected by the sheet transport section after the sheets transported by the sheet transport section are subjected to predetermined processing, the sheets being ejected to the first eject tray in such a manner that an order of the sheets when placed on the sheet supply section is retained, is arranged so as to include an alignment section (first eject tray operation section) for aligning the leading edges of the sheets ejected to the first eject tray by changing a positional relation in a vertical direction between an upstream side and a downstream side of the first eject tray in a sheet transporting direction, the first eject tray being located at a position to which the sheets are ejectable in such a manner that front and back surfaces of the sheets are not reversed after the sheets are subjected to the predetermined processing.

With this arrangement, the alignment section can change the positional relation in the vertical direction between the upstream side and the downstream side of the first eject tray in the sheet transporting direction. Therefore, if the downstream side of the first eject tray in the sheet transporting direction is set lower than the upstream side of the first eject tray in the sheet transporting direction, for example, the leading edges of the sheets when transported by the sheet supply section are always located on the downstream side of the first eject tray in the sheet transporting direction.

In this case, even if the sheets have different sheet lengths in the sheet transporting direction, the leading edges of the sheets when supplied are always located on the downstream side of the first eject tray in the sheet transporting direction.

Namely, the leading edges of the sheets can be aligned on the downstream side of the first eject tray in the sheet transporting direction after the sheets are ejected to the first eject tray. With this, it is possible to align the leading edges of the sheets ejected to the first eject tray.

Therefore the user does not need to align the leading edges of the sheets after the sheets are ejected to the first eject tray. With this, it is possible to provide a sheet transport apparatus that can reduce labor on the user.

Further, sheets are ejected to the first eject tray in such a manner that the order of the sheets when placed on the sheet supply section is retained. Therefore it is not necessary to change the order of the sheets (sequence of the sheets).

In order to solve the foregoing problems, a sheet transport apparatus of the present invention which includes a sheet supply section capable of supplying a plurality of sheets whose leading edges are aligned, one sheet at a time from a leading edge; a sheet transport section for transporting the sheets supplied from the sheet supply section; and a first eject tray to which the sheets are ejected by the sheet transport section after the sheets transported by the sheet transport section are subjected to predetermined processing, the sheets being ejected to the first eject tray in such a manner that an order of the sheets when placed on the sheet supply section is retained, is arranged so as to include an alignment section for aligning the leading edges of the sheets ejected to the first eject tray by reversing a positional relation between the leading edges and trailing edges of the sheets after the sheets are subjected to the predetermined processing and before the sheets are ejected to the first eject tray, the first eject tray being located at a position to which the sheets are ejectable in such a manner that front and back surfaces of the sheets are not reversed after the sheets are subjected to the predetermined processing, a downstream side of the first eject tray in a sheet transporting direction being set higher than an upstream side of the first sheet eject tray in the sheet transporting direction.

With this arrangement, the alignment section reverses the positional relation between the leading edges and trailing edges of the sheets after the sheets are subjected to the predetermined processing and before the sheets are ejected to the first eject tray.

Further, the downstream side of the first eject tray in the sheet transporting direction is set higher than the upstream side of the first sheet eject tray in the sheet transporting direction.

Therefore, even if the sheets have different sheet lengths in the sheet transporting direction, the leading edges of the sheets when supplied are always located on the upstream side of the first eject tray in the sheet transporting direction.

Namely, the leading edges of the sheets can be aligned on the upstream side of the first eject tray in the sheet transporting direction after the sheets are ejected to the first eject tray. With this, it is possible to align the leading edges of the sheets ejected to the first eject tray.

Therefore the user does not need to align the leading edges of the sheets after the sheets are ejected to the first eject tray. With this, it is possible to provide a sheet transport apparatus that can reduce labor on the user.

Further, sheets are ejected to the first eject tray in such a manner that the order of the sheets when placed on the sheet supply section is retained. Therefore it is not necessary to change the order of the sheets (sequence of the sheets).

In order to solve the foregoing problems, an image reading apparatus of the present invention is arranged so as to include the foregoing sheet transport apparatus.

With this arrangement, the image reading apparatus can use the function of the sheet transport apparatus as described above.

In order to solve the foregoing problems, an image forming apparatus of the present invention is arranged so as to include the foregoing image reading apparatus.

With this arrangement, the image forming apparatus can use the function of the sheet reading apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 15 is another flowchart showing the transporting of sheets in the sheet transport apparatus.

FIG. 18 is a further flowchart showing the transporting of sheets in the sheet transport apparatus.

DESCRIPTION OF THE EMBODIMENTS

[First Embodiment]

The following will explain an embodiment of the present invention with reference to FIGS. 1 through 20.

Figure 2:
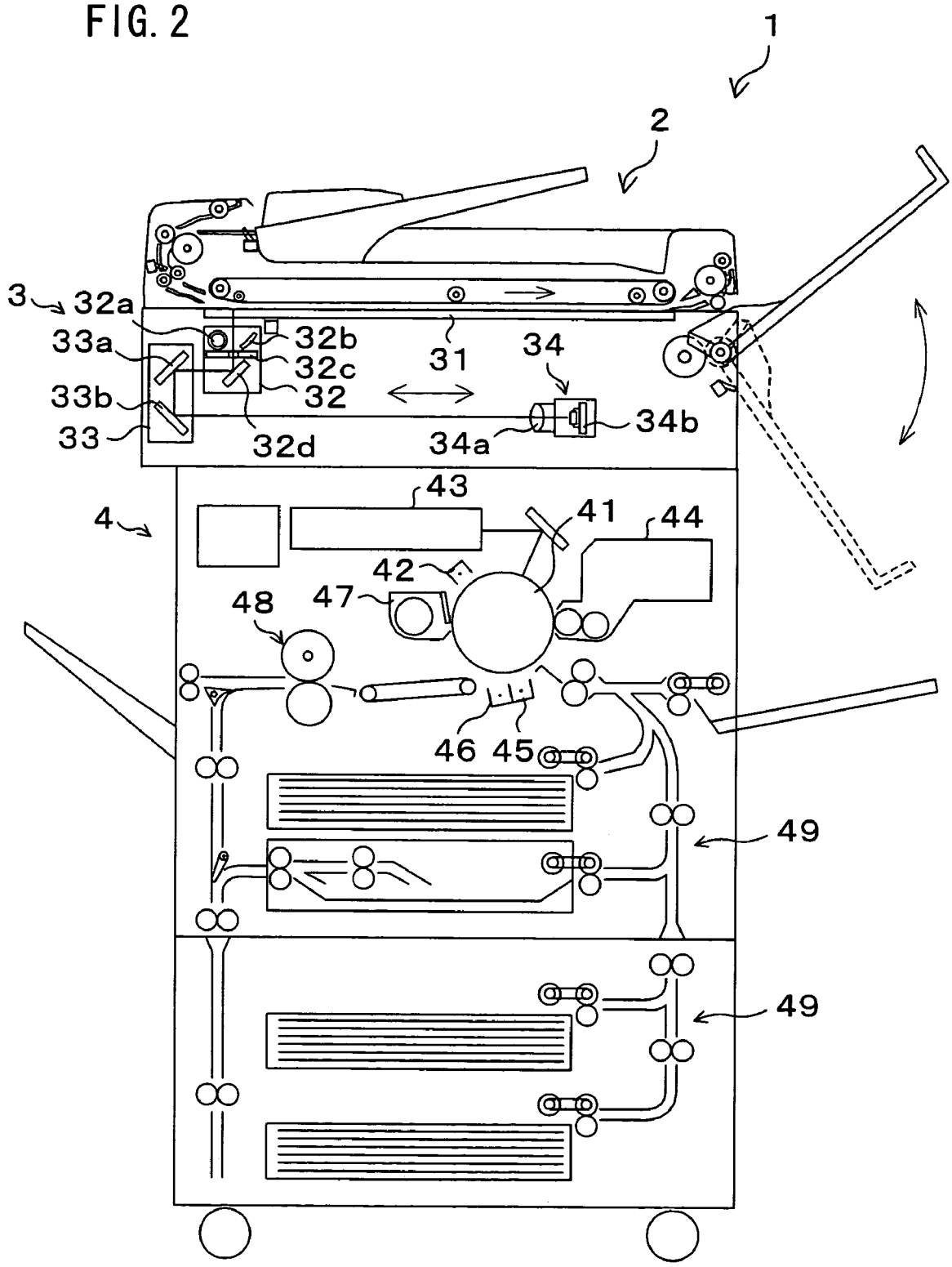
FIG. 2 is a cross-sectional view schematically showing an arrangement of an image forming apparatus provided with the sheet transport apparatus.

FIG. 2 is a cross-sectional view of an image forming apparatus in accordance with the present invention. The image forming apparatus 1 is provided with a sheet transport section (sheet transport apparatus) 1, an image reading section 3, an image forming section 4, and an operation section (not shown; see FIGS. 3 and 4). Note that, the sheet transport section 2, the image reading section 3, and the operation section 5 form an image reading apparatus.

The sheet transport section 2 sequentially transports originals in sheet form (hereinafter referred to as sheets) placed on a sheet supply tray one sheet at a time to a predetermined position at which the originals are read, and ejects the originals to an paper eject tray one sheet at a time after the originals are read. The details of the sheet transport section 2 will be described later.

The image reading section 3 is used as a scanner apparatus, and reads an image formed on a sheet which is a reading object. Further, the image reading section 3 is provided with an original table (platen glass) 31, a light source unit 32, a mirror unit 33, and a CCD unit 34.

The original table 31 is a transparent member provided to allow the CCD unit 34 and the like to read a sheet transported by the sheet transport section 2.

The light source unit 32 is provided with a light source 32*a*, a mirror 32*b*, a slit 32*c*, and a mirror 32*d*. The mirror 32*b* concentrates on the original table 31 in a predetermined position, light irradiated from the light source 32*a*. Among the light irradiated from the light source 32*a*, the slit 32*c* transmits only light reflected by the sheet. The mirror 32*d* changes by 90 degrees a light path of the reflected light that has transmitted the slit.

The mirror unit 33 is provided with a pair of mirrors (33*a* and 33*b*). The pair of mirrors (33*a* and 33*b*) change by 180 degrees the light path of the light exited from the mirror unit 32*d*.

The CCD unit 34 is provided with an imaging lens 34*a* and an image sensor 34*b*. When the light emitted from the mirror unit 33 enters the imaging lens 34*a*, the image sensor 34*b* recognizes a read image.

Note that, the image reading section 3 shown in FIG. 2 is arranged so that the light source unit 32 moves in a sheet transporting direction (sub-scanning direction). In this arrangement, the mirror unit 33 also moves in the same direction as the light source unit 32 in accordance with the movement of the light source unit 32. Note that, the mirror unit 33 moves at a speed half as the moving speed of the light source unit 32.

Further, instead of the light source unit 32, the mirror unit 33, and the CCD unit 34, the optical system may be composed of the imaging lens 34*a*, the image sensor 34*b*, and the light source 32*a*, as described above.

Figure 3:
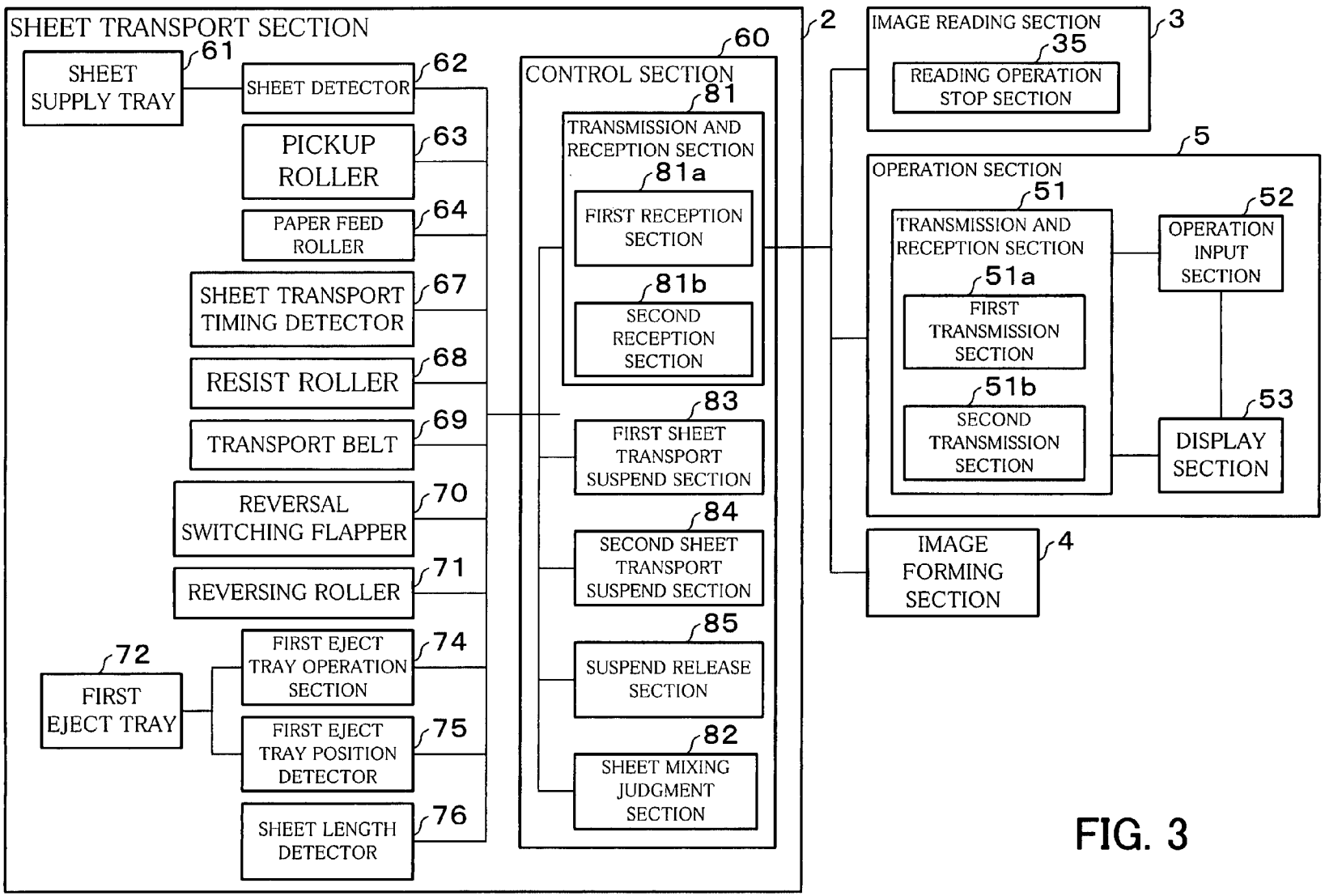
FIG. 3 is a functional block diagram of the image forming apparatus.

Further, the image reading section 3 is provided with a reading operation stop section 35, as shown in FIG. 3. The reading operation stop section 35 is a functional block that stops an image reading operation. The reading operation stop section 35 will be described later.

The image forming section 4 forms an image based on data acquired by the CCD unit 34 of the image reading section 3. Further, the image forming section 4 is provided with a photosensitive drum 41, a charger 42, a laser unit 43, a developer 44, a transferring device 45, a charge eliminator 46, a cleaning device 47, a fixing unit 48, a paper feed section 49, and a storage unit (not shown), as shown in FIG. 2.

Note that, in the image forming section 4, the charger 42, the laser unit 43, the developer 44, the transferring device 45, the charge eliminator 46, and the cleaning device 47 are sequentially located in this order around the photosensitive drum 41.

The storage unit is composed of a memory, for example. Further, the storage unit stores read data acquired by the CCD unit 34. Further, the charger 42 charges a surface of the photosensitive drum 41 to a predetermined potential.

The laser unit 43 is composed of a semiconductor laser light source, a polygon mirror, an f-θ lens, and the like (not shown). The semiconductor laser light source emits laser light in accordance with data read out from the storage unit or data transferred from an external device. The polygon mirror polarizes the emitted laser light at uniform angular velocity. Further, the f-θ lens corrects the polarized laser light so that the polarized laser light is scanned at uniform velocity on the photosensitive drum 41. Note that, the laser unit 43 irradiates laser onto the photosensitive drum 41 after the charger 42 charges the photosensitive drum 41.

By irradiating laser as described above, the laser unit 43 forms on the surface of the photosensitive drum 41, an electrostatic latent image corresponding to the read data.

Note that, instead of the laser unit 43, an optical write head unit provided with a light-emitting element array such as LED and EL may be used.

The developer 44 supplies toner to the electrostatic latent image formed on the surface of the photosensitive drum 41 so as to cause the electrostatic latent image to emerge as a toner image. Further, the transferring device 45 transfers onto a sheet fed from the paper feed section 49, the toner image that has been formed on the surface of the photosensitive drum 41 by the developer 44. Further, the charge eliminator 46 eliminates charge on the surface of the photosensitive drum 41. Further, the cleaning device 47 collects excess toner remaining on the surface of the photosensitive drum 41.

The fixing unit 48 fixes on the sheet the toner image that has been transferred by the transferring device 45. Further, the paper feed section 49 stores sheets and transports the sheets for the transferring of the toner image. Note that, the sheet on which the toner image has been transferred is ejected to an eject tray for the image forming section.

The operation section 5 is provided with a transmission and reception section 51, an operation input section 52, and a display section (display means) 53, as shown in FIG. 3. Further, the transmission and reception section 51 is provided with a first transmission section (first transmission means) 51*a* and a second transmission section (second transmission means) 51*b*.

The transmission and reception section 51 transmits and receives data to and from a transmission and reception section 81 of the sheet transport section 2, transmits and receives data to and from the image reading section 3, and transmits and receives data to and from the image forming section 4. Further, the transmission and reception section 51 receives an input from the operation input section 52, and gives the sheet transport section 2 and the other sections an instruction in accordance with the input. Further, the transmission and reception section 51 sends to the display section 53, information received from the sheet transport section 2, the image reading section 3, and the image forming section 4.

The operation input section 52 is a block that receives an input from the user. The input received through the operation input section 52 is sent to the transmission and reception section 51.

Further, the operation input section 52 can receive an instruction regarding a position of a first eject tray 72 (described later) in the sheet transport section 2. Further, the operation input section 52 can also receive an instruction as to which of the first eject tray 72 and a second eject tray 73 (described later) the sheets are ejected to.

Further, the operation input section 52 can also receive an user's input for turning on the function of the reading operation stop section 35 of the image reading section 3 as described above.

In accordance with an input through the operation input section 52, the first transmission section 51*a* sends to a first reception section 81*a* of the sheet transport section 2, a signal that designates the position of the first eject tray 72, that is either a first set position or a second set position to be described later.

In accordance with an input through the operation input section 52, the second transmission section 51*b* sends to a second reception section 81*b* of the sheet transport section 2, a signal that designates a destination to which the sheets are ejected, that is either the first eject tray 72 or the second eject tray 73.

Further, the operation input section 52 can also accept an input from the user as to whether or not to perform mixed processing to be described later. Here, if the user selects the execution of the mixed processing, the first eject tray 72 is set to the second set position via the first transmission section 51*a*.

The display section 53 displays an input status of the operation input section 52. Further, the display section 53 displays via the transmission and reception section 51, an operational status of the sheet transport section 2, the image reading section 3, or the image forming section 4.

Figure 4:
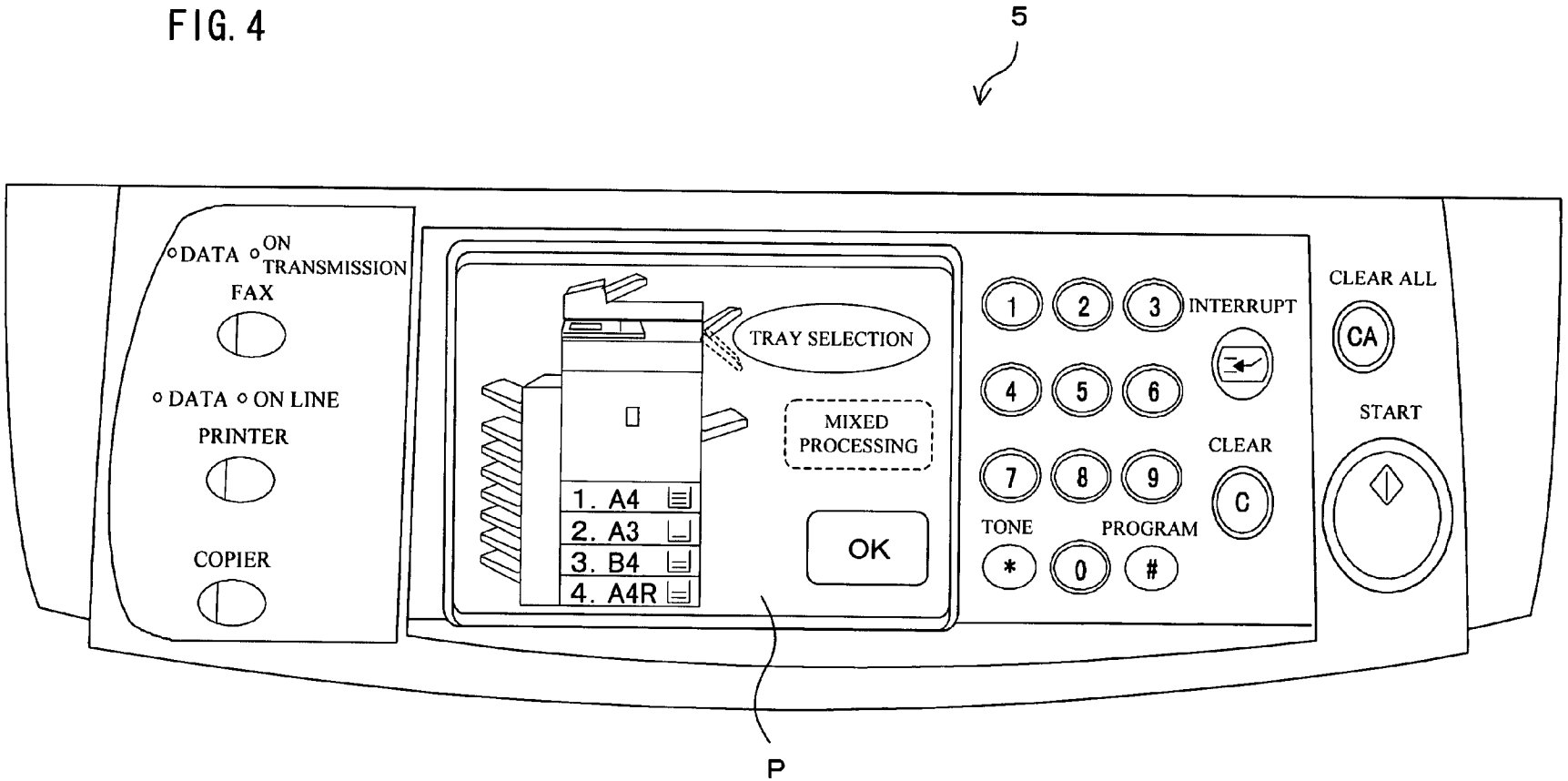
FIG. 4 is a top view of an operation section of the image forming apparatus.

Incidentally, the operation section 5 is in panel shape, as shown in FIG. 4, for example. FIG. 4 shows an example of arrangement where the panel P includes both the operation input section 52 and the display section 53. Note that, the arrangement of the panel is not limited to this.

Next, the details of the sheet transport section 2 will be explained with reference to FIG. 1.

Figure 1:
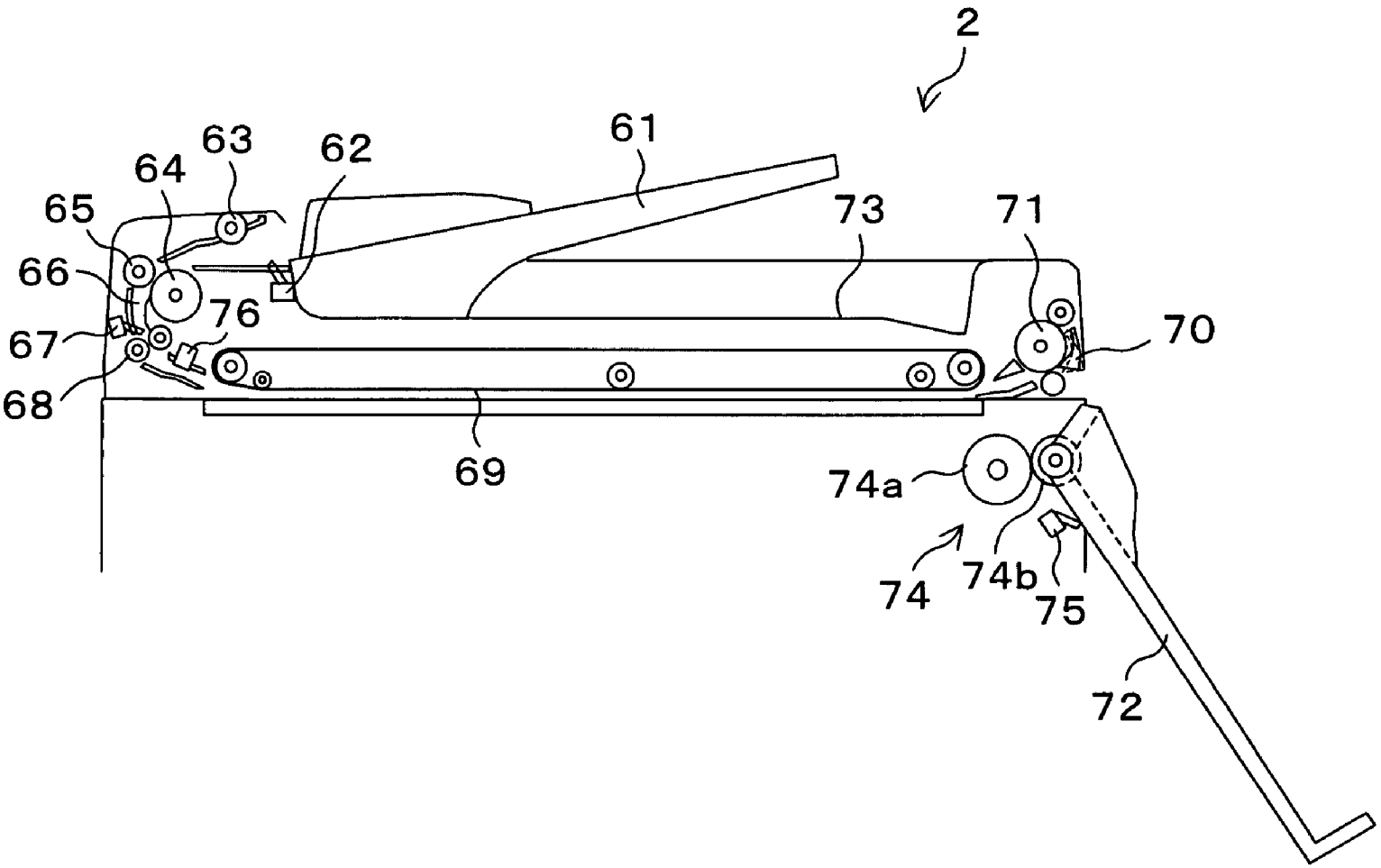
FIG. 1 is a cross-sectional view showing an embodiment of a sheet transport apparatus of the present invention.

FIG. 1 is a cross-sectional view of the sheet transport section 2. As shown in FIG. 1, the sheet transport section 2 is provided with a sheet supply tray 61, a sheet detector 62, a pickup roller 63, a paper feed roller 64, a separation roller 65, a curved transport path 66, a sheet transport timing detector 67, a resist roller 68, a transport belt 69, a reversal switching flapper 70, a reversing roller 71, the first eject tray (first sheet eject means) 72, the second eject tray (second sheet eject means) 73, a first eject tray operation section (alignment means, alignment section) 74, a first eject tray position detector 75, a sheet length detector 76, and a control section 60 (not shown; see FIG. 3).

Here, the sheet supply tray 61, the sheet detector 62, the pickup roller 63, and the separation roller 65 constitute sheet supply means (sheet supply section) as recited in the claims.

Further, the sheet transport timing detector 67, the resist roller 68, the transport belt 69, and the reversing roller 71 constitute sheet transport means (sheet transport section) as recited in the claims.

In accordance with an input signal supplied from the operation section 5, or a detection result obtained from the sheet detector 62, sheet transport timing detector 67, first eject tray position detector 75, or sheet length detector 76, the control section 60 controls the operation of the pickup roller 63, paper feed roller 64, separation roller 65, resist roller 68, transport belt 69, reversal switching flapper 70, reversing roller 71, first eject tray operation section 74, and the like.

Further, the control section 60 is provided with the transmission and reception section 81, a sheet mixing judgment section 82, a first sheet transport suspend section (first suspend means) 83, a second sheet transport suspend section (second suspend means) 84, and a suspend release section 85, as shown in FIG. 3. Further, the transmission and reception section 81 is provided with the first reception section (first reception means) 81*a* and the second reception section (second reception means) 81*b*.

Note that, the transmission and reception section 81, the sheet mixing judgment section 82, the first sheet transport suspend section 83, the second sheet transport suspend section 84, and the suspend release section 85 are respectively functional blocks. Further, the sheet mixing judgment section 82 and the sheet length detector 76 correspond to detecting means (detecting section) recited in the claims.

The sheet supply tray 61 is a tray on which a plurality of sheets as reading object can be placed, as shown in FIG. 1. Further, the sheet detector 62 detects whether or not a sheet is placed on the sheet supply tray 61, and sends the detection result to the control section 60.

The pickup roller 63 picks up sheets placed on the sheet supply tray 61 basically one sheet at a time. Note that, the pickup roller 63 shown in FIG. 3 sequentially picks up the sheets placed on the sheet supply tray 61 in order from a sheet placed on a top surface of the sheet supply tray 61.

However, due to the mechanism of the pickup roller 63, the pickup roller 63 may pick up a plurality of sheets at the same time. Therefore, in the sheet transport apparatus 2, while the paper feed roller 64 transports sheets to the curved transport path 66 located on the downstream side of the rollers (64 and 65), the separation roller 65 provided to face the paper feed roller 64 allows only one sheet to be transported at a time.

In accordance with a detection result detected at the sheet transport timing detector 67, the resist roller 68 adjusts timing for supplying a sheet to the transport belt 69 located on the downstream side of the resist roller 68. In other words, the resist roller 68 is a roller that adjusts timing for sending a sheet to the original table 31 of the image reading section 3 as described above.

Note that, more specifically, the detection result detected at the sheet transport timing detector 67 is temporarily supplied to the control section 60, and the control section 60 controls the operation of the resist roller 68 in accordance with the detection result.

The transport belt 69 transports along the original table 31, a sheet supplied from the resist roller 68. More specifically, the image reading section 3 reads a sheet in the following method. First, the transport belt 69 transports a sheet to a predetermined position, and temporarily stops the transporting of the sheet at the predetermined position. Then, the image reading section 3 reads the sheet in the predetermined position. After the sheet is read, the transport belt 69 resumes the transporting of the sheet.

The reversal switching flapper 70 is a device that switches to either the first eject tray 72 or the second eject tray 73, a destination to which the sheet transported by the transport belt 69 is ejected. More specifically, the reversal switching flapper 70 is arranged to be movable. Here, the sheet is ejected to the first eject tray 72 when the reversal switching flapper 70 is in a first switching position (position indicated by the solid line in FIG. 1). On the other hand, the sheet is ejected to the second eject tray 73 when the reversal switching flapper 70 is in a second switching position (position indicated by the broken line in FIG. 1). Further, the second eject tray 73 is arranged so that the downstream side of the second eject tray 73 in the sheet transporting direction is higher than the upstream side of the second eject tray 73 in the sheet transporting direction.

Note that, hereinafter the downstream side (or upstream side) of the second eject tray 73 (or first eject tray 72) in the sheet transporting direction is simply referred to as the downstream side (or upstream side) of the second eject tray 73 (or first eject tray 72). This also applies to other embodiments to be described later.

Here, when the sheet is ejected to the second eject tray 73, the reversing roller 71 is used to transport the sheet. In this case, a state of the ejected sheet is different from a state of the sheet when transported by the transport belt 69. Namely, the front and back surfaces of the sheet are reversed. In other words, the sheet is ejected so as to face the same side as the sheet when placed on the sheet supply tray 61.

On the other hand, when the sheet is ejected to the first eject tray 72, a state of the ejected sheet is the same as a state of the sheet when transported by the transport belt 69. Namely, the front and back surfaces of the sheet are not reversed. In other words, the sheet is ejected so as to face the side opposite to the sheet when placed on the sheet supply tray 61.

The first eject tray operation section 74 is provided with a drive motor 74*a*, and a driven section 74*b* that is driven to rotate in accordance with the operation of the drive motor 74*a*. Here, the driven section 74*b* is provided so as to be fixed to the first eject tray 72.

Further, when the drive motor 74*a* rotates in the first eject tray operation section 74, the rotating operation is conveyed to the first eject tray 72 via the driven section 74*b*. With this, the first eject tray operation section 74 changes a mounting angle of the first eject tray 72 with respect to a surface of a sheet ejected to the first eject tray 72. In other words, the first eject tray operation section 74 rotates the first eject tray 72 so as to change the mounting angle of the first eject tray 72. Note that, the mounting angle is changed within a predetermined range.

More specifically, the first eject tray operation section 74 moves the first eject tray 72 either to (i) the first set position (position indicated by the solid line in FIG. 2) where the downstream side of the first eject tray 72 is higher than the upstream side of the first eject tray 72 or (ii) the second set position (position indicated by the broken line in FIG. 2) where the downstream side of the first eject tray 72 is lower than the upstream side of the first eject tray 72.

The first eject tray position detector 75 is a device that detects whether or not the first eject tray 72 is in the second set position.

The sheet length detector 76 detects a sheet length of a transported sheet in the sheet transporting direction (sub-scanning direction in the image reading apparatus). The detection result is sent to the sheet mixing judgment section 82 of the control section 60.

Note that, the sheet length in the sheet transporting direction will be simply described as sheet length in the following explanation and other embodiments to be described later.

Here, the functional blocks 81 through 85 in the control section 60 will be explained.

The transmission and reception section 81 transmits and receives data with respect to the image reading section 3, and receives data from the operation section 5.

Further, the first reception section 81*a* receives a signal from the first transmission section 51*a* of the operation section 5. Namely, the first reception section 81*a* receives the signal that designates either the first set position or the second set position, that is the position of the first eject tray 72, as described above.

Then, in the sheet transport section 2, when the first reception section 81*a* receives the signal, the first eject tray 72 is moved to the second set position in accordance with the operation of the first eject tray operation section 74.

Further, the second reception section 81*b* receives a signal from the second transmission section 51*b* of the operation section 5. Namely, the second reception section 81*b* receives the signal that designates either the first eject tray 72 or the second eject tray 73, that is a destination to which the sheets are ejected.

Then, in the sheet transport section 2, when the second reception section 81*b* receives the signal, a tray to which the sheets are ejected is changed in accordance with the operation of the reversal switching flapper 70.

In accordance with detection results detected at the sheet length detector 76 with respect to a plurality of sheets placed on the sheet supply tray 61, the sheet mixing judgment section 82 judges whether or not the plurality of sheets include sheets having different sheet lengths. The information thus obtained by the sheet mixing judgment section 82 is sent to the first sheet transport suspend section 83 and the second sheet transport suspend section 84.

If the first eject tray 72 is in the first set position, and the sheet mixing judgment section 82 judges that the sheets include sheets having different sheet lengths, the first sheet transport suspend section 83 temporarily suspends the ejection of the sheets to the first eject tray 72.

If the sheets are to be ejected to the second eject tray 73, and the sheet mixing judgment section 82 judges that the sheets include sheets having different sheet lengths, the second sheet transport suspend section 84 temporarily suspends the ejection of the sheets to the second eject tray 73.

The suspend release section 85 resumes the transporting of the sheets suspended by the first sheet transport suspend section 83 or second sheet transport suspend section 84.

Further, the function of the first sheet transport suspend section 83 and second sheet transport suspend section 84 can be turned on or off. Specifically, when the user gives to the sheet transport section 2 through the operation input section 52 of the operation section 5, an instruction to turn on or off the function, the first sheet transport suspend section 83 or second sheet transport suspend section 84 suspends or does not suspend the transporting of the sheets in accordance with the instruction.

Here, the transporting of a sheet by means of the first eject tray operation section (alignment means) 74, which characterizes the present invention, will be explained with reference to Examples. Note that, in the following explanation, reading of an image corresponds to predetermined processing as recited in the claims.

EXAMPLE 1

The following will explain the present example with reference to FIGS. 5 through 14. Note that, the explanation with reference to FIGS. 5 through 14 will describe cases where the function of the first sheet transport suspend section 83 is turned off. Further, the present example will explain cases where the user already knows whether or not the sheets include sheets having different lengths. Further, the following will explain cases where the user gives through the operation input section 52 an instruction (input) to perform the mixed processing when the user knows that the sheets include sheets having different lengths.

Figure 5:
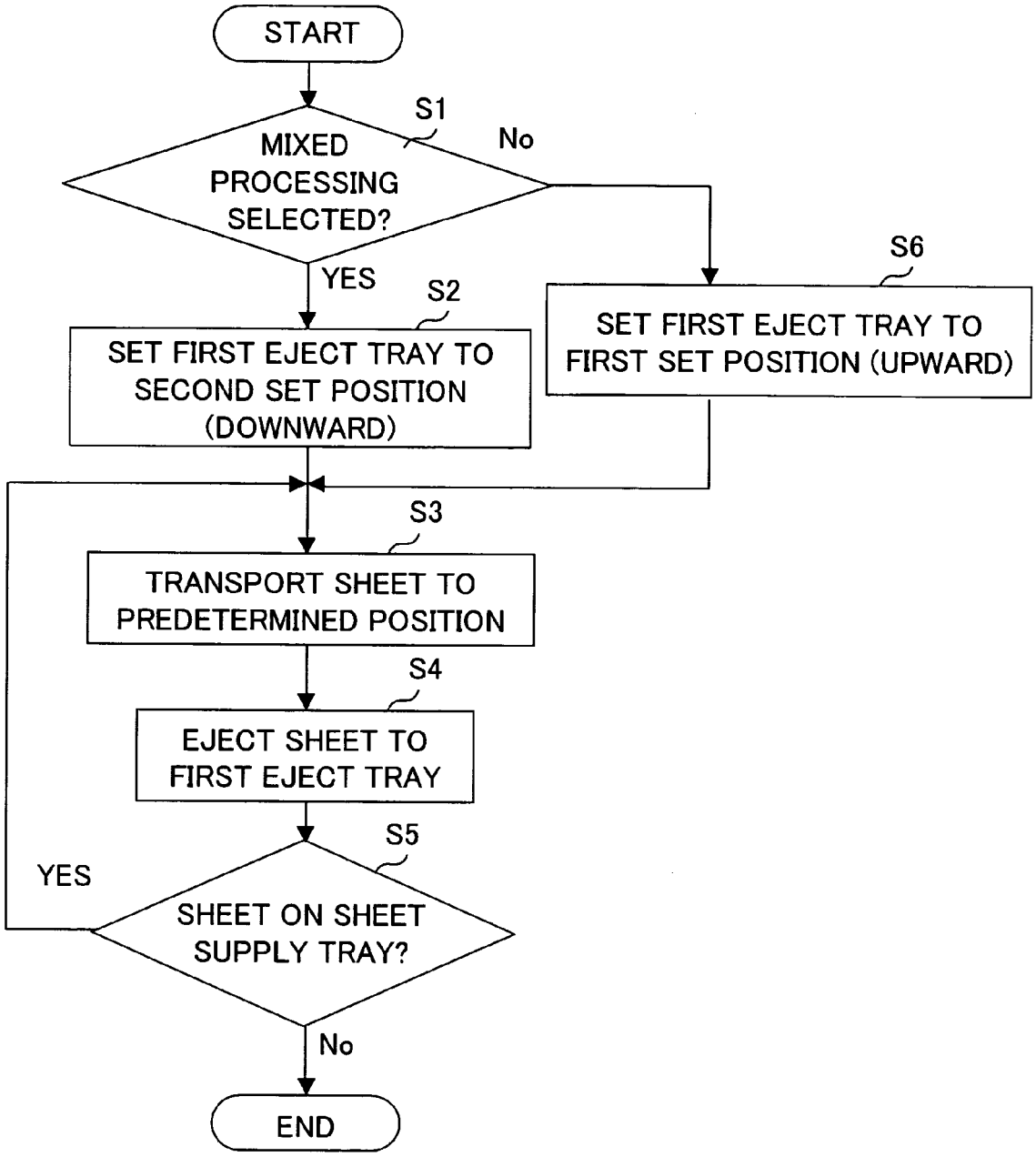
FIG. 5 is a flowchart showing the transporting of sheets in the sheet transport apparatus.

First, as shown in FIG. 5, the control section 60 judges whether or not the mixed processing is selected with respect to sheets placed on the sheet supply tray 61 (S1). Note that, the control section 60 judges in accordance with an input through the operation input section 52 whether or not the mixed processing is selected.

If the control section 60 judges in S1 that the mixed processing is selected, the first eject tray operation section 74 which has received an instruction from the control section 60 sets the first eject tray 72 downward, namely, to the second set position (S2). After S2, the sheets are sequentially transported to a predetermined position one sheet at a time by the pickup roller 63, the resist roller 68, the transport belt 69, and the like (S3). Further, an image is read in the predetermined position by the image reading section 3.

After S3, the sheet is ejected by the transport belt 69 and the like to the first eject tray 72 which is in the second set position (S4). After S4, the sheet detector 62 detects whether or not there is a sheet on the sheet supply tray 61 (S5).

If it is judged in S5 that there is a sheet, the processing goes back to S3 again. Then, the next sheet is sent to the predetermined position and read. After this, the sheet is ejected to the first eject tray 72. On the other hand, if it is judged in S5 that there is no sheet, the processing ends.

Further, if the control section 60 judges in S1 that the mixed processing is not selected, the first eject tray operation section 74 sets the first eject tray 72 upward, namely, to the first set position (S6). After S6, the processing proceeds to S3, and similar steps are sequentially performed.

Next, concrete examples of the processing in accordance with the flowchart shown in FIG. 5 will be explained with reference to FIGS. 6 through 13.

First, FIGS. 6 through 10 show a case where two sheets ($S_{1a}$ and $S_{1b}$) having different sheet lengths are transported and the control section 60 judges in S1 shown in FIG. 5 that the mixed processing is selected. Note that, the leading edge of the sheet $S_{1a}$ is indicated by the white triangle mark, and the leading edge of the sheet $S_{1b}$ is indicated by the black triangle mark in FIGS. 6 through 10. Further, the sheet $S_{1a}$ is placed on the sheet $S_{1b}$ in the sheet supply tray 61. Further, the sheets ($S_{1a}$ and $S_{1b}$) are placed on the sheet supply tray 61 in a face-up state, namely, in such a manner that the reading surfaces of the sheets ($S_{1a}$ and $S_{1b}$) face upward.

Figure 6:
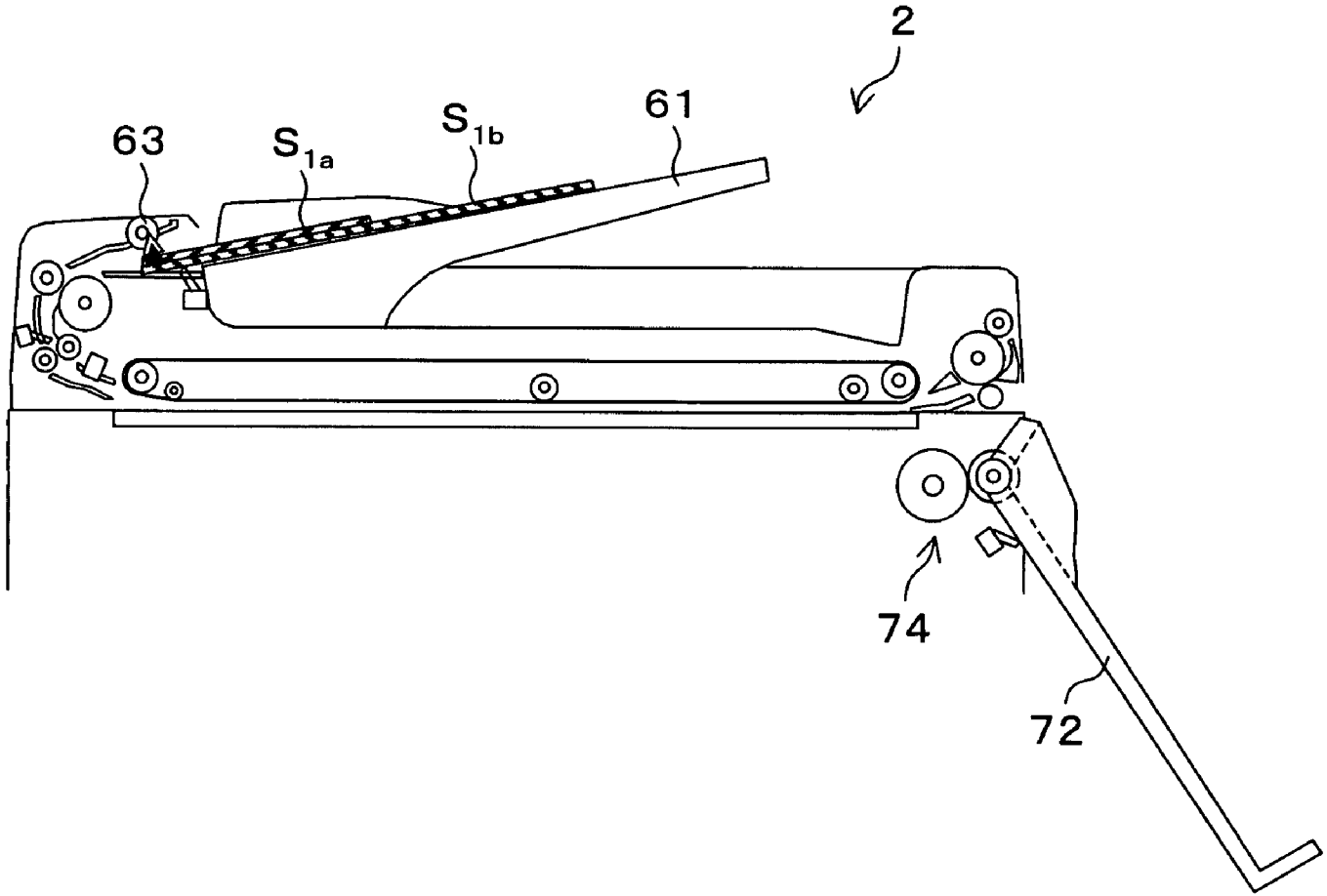
FIG. 6 is a cross-sectional view of the sheet transport apparatus before starting transporting the sheets in a case in accordance with the flowchart where the sheets have different sheet lengths.
Figure 7:
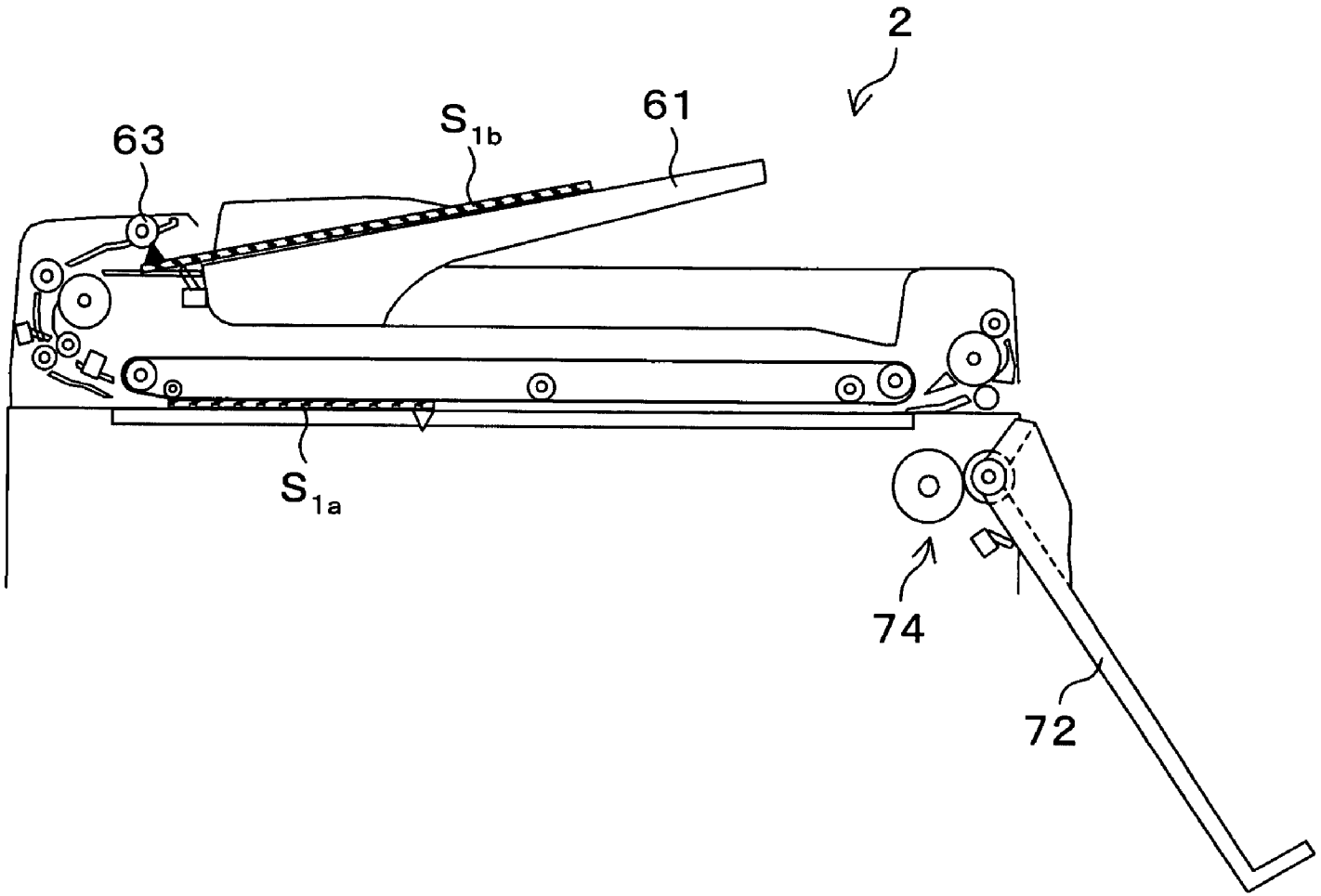
FIG. 7 is a cross-sectional view of the sheet transport apparatus after starting transporting the sheets, and shows a state after the state shown in FIG. 6.
Figure 8:
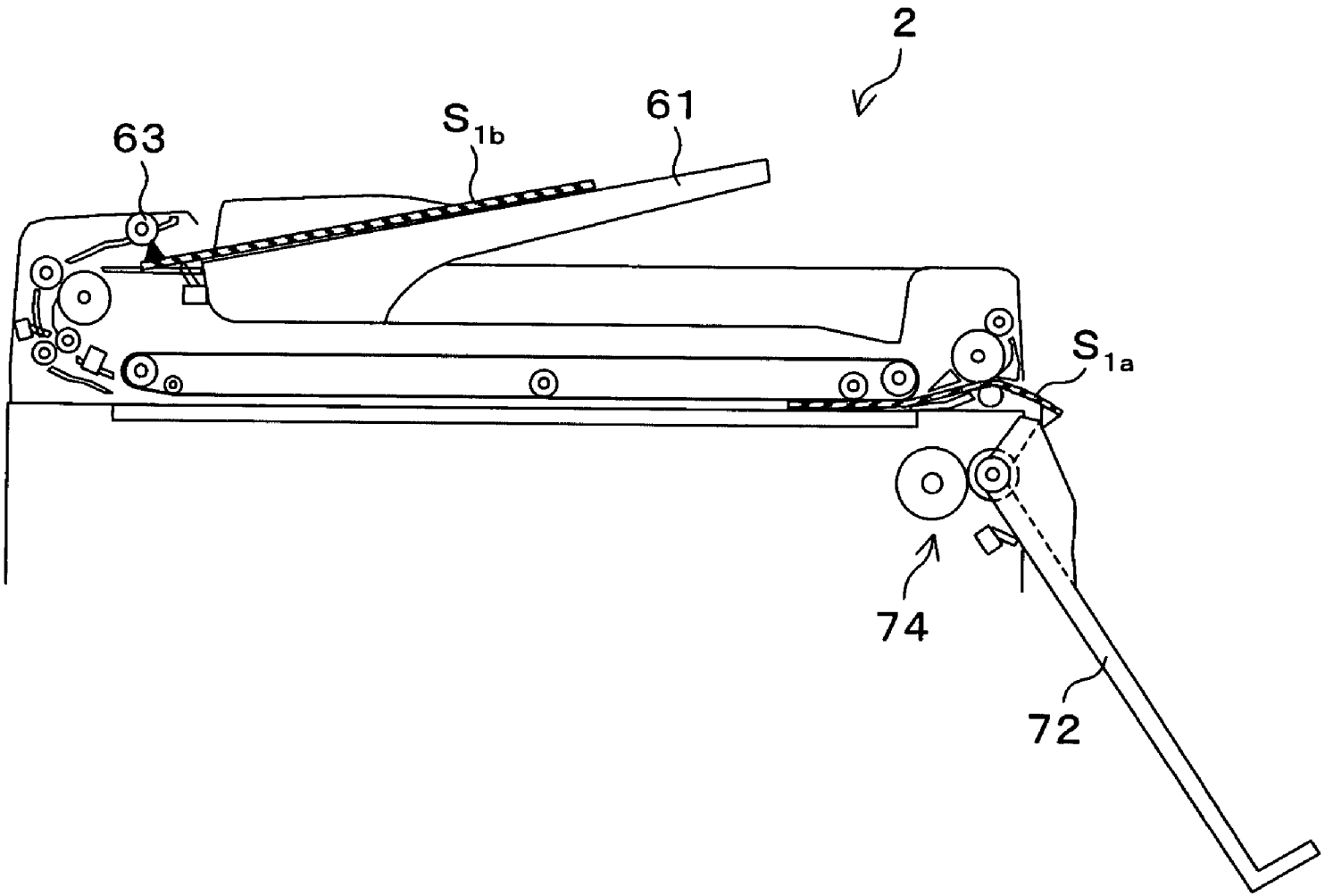
FIG. 8 is a cross-sectional view of the sheet transport apparatus during the transporting of the sheets, and shows a state after the state shown in FIG. 7.

In this case, the first eject tray 72 is set to the second set position (downward), as shown in FIG. 6 (corresponding to S2 in FIG. 5). Then, the sheet $S_{1a}$ is transported to a predetermined position, as shown in FIG. 7 (corresponding to S3). Next, the sheet $S_{1a}$ is ejected to the first eject tray 72 which is in the second set position, as shown in FIG. 8 (corresponding to S4).

Figure 9:
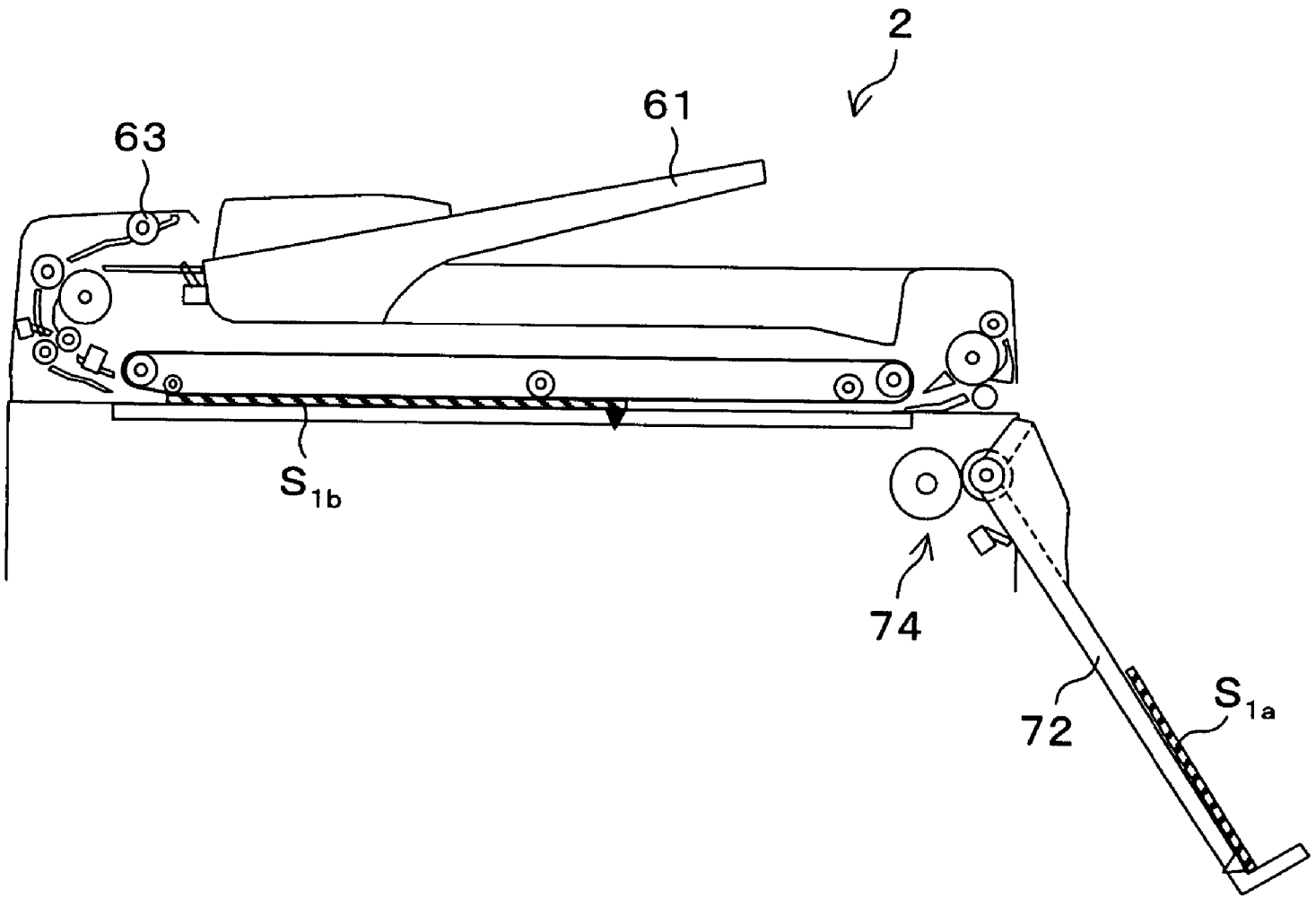
FIG. 9 is a cross-sectional view of the sheet transport apparatus during the transporting of the sheets, and shows a state after the state shown in FIG. 8.
Figure 10:
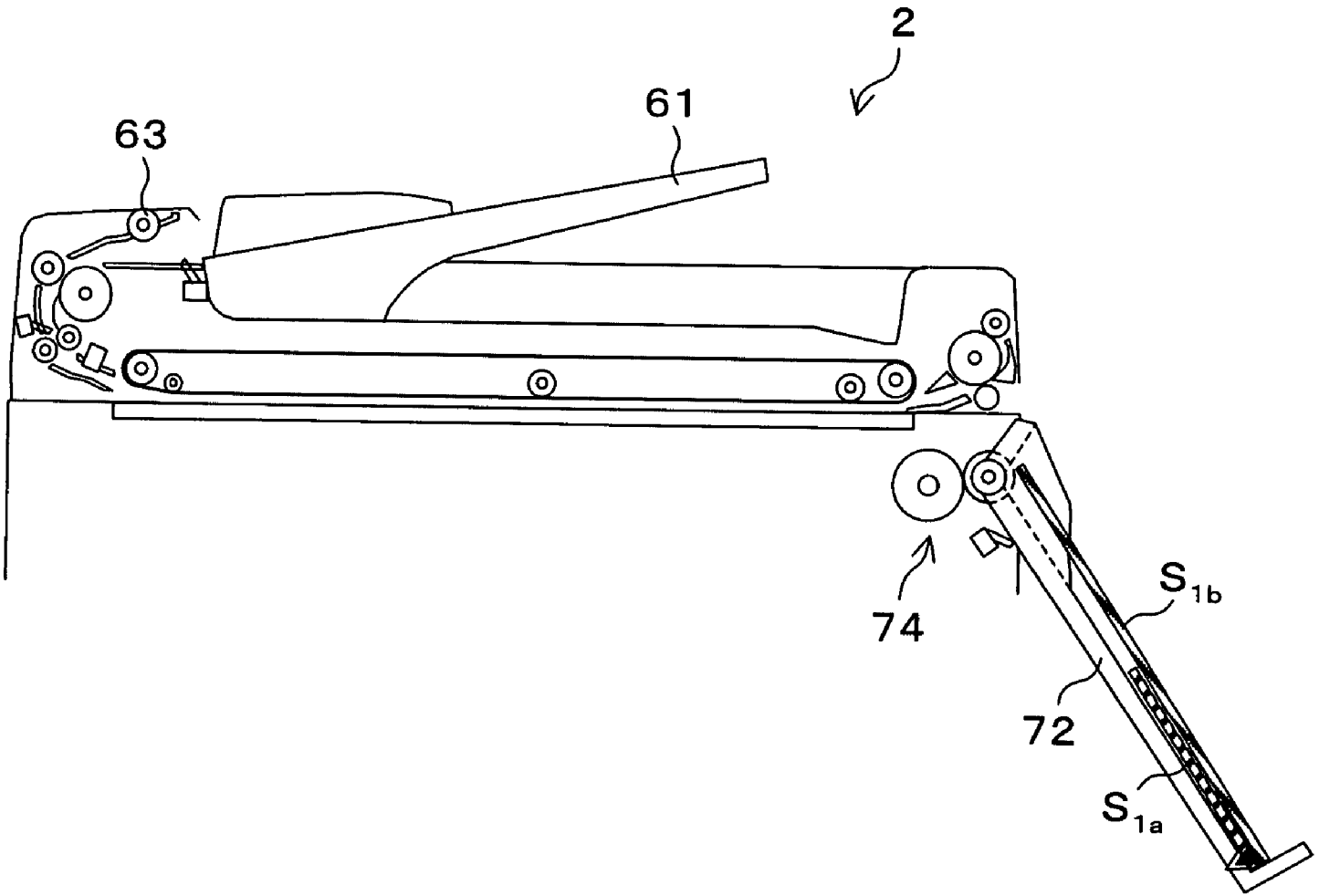
FIG. 10 is a cross-sectional view of the sheet transport apparatus when finishing transporting the sheets, and shows a state after the state shown in FIG. 9.

After this, since the sheet $S_{1b}$ is placed on the sheet supply tray 61, the sheet $S_{1b}$ is transported to the predetermined position, as shown in FIG. 9 (corresponding to S5 and S3). Then, like the sheet $S_{1a}$, the sheet $S_{1b}$ is ejected to the first eject tray 72, as shown in FIG. 10 (corresponding to S4). With this, the processing ends.

Here, notably, the sheet order of the sheets ($S_{1a}$ and $S_{1b}$) when placed on the sheet supply tray 61 is retained, and the leading edges (white triangle mark and black triangle mark in FIG. 10) of the sheets ($S_{1a}$ and $S_{1b}$) are aligned, as shown in FIG. 10.

With this, the user can obtain from the first eject tray 72, the sheets in the same state as the sheets when placed on the sheet supply tray 61.

Note that, in this case, the sheets ($S_{1a}$ and $S_{1b}$) are in a face-down state on the first eject tray 72.

Figure 11:
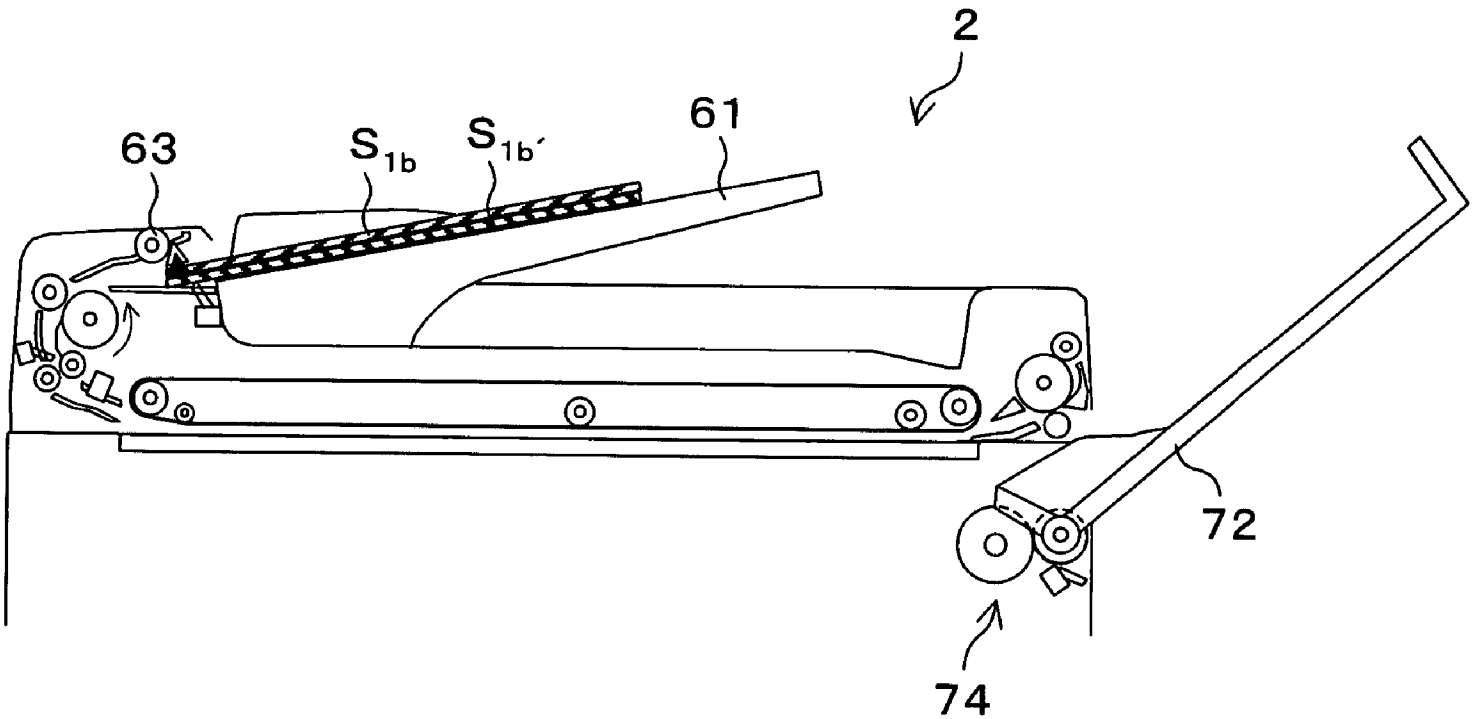
FIG. 11 is a cross-sectional view of the sheet transport apparatus before starting transporting the sheets in a case in accordance with the flowchart where the sheets all have the same sheet length.
Figure 12:
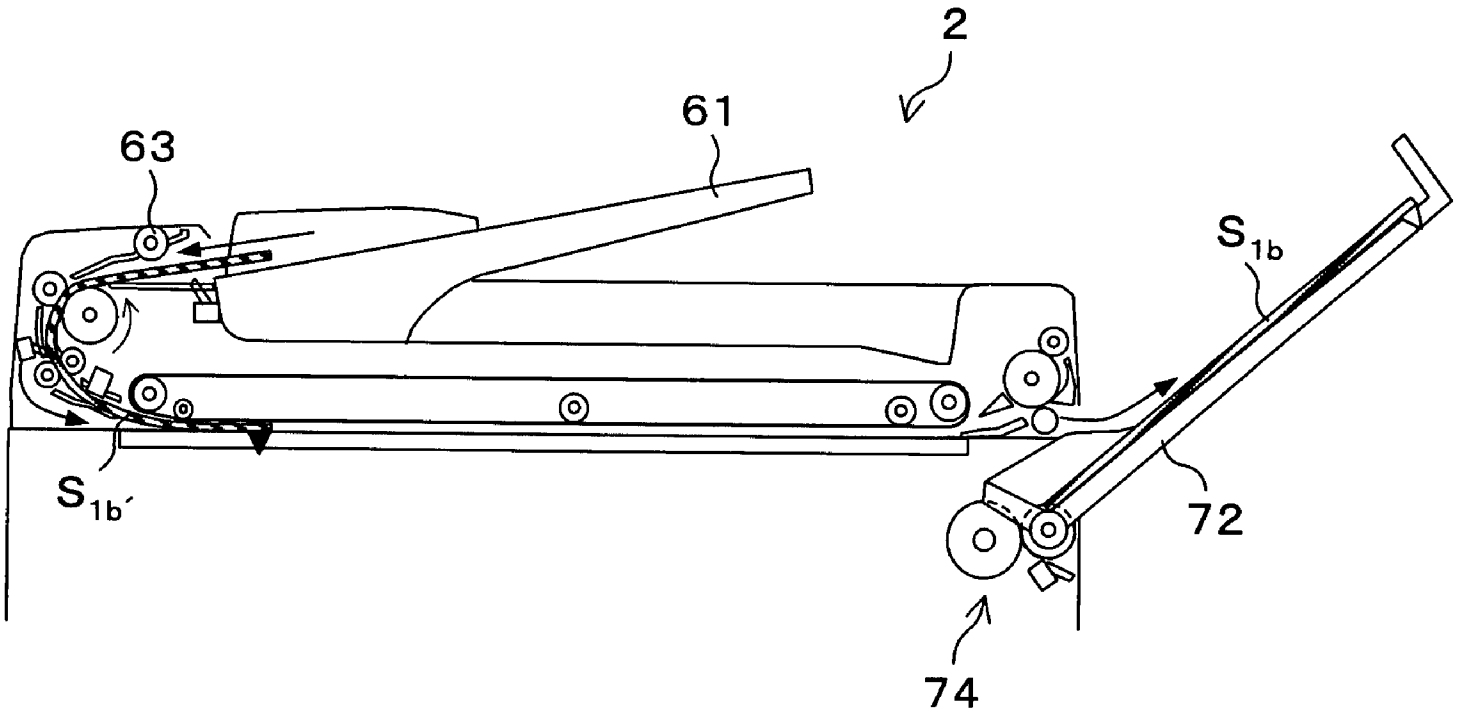
FIG. 12 is a cross-sectional view of the sheet transport apparatus after starting transporting the sheets, and shows a state after the state shown in FIG. 11.
Figure 13:
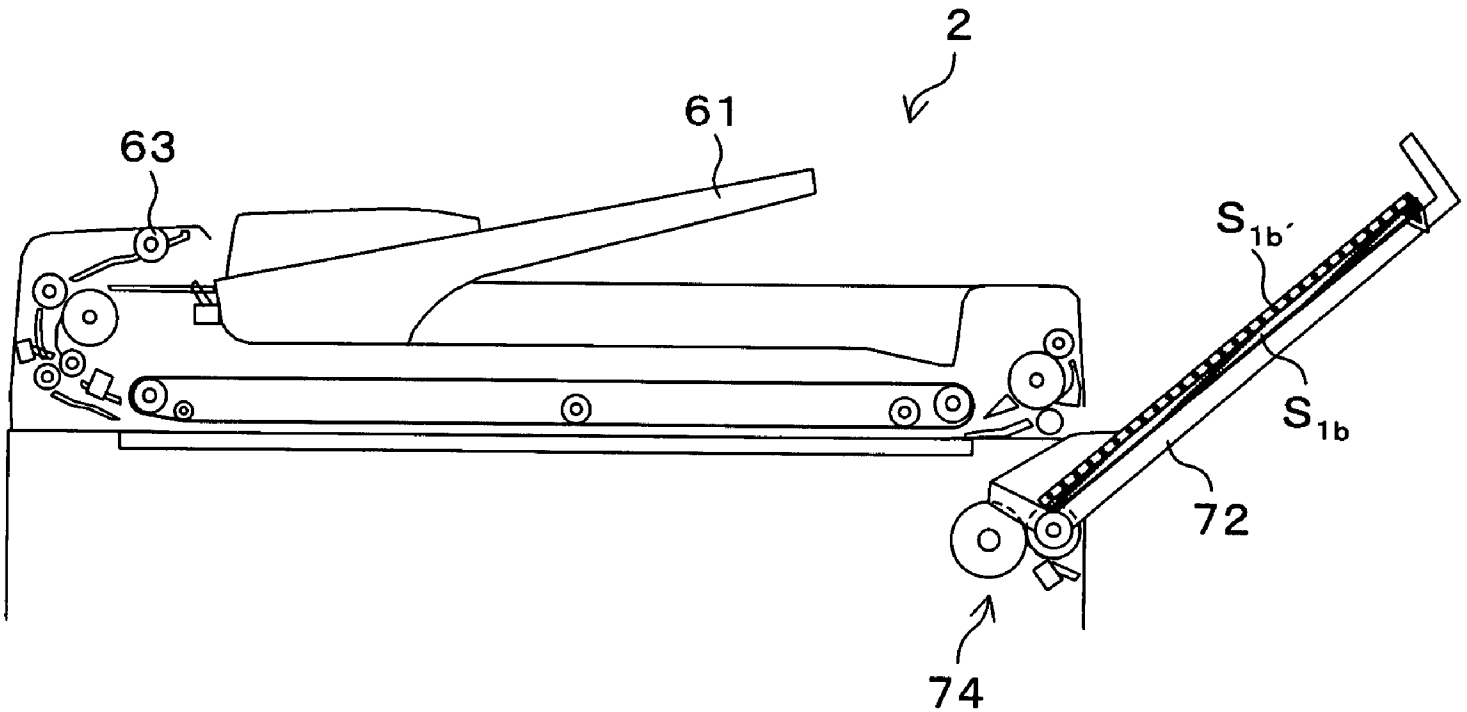
FIG. 13 is a cross-sectional view of the sheet transport apparatus when finishing transporting the sheets, and shows a state after the state shown in FIG. 12.

Next, FIGS. 11 through 13 show a case where two sheets ($S_{1b}$ and $S_{1b'}$) having different sheet lengths are transported and the control section 60 judges in S1 shown in FIG. 5 that the mixed processing is not selected. Note that, the leading edge of the sheet $S_{1b}$ is indicated by the white triangle mark, and the leading edge of the sheet $S_{1b'}$ is indicated by the black triangle mark in FIGS. 10 through 13. Further, the sheet $S_{1b}$ is placed on the sheet $S_{1b'}$ in the sheet supply tray 61.

In this case, the first eject tray 72 is set to the first set position (upward), as shown in FIG. 11 (corresponding to S6 in FIG. 5). Then, the sheet $S_{1b}$ is transported to a predetermined position (corresponding to S3). Next, the sheet $S_{1b}$ is ejected to the first eject tray 72 which is in the first set position, as shown in FIG. 12 (corresponding to S4).

After this, since the sheet $S_{1b'}$ is placed on the sheet supply tray 61, the sheet $S_{1b'}$ is transported to the predetermined position (corresponding to S5 and S3). Then, like the sheet $S_{1b}$, the sheet $S_{1b'}$ is ejected to the first eject tray 72, as shown in FIG. 13 (corresponding to S4). With this, the processing ends.

Here, the sheet order of the sheets ($S_{1b}$ and $S_{1b'}$) when placed on the sheet supply tray 61 is retained, and the leading edges (white triangle mark and black triangle mark in FIG. 10) of the sheets ($S_{1b}$ and $S_{1b'}$) are aligned, as shown in FIG. 13.

Note that, in this case, the sheets ($S_{1b}$ and $S_{1b'}$) are in the face-down state on the first eject tray 72.

Here, in the case where sheets having the same sheet length are transported, it is possible to align the leading edges of the sheets even if the first eject tray 72 is set to the second set position. Nevertheless, the first eject tray 72 is set to the first set position here for the following reasons.

Figure 14:
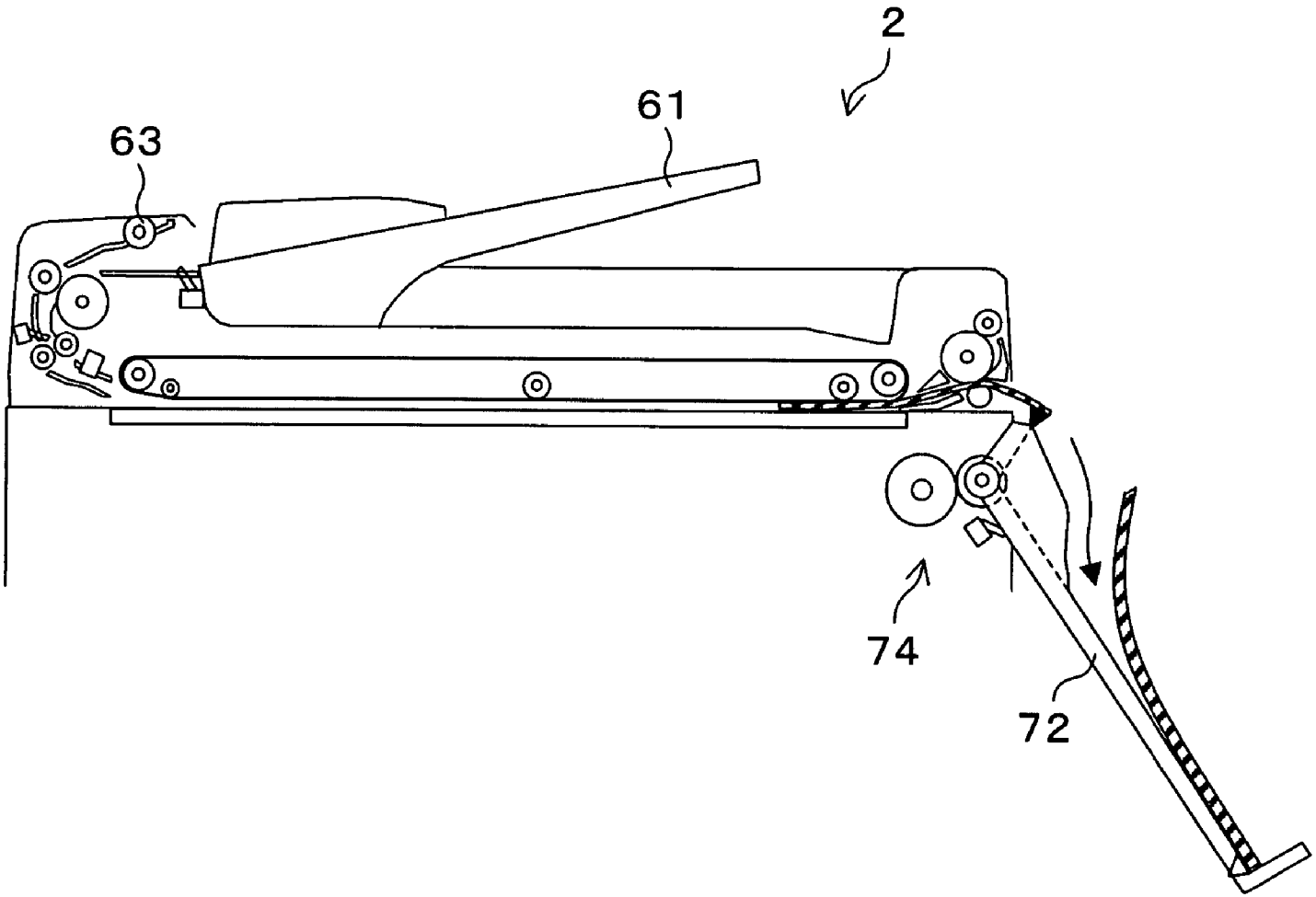
FIG. 14 is a cross-sectional view of the sheet transport apparatus, and shows a case where the order of the sheets changes after the sheets are transported.

Namely, if the first eject tray 72 is set to the second set position, there is a possibility that the following problem will occur. Namely, if the trailing edge of an ejected sheet is curled when placed on the first eject tray 72, the leading edge of a later ejected sheet may get under the curled trailing edge of the previously ejected sheet as shown in FIG. 14, thus changing the order of the sheets.

Accordingly, in order to more surely retain the order of the sheets, the first eject tray 72 is set to the first set position when the sheets having the same sheet length are transported.

Further, it is preferable that the first eject tray 72 is set to the first set position when the sheet transport apparatus is started up, such as when the power is applied to the sheet transport apparatus, and the first eject tray 72 is then moved to the second set position when the mixed processing is to be performed. This is because cases where the mixed processing is carried out are generally considered to be less than cases where the mixed processing is not carried out.

EXAMPLE 2

Figure 16:
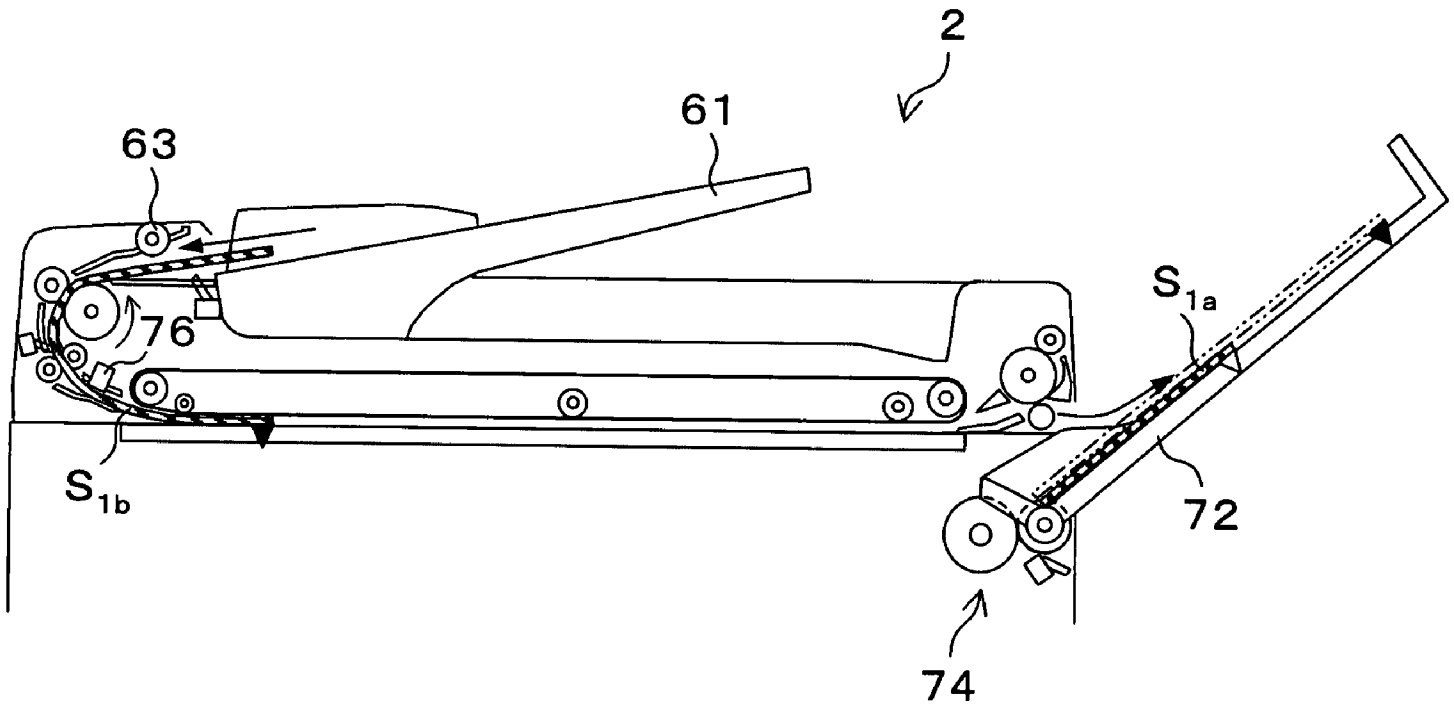
FIG. 16 is a cross-sectional view of the sheet transport apparatus during the transporting of the sheets in a case in accordance with the above another flowchart where the sheets have different sheet lengths.
Figure 17:
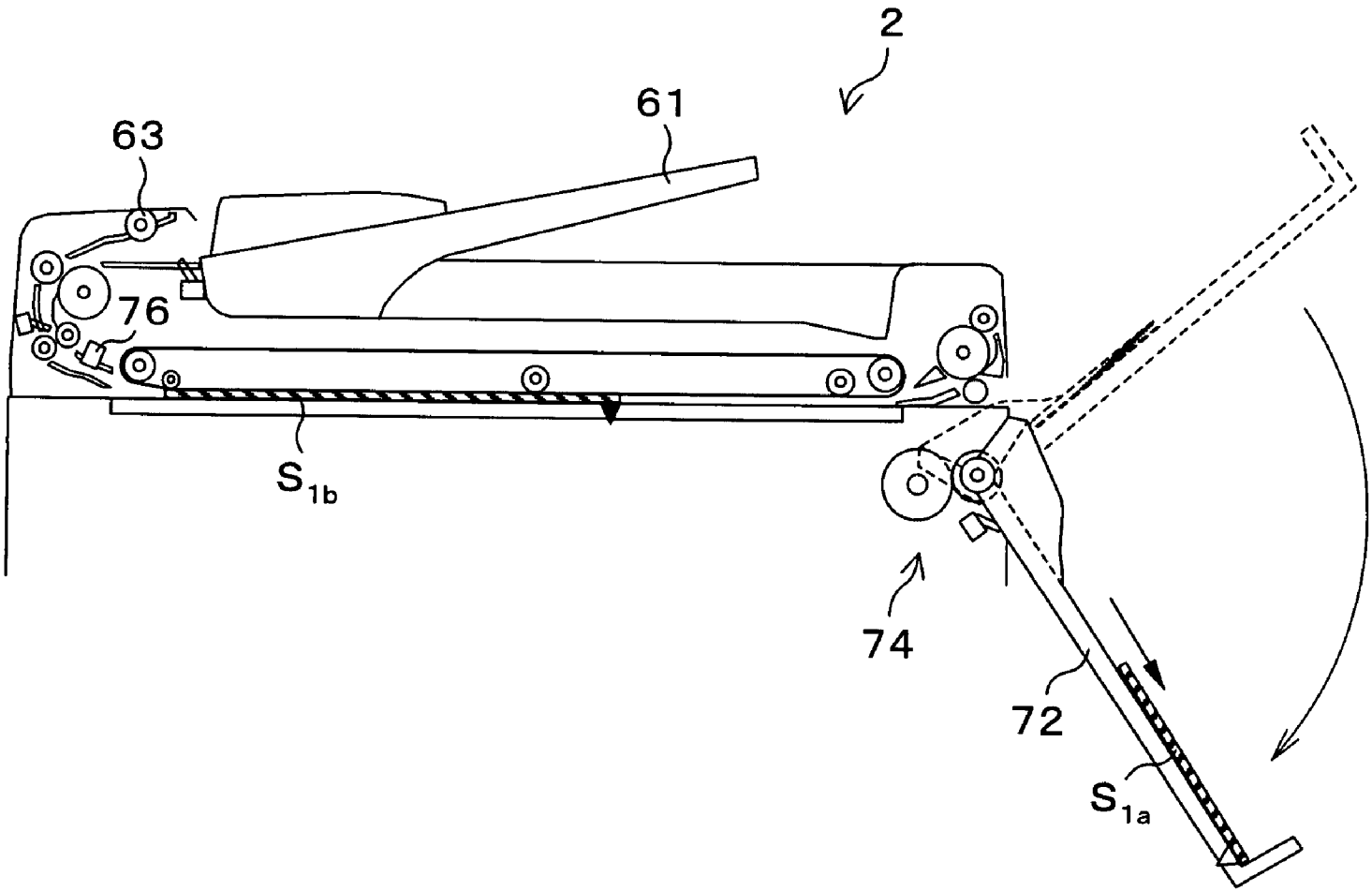
FIG. 17 is a cross-sectional view of the sheet transport apparatus after a first eject tray is moved so as to align the leading edges of the sheets, and shows a state after the state shown in FIG. 16.

The following will explain the present example with reference to FIGS. 15 through 17. Note that, the explanation with respect to FIGS. 15 through 17 will also describe a case where the function of the first sheet transport suspend section 83 is turned off.

FIG. 15 is a flowchart of the processing where the sheet length detector 76 and the sheet mixing judgment section 82 are used. In other words, the user does not give an instruction (input) as to the execution of the mixed processing through the operation input section 52, but the sheet transport section 2 automatically performs the mixed processing.

First, the sheets are sequentially transported one sheet at a time by the pickup roller 63, the resist roller 68, the transport belt 69, and the like (S11). Then, the sheet length of the transported sheet is detected by the sheet length detector 76 (S12). After S12, the sheet is transported to a predetermined position (S13). Note that, in the predetermined position, an image on the sheet is read by the image reading section 3.

After S13, it is judged whether or not the sheet is the first sheet (S14). Note that, this judgment may be given by the sheet mixing judgment section 82 which has received information of the sheet length of the sheet from the sheet length detector 76. Further, the sheet mixing judgment section 82 may obtain from the image reading section 3, information as to how many times the image reading section 3 has read an image, and then give the judgment based on the obtained information.

If it is judged in S14 that the sheet is the first sheet, the first sheet is ejected to the first eject tray 72 (S15). On the other hand, if it is judged in S14 that the sheet is not the first sheet, then it is judged whether the sheet has the same length as a sheet that has been transported before (S16). This judgment is given by the sheet mixing judgment section 82.

If it is judged in S16 that the sheet has the same sheet length, the processing proceeds to S15 and the sheet is ejected to the first eject tray 72. Note that, the position of the first eject tray in S15 may be either the first set position or the second set position.

On the other hand, if it is judged in S16 that the sheet does not have the same sheet length, the first eject tray position detector 75 judges whether or not the first eject tray 72 is set to the second set position (namely, downward) (S17).

If it is judged in S17 that the first eject tray 72 is in the second set position, the first eject tray operation section 74 does not move the first eject tray 72, and the sheet is ejected to the first eject tray 72 (S18).

On the other hand, if it is judged in S17 that the first eject tray 72 is not in the second set position, namely, if the first eject tray 72 is in the first set position (namely, upward), the first eject tray operation section 74 moves the first eject tray 72 to the second set position (S19). After S19, the sheet is ejected to the first eject tray 72 by the transport belt 69 and the like (S18).

After S18, the sheet detector 62 judges whether or not there is a sheet on the sheet supply tray 61 (S20). If it is judged in S20 that there is a sheet, the remaining sheet(s) are transported one sheet at a time by the pickup roller 63, the resist roller 64, the transport belt 69, and the like (S21). After S21, the sheet is transported to the predetermined position, and an image on the sheet is read (S22). After S22, the read sheet is ejected to the first eject tray 72 which is in the second set position (S23). After S23, the processing goes back to S20.

On the other hand, if it is judged in S20 that there is no sheet, the processing ends.

Further, after S15, it is judged whether or not there is a sheet on the sheet supply tray 61 (S24). If it is judged in S24 that there is a sheet, the processing goes back to S11 again. On the other hand, if it is judged in S24 that there is no sheet, the processing ends.

Next, a concrete example of the processing in accordance with the flowchart shown in FIG. 15 will be explained with reference to FIGS. 16 and 17.

FIGS. 16 and 17 show a case where two sheets ($S_{1a}$ and $S_{1b}$) having different sheet lengths are transported. Note that, the leading edge of the sheet $S_{1a}$ is indicated by the white triangle mark, and the leading edge of the sheet $S_{1b}$ is indicated by the black triangle mark in FIGS. 16 and 17. Further, the sheet $S_{1a}$ is placed on the sheet $S_{1b}$ in the sheet supply tray 61.

FIG. 16 shows a state where the first sheet $S_{1a}$ has been ejected to the first eject tray 72. Note that, the first eject tray 72 is set to the first set position as an initial state.

In this case, since the sheet $S_{1a}$ is the first sheet, the sheet $S_{1a}$ is ejected to the first eject tray 72 which is in the first set position (corresponding to S14 and S15 in FIG. 15).

Then, it is judged whether or not the second sheet $S_{1b}$ has the same sheet length as the previously transported sheet $S_{1a}$ (corresponding to S16). In this case, the sheets $S_{1a}$ and the sheet $S_{1b}$ have different sheet lengths from each other. Accordingly, the first eject tray operation section 74 moves the first eject tray 72 to the second set position (corresponding to S19). Then, the sheet $S_{1b}$ is ejected to the first eject tray 72 by the transport belt 69 and the like.

Also in this case, the sheet order of the sheets ($S_{1a}$ and $S_{1b}$) when placed on the sheet supply tray 61 is retained, and the leading edges (white triangle mark and black triangle mark in the drawing) of the sheets ($S_{1a}$ and $S_{1b}$) are aligned.

Note that, in this case, the sheets ($S_{1a}$ and $S_{1b}$) are in the face-down state on the first eject tray 72.

EXAMPLE 3

Figure 19:
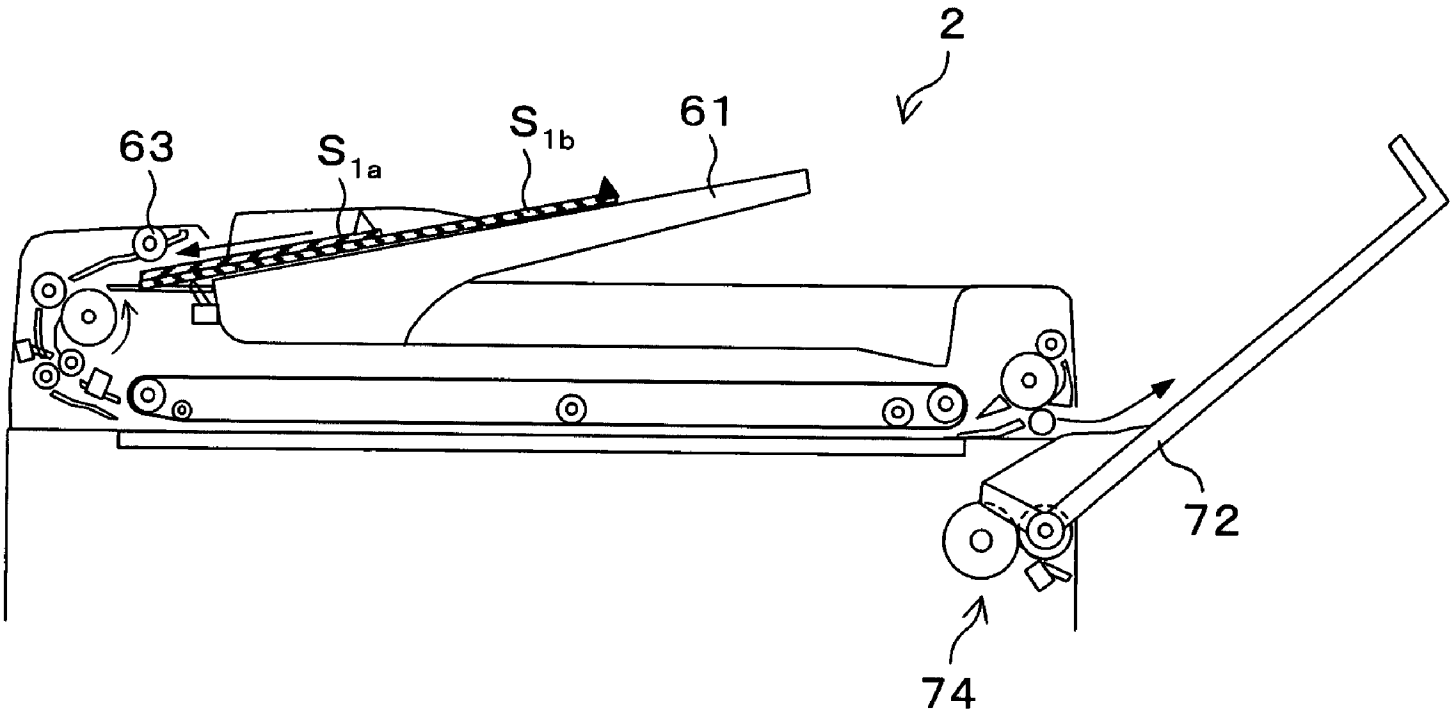
FIG. 19 is a cross-sectional view of the sheet transport apparatus on which the sheets whose leading edges are not aligned after the sheets are read are placed so as to align the leading edges of the sheets.
Figure 20:
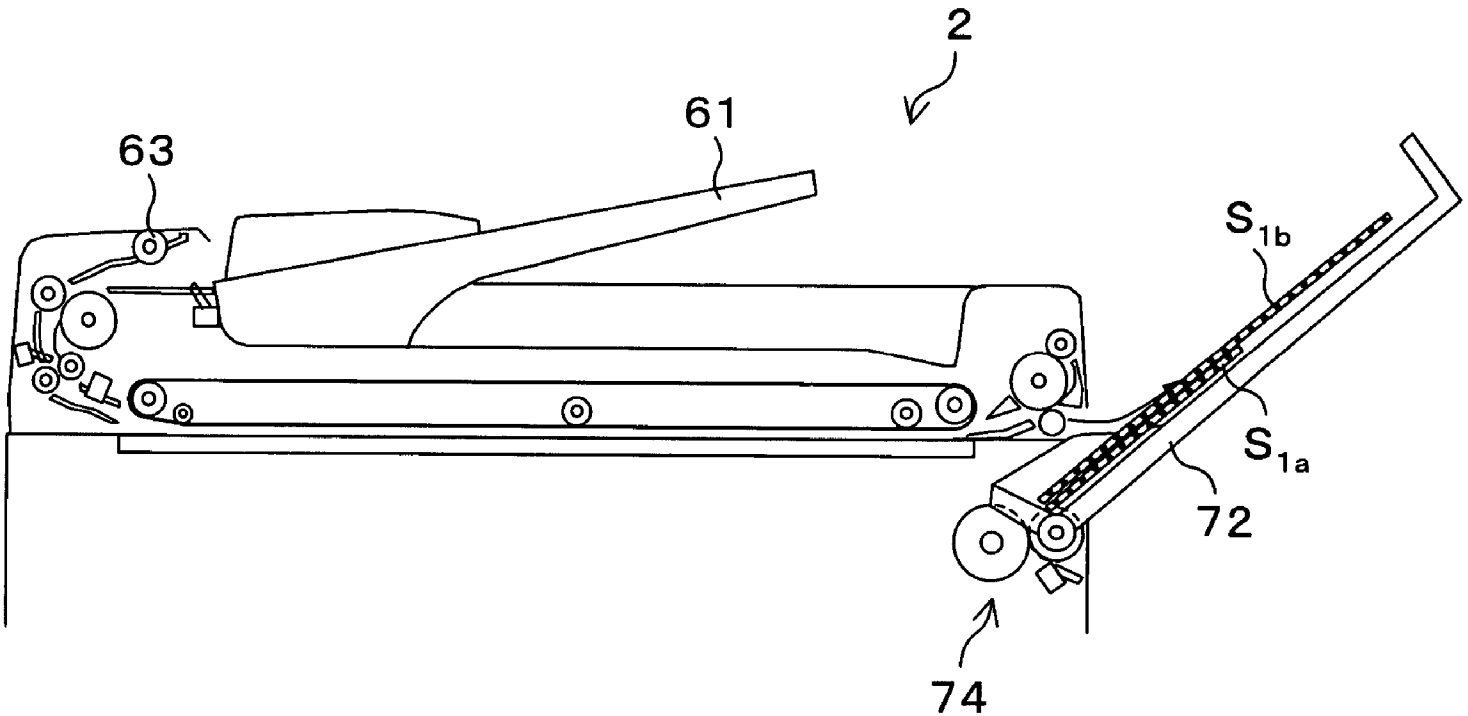
FIG. 20 is a cross-sectional view of the sheet transport apparatus after the leading edges of the sheets are aligned, and shows a state after the state shown in FIG. 19.

The following will explain the present example with reference to FIGS. 18 through 20. Note that, the explanation with respect to FIG. 18 will describe a case where the function of the first sheet transport suspend section 83 is turned on.

The steps S31 through S37 shown in FIG. 18 and the step S56 are respectively the same as the steps S11 through S17 and the step S24 in Example 2, thus their explanation is omitted here. The following will explain steps from S38 except S56.

If it is judged in S37 that the first eject tray 72 is in the second set position, the first eject tray operation section 74 does not move the first eject tray 72, and the sheet is ejected to the first eject tray 72 (S38).

After S38, the sheet detector 62 judges whether or not there is still a sheet on the sheet supply tray 61 (S39). If it is judged in S39 that there is any sheet, the remaining sheet(s) are transported one sheet at a time by the pickup roller 63, the resist roller 68, the transport belt 69, and the like (S40). After S40, the sheet is transported to a predetermined position, and an image on the sheet is read (S41). After S41, the read sheet is ejected to the first eject tray 72 which is in the second set position (S42). After S42, the processing goes back to S39.

On the other hand, if it is judged in S39 that there is no sheet, the processing ends.

Incidentally, if it is judged in S37 that the first eject tray 72 is not in the second set position, namely, if it is judged in S37 that the first eject tray 72 is in the first set position (namely, upward), the first sheet transport suspend section temporarily suspends the transporting of the sheets (S43).

After S43, the control section 60 sends to the operation section 5, information that the transporting of the sheets is suspended. Then, in this case, the display section 5 displays a warning notifying the user that the leading edges of the sheets are not aligned, for example (S44).

After S44, the control section 60 judges whether or not the operation input section 52 has been subjected to any input operation performed by the user (S45). If it is judged in S45 that any input operation has been performed, it is judged whether or not the performed input operation is to change the position of the first eject tray 72 to the second set position (S46).

If it is judged in S46 that the input operation is to change the position of the first eject tray 72 to the second set position, the first eject tray operation section 74 moves the first eject tray 72 to the second set position (S47). After S47, the sheet is ejected to the first eject tray 72 (S48). After S48, the processing proceeds to S39, and similar steps as described above are sequentially performed. Alternatively, processing after S48 may be performed as follows. Namely, it is judged whether or not there is a sheet on the sheet supply tray 61, and if there is a sheet, the processing proceeds to S31. Then, a mixed state of the sheets is checked again so as to direct the user to proceed processing for moving or not moving the first eject tray 72.

Further, if it is judged in S45 that no input operation is performed, the control section 60 judges whether or not a predetermined time has elapsed (S49). If it is judged in S49 that the predetermined time has not elapsed, the processing goes back to S45 again.

On the other hand, if it is judged in S49 that the predetermined time has elapsed, the sheet is ejected to the first eject tray 72 which is in the first set position (S50). Further, if it is judged in S46 that the input operation is not to change the position of the first eject tray 72 to the second set position, the sheet is similarly ejected to the first eject tray 72 in the first set position (S50).

After S50, the sheet detector 62 judges whether or not there is still a sheet on the sheet supply tray 61 (S51). If it is judged in S51 that there is still a sheet, the remaining sheet(s) are transported one sheet at a time by the pickup roller 63, the resist roller 68, the transport belt 69, and the like (S52). After S52, the sheet is transported to the predetermined position, and an image on the sheet is read (S53). After S53, the read sheet is ejected to the first eject tray 72 which is in the second set position (S54). After S54, the processing goes back to S51.

On the other hand, if it is judged in S51 that there is no sheet, the control section 60 sends to the display section 53 an instruction that causes the display section 53 to display that it is necessary to align the leading edges of the sheets and/or display a method for aligning the leading edges of the sheets. With this, the display section 53 displays that it is necessary to align the leading edges of the sheets and/or displays a method for aligning the leading edges of the sheets (S55). After the displaying is carried out in S55, the processing ends.

Here, a method for aligning the leading edges of the sheets displayed on the display section 53 will be explained with reference to FIGS. 19 and 20.

When the processing in S55 is performed, the trailing edges of the sheets are aligned. Here, the sheets in this state are placed on the sheet supply tray 61 again, as shown in FIG.

19. Then, the sheets are transported while the function of the reading operation stop section 35 is turned on, namely, while the reading of an image is stopped. With this, the sheets are ejected to the first eject tray 72 in the first set position with the leading edges of the sheets being aligned, as shown in FIG. 20.

Here, the foregoing embodiment showed the arrangement where the operation section 5 is provided separately from the sheet transport section (sheet transport apparatus) 2, but the arrangement is not limited to this. The sheet transport section 2 and the operation section 5 may constitute the sheet transport apparatus.

Further, in the explanation of the embodiment, the first eject tray operation section (alignment means) 74 is provided to move the set position of the first eject tray 72. However, the first eject tray operation section 74 may not be provided and the first eject tray 72 may be fixed to a position corresponding to the second set position. In this case, if the sheets have different sheet lengths, the sheets are ejected to the first eject tray whose position is fixed. With this, it is possible to retain the same sheet order of the sheets when placed on the sheet supply tray 61, and align the leading edges of the sheets.

[Second Embodiment]

The following will explain another embodiment of the present invention with reference to FIGS. 21 through 32. Note that, for ease of explanation, members having the same functions as those shown in the drawings pertaining to First Embodiment above will be given the same reference symbols, thus their explanation will be omitted here.

An image forming apparatus 1' in accordance with the present embodiment is provided with a sheet transport section (sheet transport apparatus) 2', an image reading section 3, an image forming section 4, and an operation section 5 (not shown). Note that, the sheet transport section 2', the image reading section 3, and the operation section 5 form an image reading apparatus.

In other words, the image forming apparatus 1' in accordance with the present embodiment differs from the image forming apparatus 1 in accordance with First Embodiment in terms of the sheet transport section 2'. Further, the operation section 5 of the present embodiment differs from the operation section 5 shown in First Embodiment in that the first transmission section 51*a* is not provided.

Figure 21:
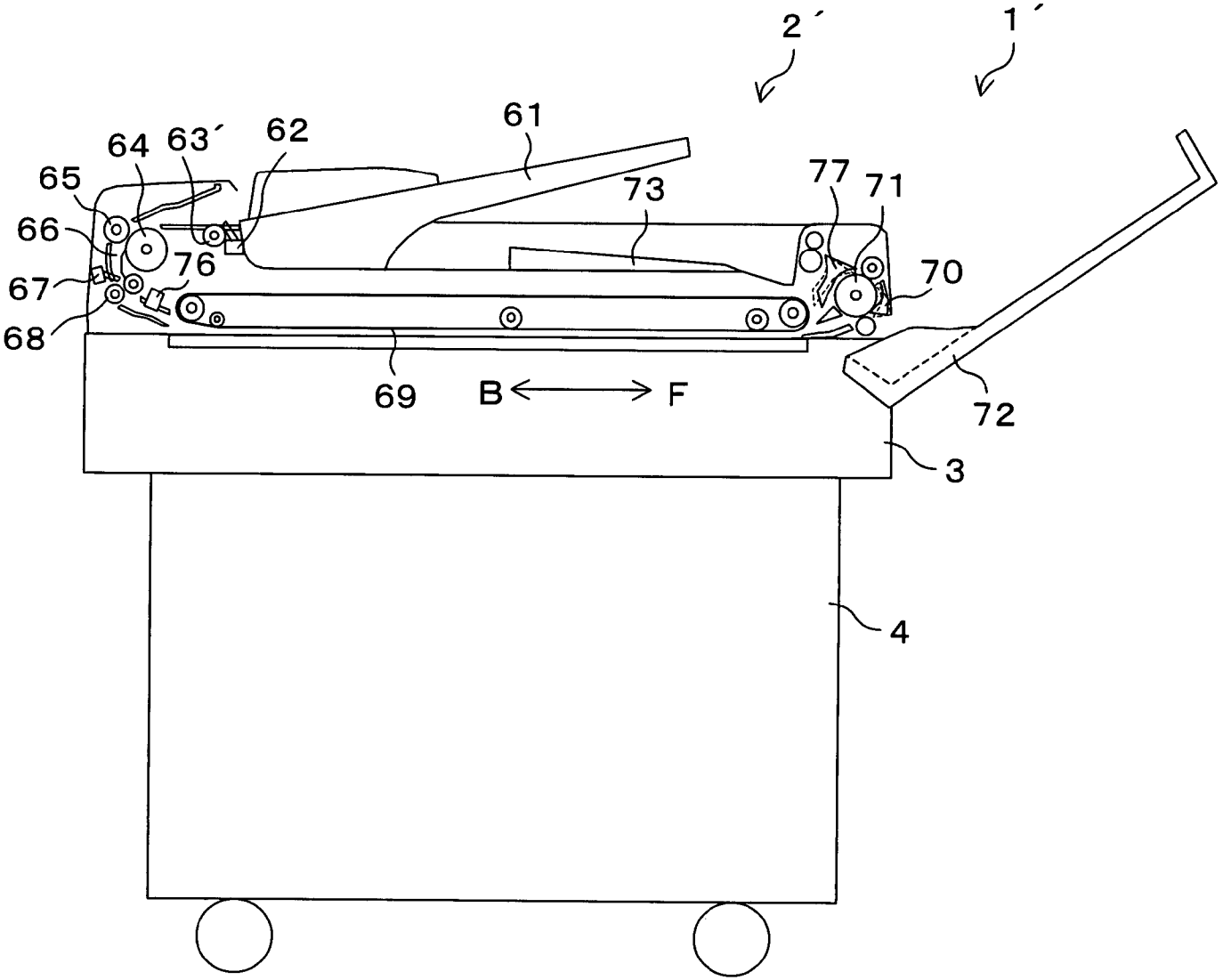
FIG. 21 is a cross-sectional view showing an embodiment of an image forming apparatus provided with another sheet transport apparatus in accordance with the present invention.

As shown in FIG. 21, the sheet transport section 2' is provided with a sheet supply tray 61, a sheet detector 62, a pickup roller 63', a paper feed roller 64, a separation roller 65, a curved transport path 66, a sheet transport timing detector 67, a resist roller 68, a transport belt 69, a reversal switching flapper 70, a reversing roller 71, a first eject tray (first sheet eject means) 72, a second eject tray (second sheet eject means) 73, a sheet length detector 76, an ejection switching flapper 77, and a control section 60 (not shown).

In other words, compared with the sheet transport section 2 of First Embodiment, the sheet transport section 2' of the present embodiment is not provided with the first eject tray operation section (alignment means) 74 and the first eject tray position detector 75. Further, the sheet transport section 2' is provided with the pickup roller 63' instead of the pickup roller 63. Further, the sheet transport section 2' is newly provided with the ejection switching flapper 77.

Further, the control section 60 of the present embodiment is arranged the same as the control section 60 of First Embodiment except that the first reception section 81*a* and the first sheet transport suspend section 83 are not provided.

Here, the sheet supply tray 61, the sheet detector 62, the pickup roller 63', the paper feed roller 64, and the separation roller 65 constitute the sheet supply means as recited in the claims. Further, the reversal switching flapper 70, the reversing roller 71, and the ejection switching flapper 77 constitute alignment means (alignment section) as recited in the claims.

Further, the sheet transport timing detector 67, the resist roller 68, the transport belt 69, and the reversing roller 71 constitute the sheet transport means (sheet transport section) as recited in the claims.

The pickup roller 63' picks up sheets placed on the sheet supply tray 61 basically one sheet at a time. The pickup roller 63' sequentially picks up the sheets placed on the sheet supply tray 61 in order from a sheet placed on the bottom. The other functions of the pickup roller 63' are the same as those of the pickup roller 63 of First Embodiment.

The ejection switching flapper 77 is a device which, in cooperation with the reversing roller 71 and the reversal switching flapper 70, switches back a sheet transported by the transport belt 69 in the direction of the transport belt 69 again. More specifically, the ejection switching flapper 77 is arranged so as to be movable. Here, the sheet can be switched back when the ejection switching flapper 77 is in a third switching position (position indicated by the solid line in FIG. 21), and the sheet can be ejected to the second eject tray 73 when the ejection switching flapper 77 is in a fourth switching position (position indicated by the broken line in FIG. 21). Note that, the reversal switching flapper 70 is required to be in the second switching position here.

Further, since the reversing roller 71 is used in the switching back, the front and back surfaces of the sheet are reversed before and after the switching back. When the sheet is switched back, the sheet reaches the transport belt 69 again. Here, the moving direction of the transport belt 69 is reversed and the sheet is temporarily transported in the direction of B in FIG. 21. After the switching back of the sheet is complete, the moving direction of the transport belt 69 is reversed again, and the sheet is transported to the direction of F in FIG. 21.

Here, the transporting of a sheet using the ejection switching flapper 77 will be explained with reference to an Example as described below. Note that, in the following explanation, reading of an image corresponds to the predetermined processing as recited in the claims as in First Embodiment.

EXAMPLE

The following will explain the present example with reference to FIGS. 22 through 32. Note that, the explanation with reference to FIGS. 22 through 32 describe cases where the function of the first sheet transport suspend section 83 is turned off. Further, the present example will explain cases where the user already knows whether or not the sheets include sheets having different lengths, and the user gives through the operation input section 52 an instruction (input) to perform the mixed processing when the user knows that the sheets include sheets having different lengths.

Figure 22:
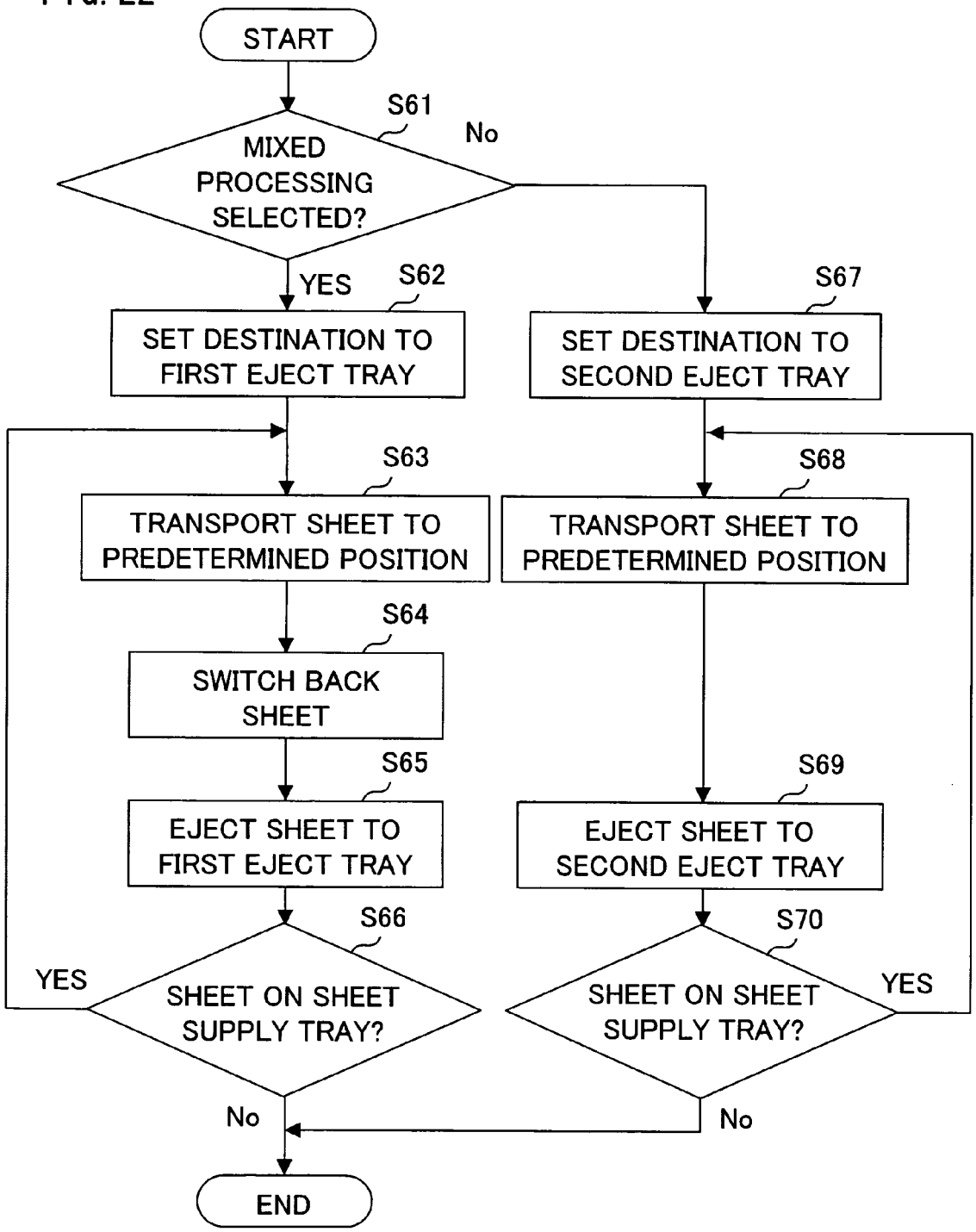
FIG. 22 is a flowchart showing the transporting of sheets in the above another sheet transport apparatus.

First, as shown in FIG. 22, the control section 60 judges whether or not the mixed processing is selected with respect to sheets placed on the sheet supply tray 61 (S61). Note that, the control section 60 judges in accordance with an input through the operation input section 52 whether or not the mixed processing is selected.

If the control section 60 judges in S61 that the mixed processing is selected, a destination to which the sheets are ejected is set to the first eject tray 72 (S62). Specifically, the control section 60 causes the ejection switching flapper 77 to be in the third switching position and the reversal switching flapper 70 to be in the second switching position.

On the other hand, if the control section 60 judges in S61 that the mixed processing is not selected, the destination to which the sheets are ejected is set to the second eject tray 73 (S67). Specifically, the control section 60 causes the ejection switching flapper 77 to be in the fourth switching position and the reversal switching flapper 70 to be in the second switching position.

After S62, the sheets are sequentially transported to a predetermined position one sheet at a time by the pickup roller 63', the resist roller 68, the transport belt 69, and the like (S63). Further, an image is read in the predetermined position by the image reading section 3.

After S63, the sheet transported by the transport belt 69 is switched back using the reversal switching flapper 70, the reversing roller 71, and the ejection switching flapper 77 (S64). After S64, the sheet is ejected to the first eject tray 72 (S65). Note that, in this case, the reversal switching flapper 70 is set to the first switching position, and the sheet is ejected to the first eject tray 72.

After S65, the sheet detector 62 judges whether or not there remains any sheet in the sheet supply tray 61 (S66). If there remains any sheet in S66, the processing goes back to S63. On the other hand, if there remains no sheet in S66, the processing ends.

Further, after S67, the sheets are sequentially transported to the predetermined position one sheet at a time by the pickup roller 63', the resist roller 68, the transport belt 69, and the like (S68). Further, an image is read in the predetermined position by the image reading section 3.

After S68, the sheet is ejected to the second eject tray 73 (S69). After S69, the sheet detector 62 judges whether or not there remains any sheet in the sheet supply tray 61 (S70). If there remains any sheet in S70, the processing goes back to S68. On the other hand, if there remains no sheet in S70, the processing ends.

Next, concrete examples of the processing in accordance with the flowchart of FIG. 22 will be explained with reference to FIGS. 23 through 29.

Figure 23:
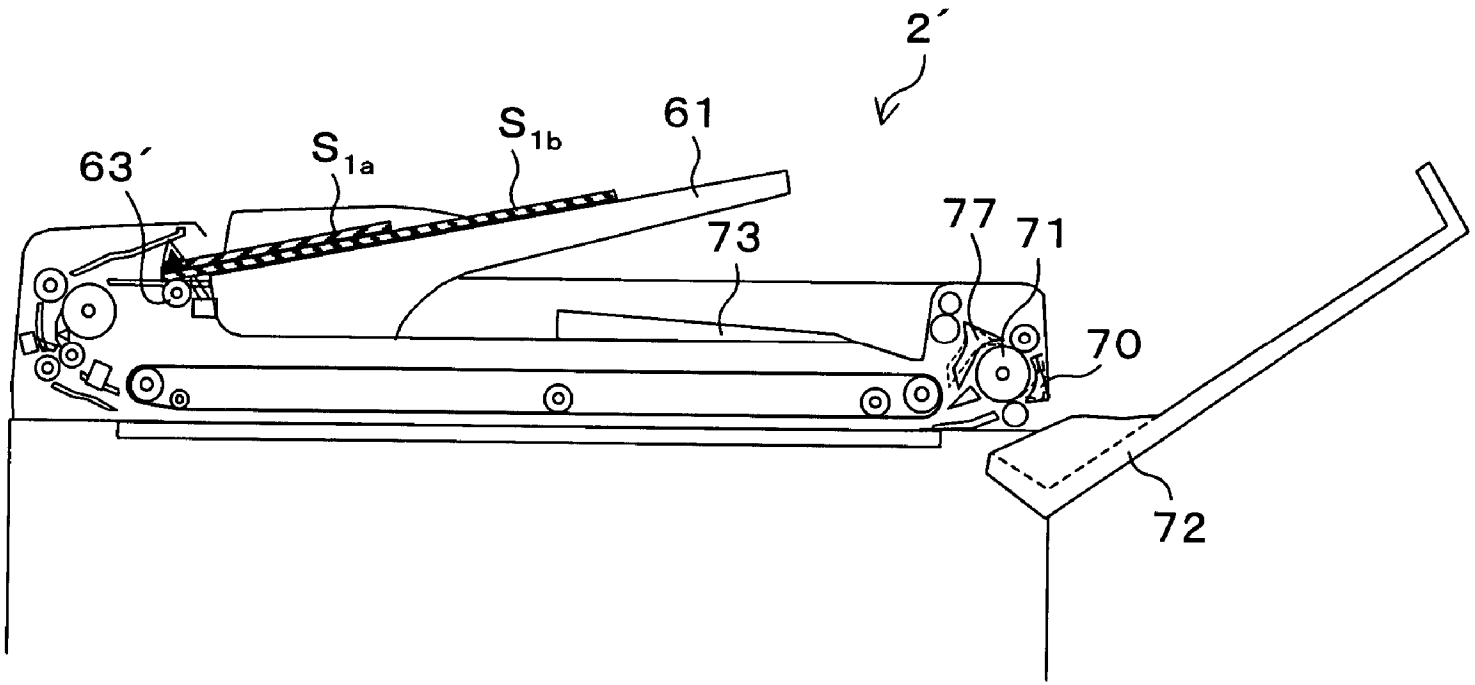
FIG. 23 is a cross-sectional view of the above another sheet transport apparatus before starting transporting the sheets in a case in accordance with the flowchart where the sheets have different sheet lengths.
Figure 24:
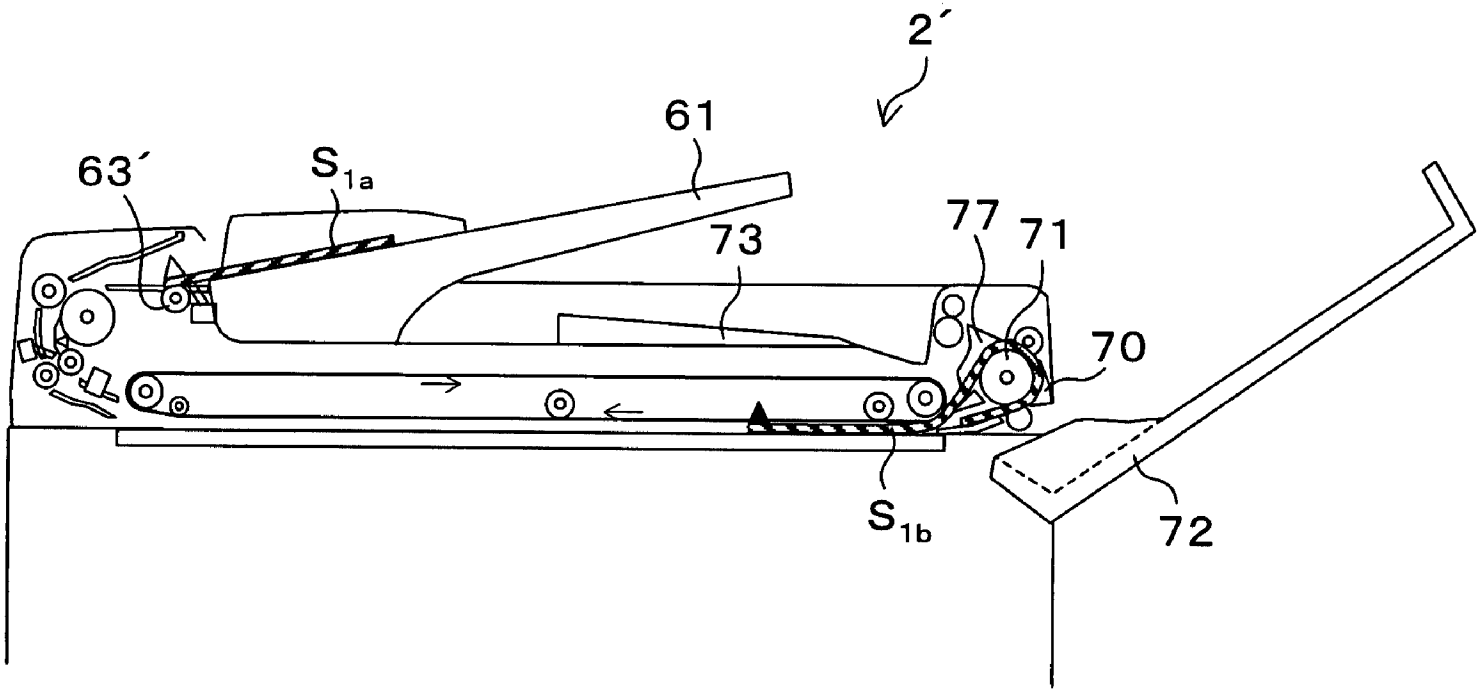
FIG. 24 is a cross-sectional view of the above another sheet transport apparatus where a sheet is switched back, and shows a state after the state shown in FIG. 23.
Figure 25:
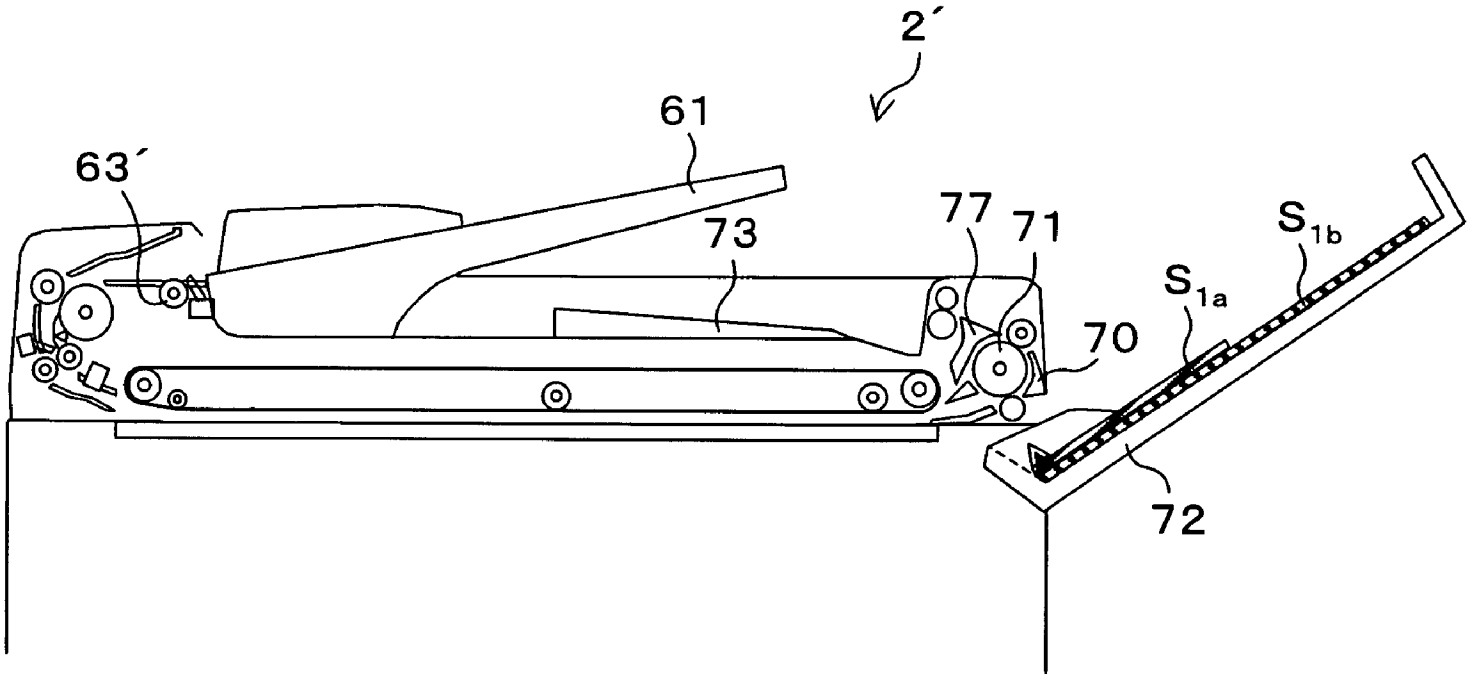
FIG. 25 is a cross-sectional view of the above another sheet transport apparatus when finishing transporting the sheets, and shows a state after the state shown in FIG. 24.

First, FIGS. 23 through 25 show a case where two sheets ($S_{1a}$ and $S_{1b}$) having different sheet lengths are transported and the control section 60 judges in S61 shown in FIG. 22 that the mixed processing is selected. Note that, the leading edge of the sheet $S_{1a}$ is indicated by the white triangle mark, and the leading edge of the sheet $S_{1b}$ is indicated by the black triangle mark in FIGS. 23 through 25. Further, the sheet $S_{1a}$ is placed on the sheet $S_{1b}$ in the sheet supply tray 61. Further, the sheets ($S_{1a}$ and $S_{1b}$) are placed on the sheet supply tray 61 in the face-up state, namely, in such a manner that the read surfaces of the sheets ($S_{1a}$ and $S_{1b}$) face upward.

In this case, first, the ejection switching flapper 77 is set to the third switching position, and the reversal switching flapper 70 is set to the second switching position (corresponding to S62 in FIG. 22), as shown in FIG. 23. Then, the sheet $S_{1b}$ is transported to a predetermined position, and the sheet is read (corresponding to S63). Next, the sheet $S_{1b}$ is switched back by the reversal switching flapper 70, the reversing roller 71, and the ejection switching flapper 77 (corresponding to S64). Here, the front and back surfaces of the sheet are reversed before and after the switching back. Then, the sheet $S_{1b}$ is ejected to the first eject tray 72 (corresponding to S65).

After this, since the sheet $S_{1a}$ is placed on the sheet supply tray 61, the sheet $S_{1a}$ is similarly processed as the sheet $S_{1b}$ (corresponding to Yes in S66). As a result, like the sheet $S_{1b}$, the sheet $S_{1a}$ is ejected to the first eject tray 72. With this, the processing ends.

Here, notably, the sheet order of the sheets ($S_{1a}$ and $S_{1b}$) when placed on the sheet supply tray 61 is retained, and the leading edges (white triangle mark and black triangle mark in the drawing) of the sheets ($S_{1a}$ and $S_{1b}$) are aligned, as shown in FIG. 25.

With this, the user can obtain the sheets in the same state as the sheets when placed on the sheet supply tray 61.

Note that, in this case, the sheets ($S_{1a}$ and $S_{1b}$) are in the face-up state on the first eject tray 72.

Next, FIGS. 26 through 29 show a case where two sheets ($S_{1b}$ and $S_{1b'}$) having different sheet lengths are transported and the control section 60 judges in S61 shown in FIG. 22 that the mixed processing is not selected. Note that, the leading edge of the sheet $S_{1b}$ is indicated by the white triangle mark, and the leading edge of the sheet $S_{1b'}$ is indicated by the black triangle mark in FIGS. 26 through 29. Further, the sheet $S_{1b}$ is placed on the sheet $S_{1b'}$ in the sheet supply tray 61. Further, the sheets ($S_{1b}$ and $S_{1b'}$) are placed on the sheet supply tray 61 in the face-up state.

Figure 26:
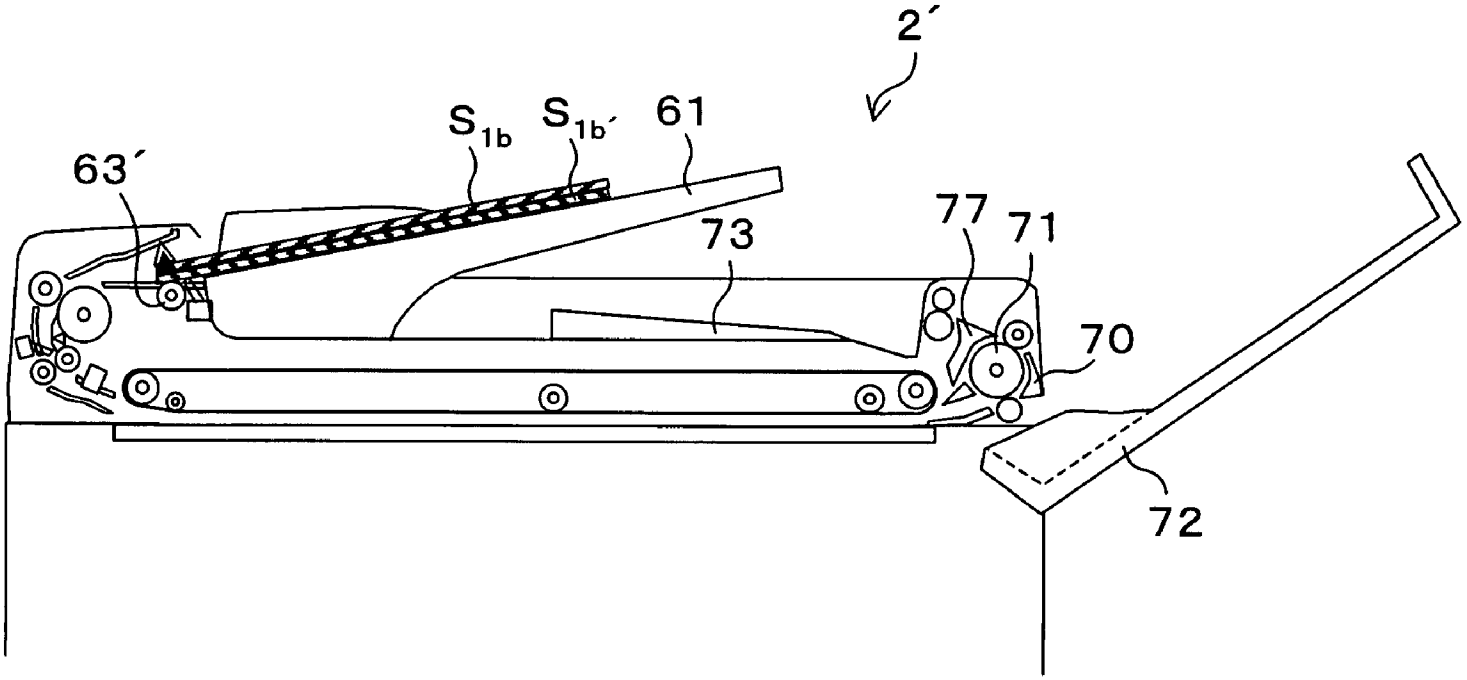
FIG. 26 is a cross-sectional view of the above another sheet transport apparatus before starting transporting the sheets in a case in accordance with the flowchart where the sheets all have the same sheet length.
Figure 27:
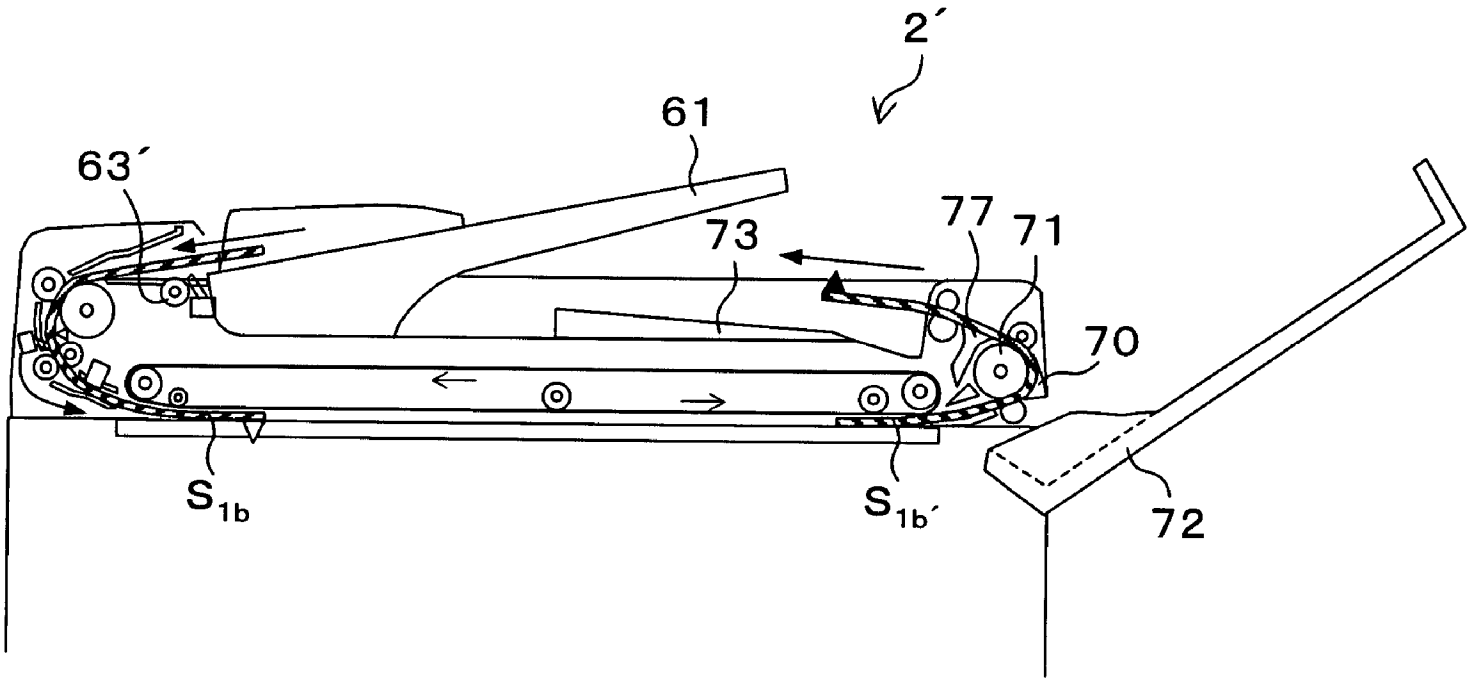
FIG. 27 is a cross-sectional view of the sheet transport apparatus during the transporting of the sheets, and shows a state after the state shown in FIG. 26.
Figure 28:
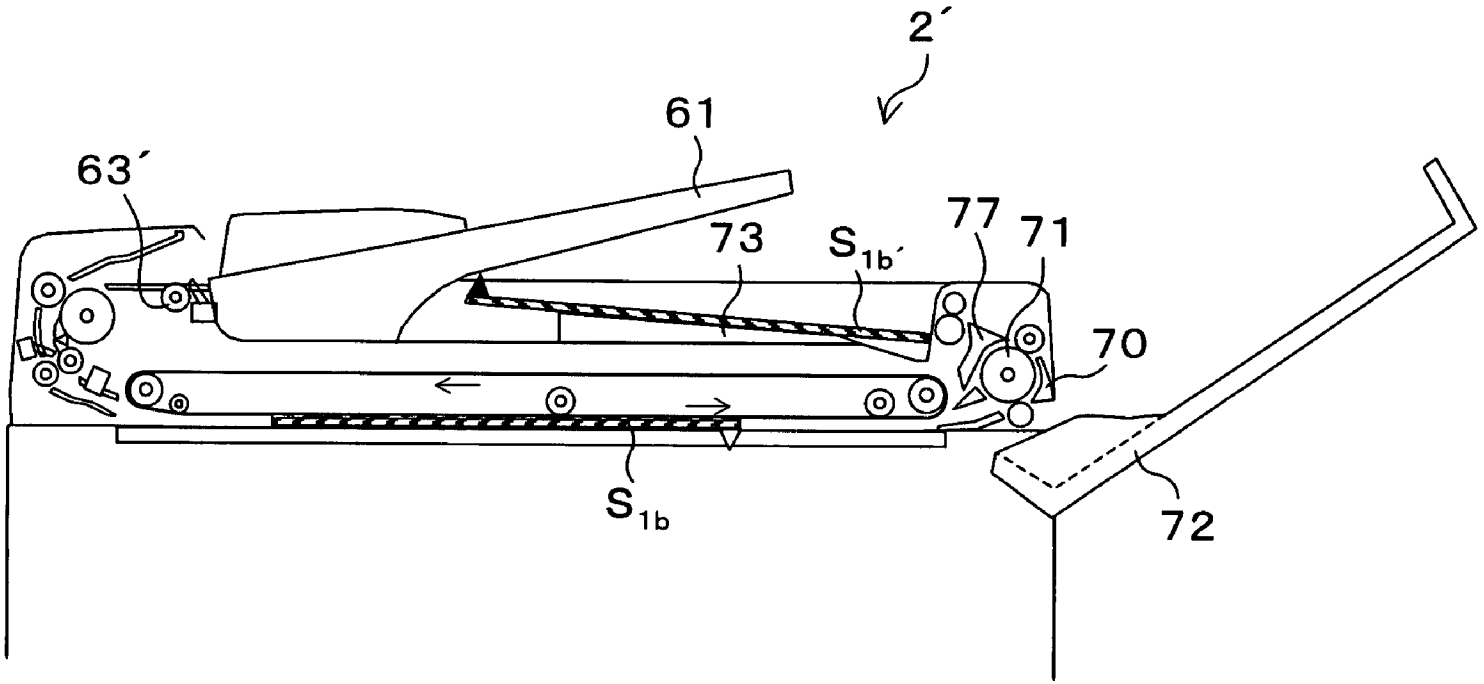
FIG. 28 is a cross-sectional view of the sheet transport apparatus during the transporting of the sheets, and shows a state after the state shown in FIG. 27.

In this case, first, the ejection switching flapper 77 is set to the fourth switching position, and the reversal switching flapper 70 is set to the second switching position (corresponding to S67 in FIG. 22), as shown in FIG. 26. Then, the sheet $S_{1b'}$ is transported to a predetermined position, and the sheet is read (corresponding to S68). Next, the sheet $S_{1b'}$ is ejected to the second eject tray 73 (corresponding to S69), as shown in FIG. 27.

After this, since the sheet $S_{1b}$ is placed on the sheet supply tray 61, the sheet $S_{1b}$ is similarly processed as the sheet $S_{1b'}$ (corresponding to Yes in S70). As a result, like the sheet $S_{1b'}$, the sheet $S_{1b}$ is ejected to the second eject tray 73. With this, the processing ends.

Figure 29:
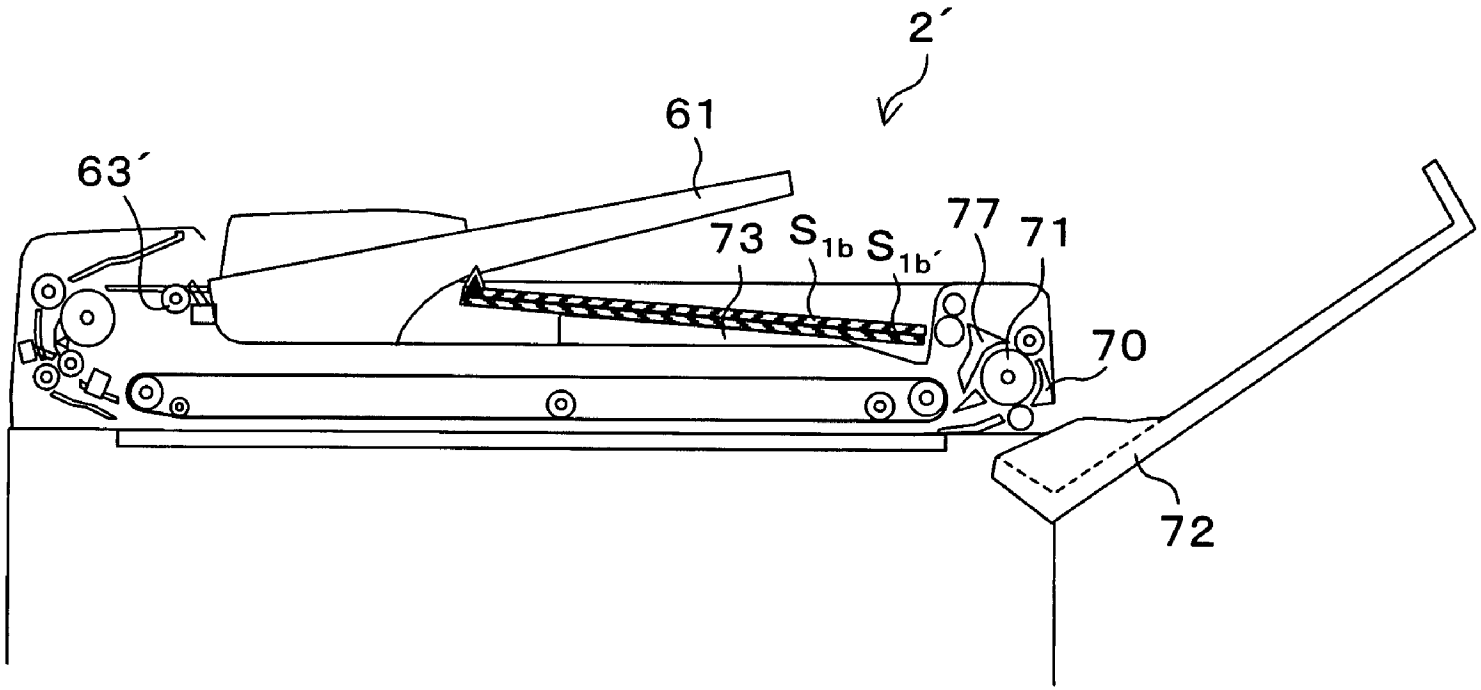
FIG. 29 is a cross-sectional view of the sheet transport apparatus when finishing transporting the sheets, and shows a state after the state shown in FIG. 28.

Also in this case, the sheet order of the sheets ($S_{1b}$ and $S_{1b'}$) when placed on the sheet supply tray 61 is retained, and the leading edges (white triangle mark and black triangle mark in the drawing) of the sheets ($S_{1b}$ and $S_{1b'}$) are aligned, as shown in FIG. 29.

Note that, in this case, the sheets ($S_{1b}$ and $S_{1b'}$) are in the face-up state on the second eject tray 73.

Incidentally, the foregoing explanation described the arrangement in which the pickup roller 63' is provided to sequentially pick up the sheets placed on the sheet supply tray 61 in order from a sheet placed on the bottom. However, the arrangement is not limited this, and may be provided with the pickup roller 63 of First Embodiment instead of the pickup roller 63'. The following will explain this case with reference to FIGS. 30 through 32. Note that, in the arrangement provided with the pickup roller 63, the sheet transport section 2' is arranged as follows. Namely, the destination to which the sheets are ejected is set to the second eject tray 73 in S62 when the mixed processing is selected, and the destination to which the sheets are ejected is set to the first eject tray 72 in S67 when the mixed processing is not selected.

Figure 30:
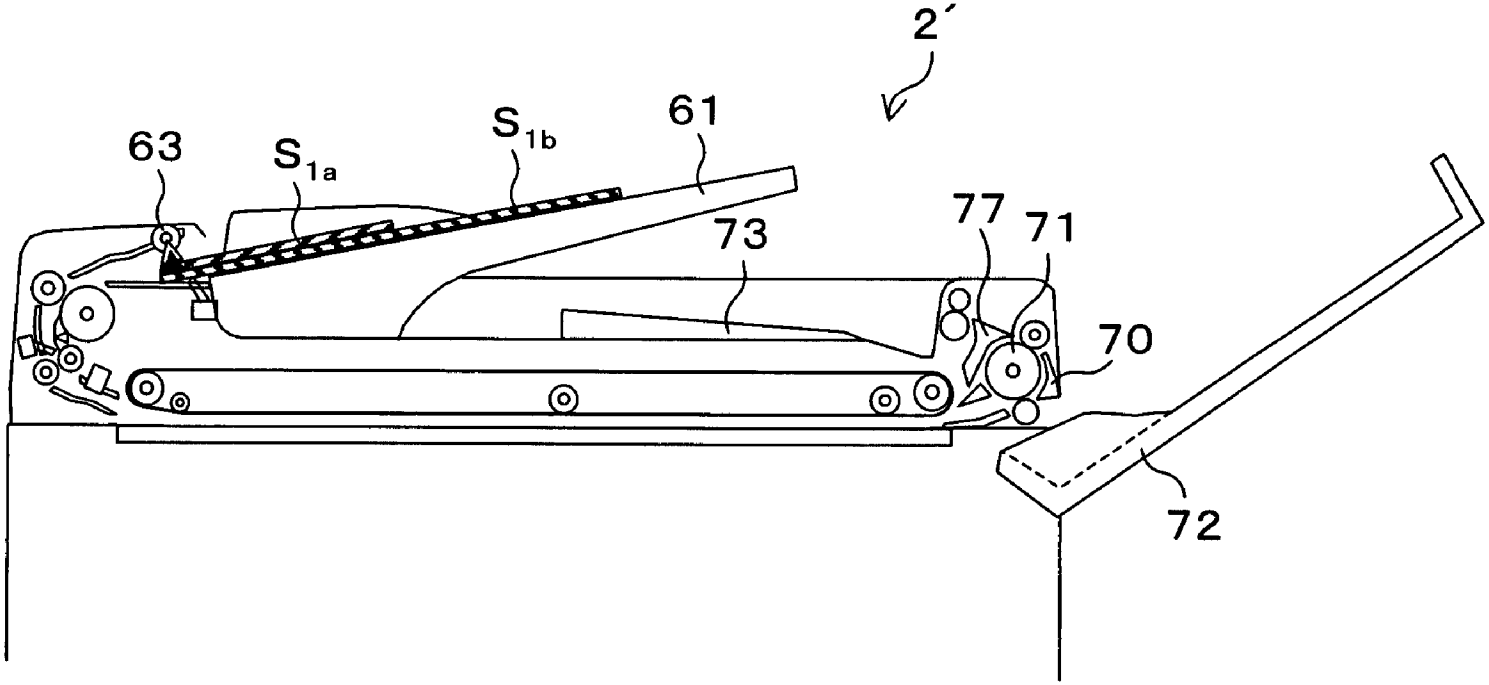
FIG. 30 is a cross-sectional view of a further sheet transport apparatus arranged to transport the sheets in order different from that of the above another sheet transport apparatus, and shows the further sheet transport apparatus before starting transporting the sheets in a case where the sheets have different sheet lengths.
Figure 31:
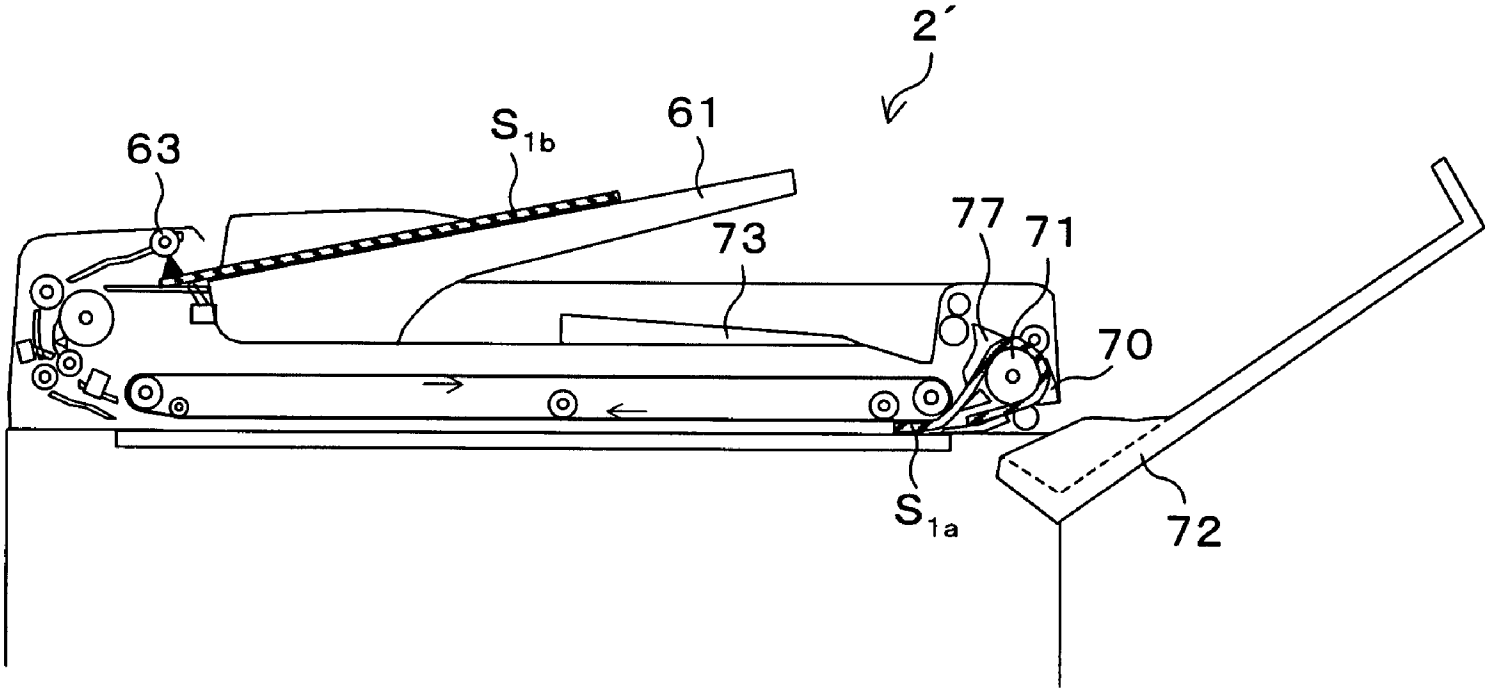
FIG. 31 is a cross-sectional view of the further sheet transport apparatus where a sheet is switched back, and shows a state after the state shown in FIG. 30.
Figure 32:
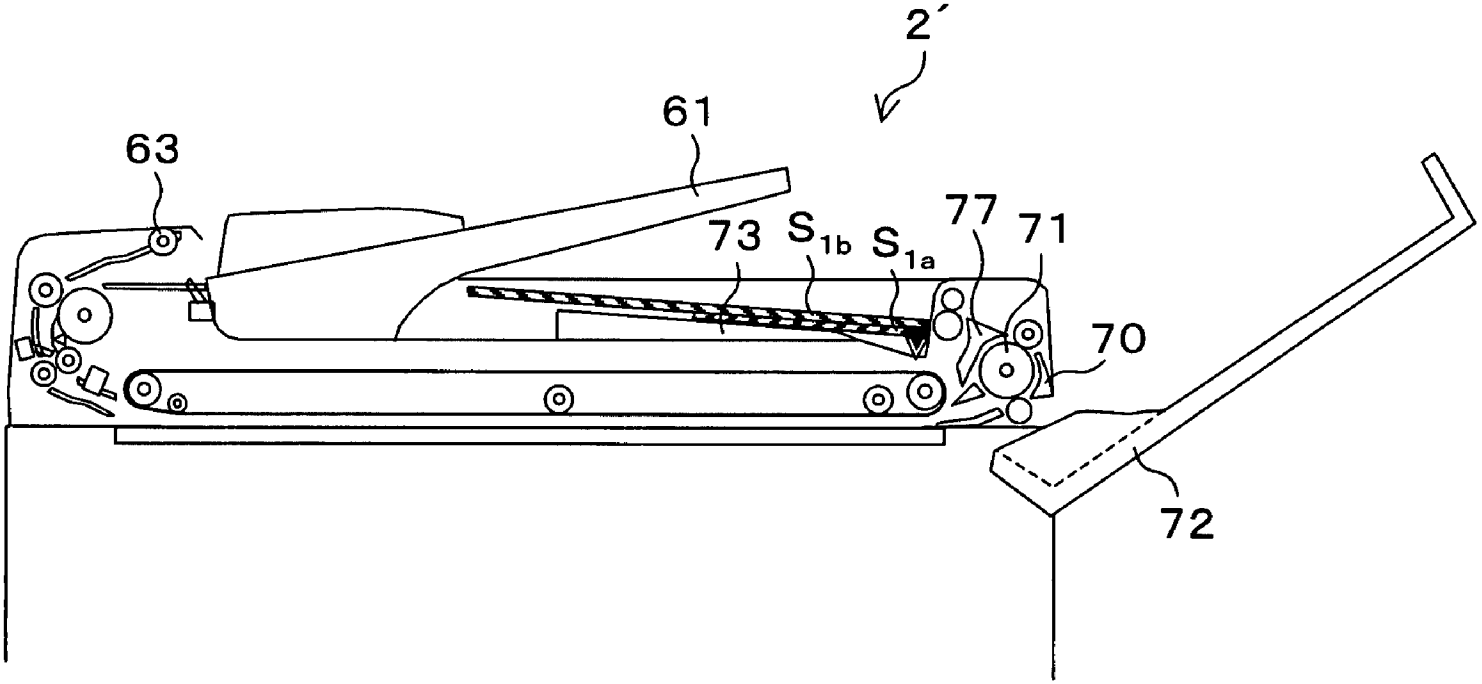
FIG. 32 is a cross-sectional view of the further sheet transport apparatus when finishing transporting the sheets, and shows a state after the state shown in FIG. 31.

As shown in FIG. 30, in the arrangement provided with the pickup roller 63, the pickup roller 63 sequentially picks up the sheets placed on the sheet supply tray 61 in order from a sheet placed on the top surface. Accordingly, in the mixed processing, after the switching back shown in FIG. 31 is performed, the reversal switching flapper 70 is kept to the second switching position and the ejection switching flapper 77 is switched to the fourth switching position. With this, the sheets ($S_{1a}$ and $S_{1b}$) are ejected to the second eject tray 73, as shown in FIG. 32.

Further, the foregoing explanation described the arrangement in which the switching back is performed once. However, it is also possible to obtain the same result by consecutively performing the switching back in an odd number (other than one) of times, for example.

Further, the foregoing explanation in Second Embodiment described the arrangement in which the control section 60 is not provided with the first reception section 81*a* and the first sheet transport suspend section 83, but the control section 60 may be provided with the first reception section 81*a* and the first sheet transport suspend section 83.

Further, if the user does not select the mixed processing and the mixed sheet size is detected, the control section 60 may perform control so as to direct the user to proceed the mixed processing as described above, after causing the sheets ejected to an eject tray to be transferred to the other eject tray.

[Third Embodiment]

Figure 33:
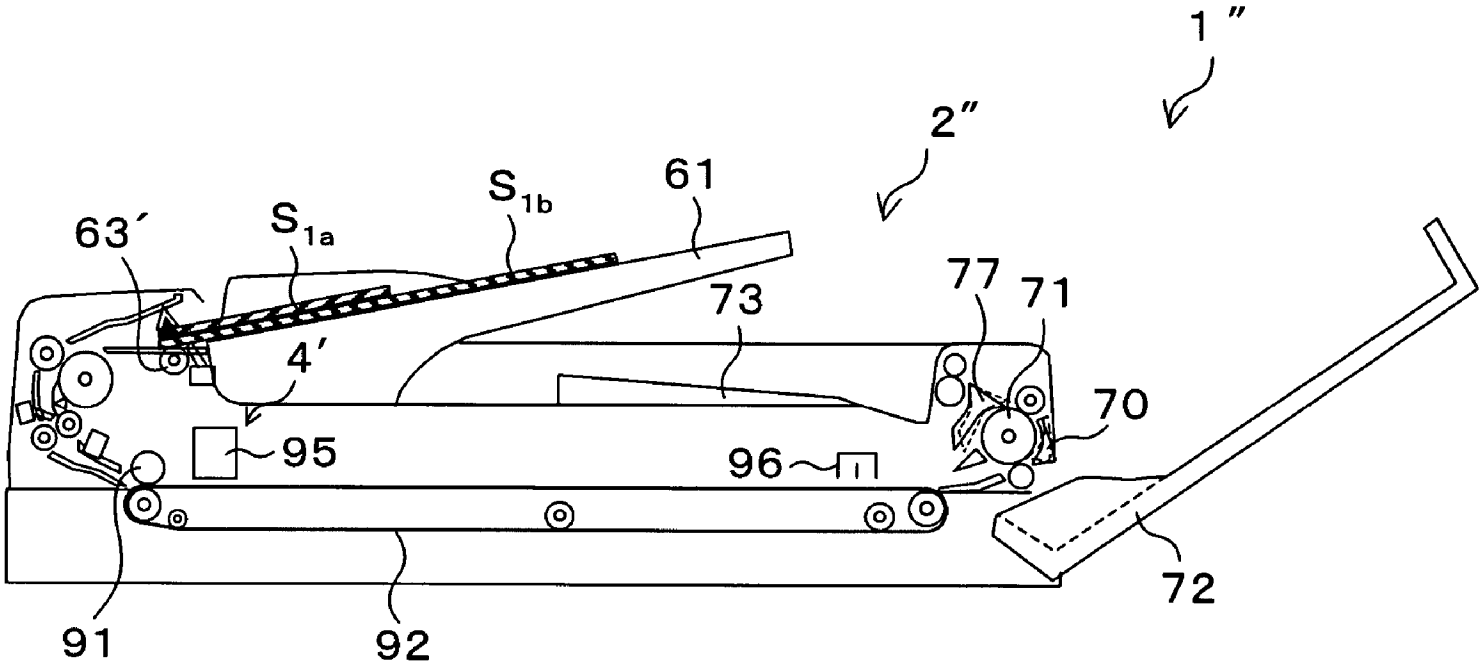
FIG. 33 is a cross-sectional view showing an embodiment of an image forming apparatus provided with yet another sheet transport apparatus in accordance with the present invention.
Figure 34:
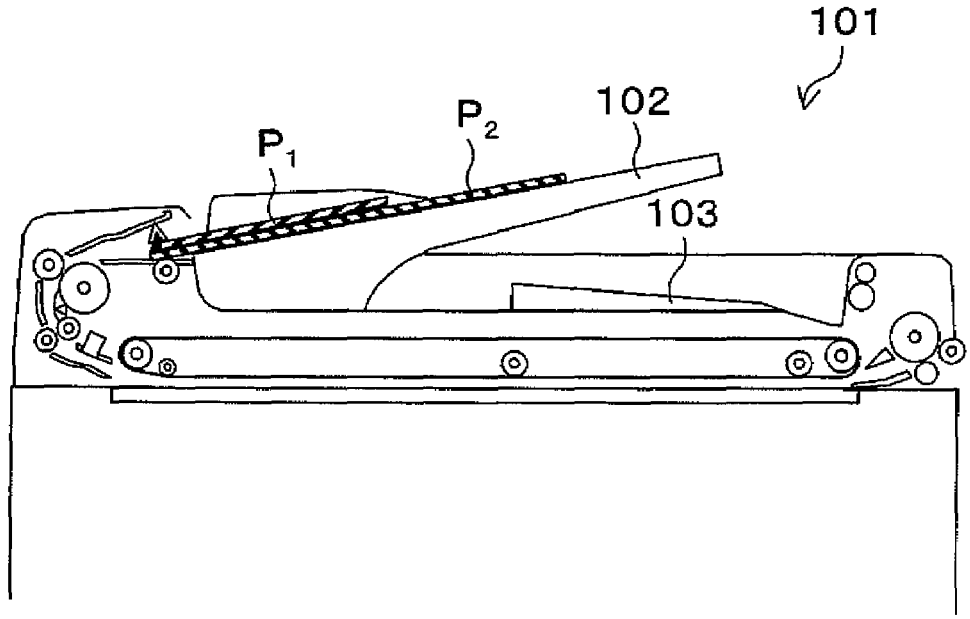
FIG. 34 is a cross-sectional view of a conventional sheet transport apparatus before starting transporting sheets in a case where the sheets have different sheet lengths.
Figure 35:
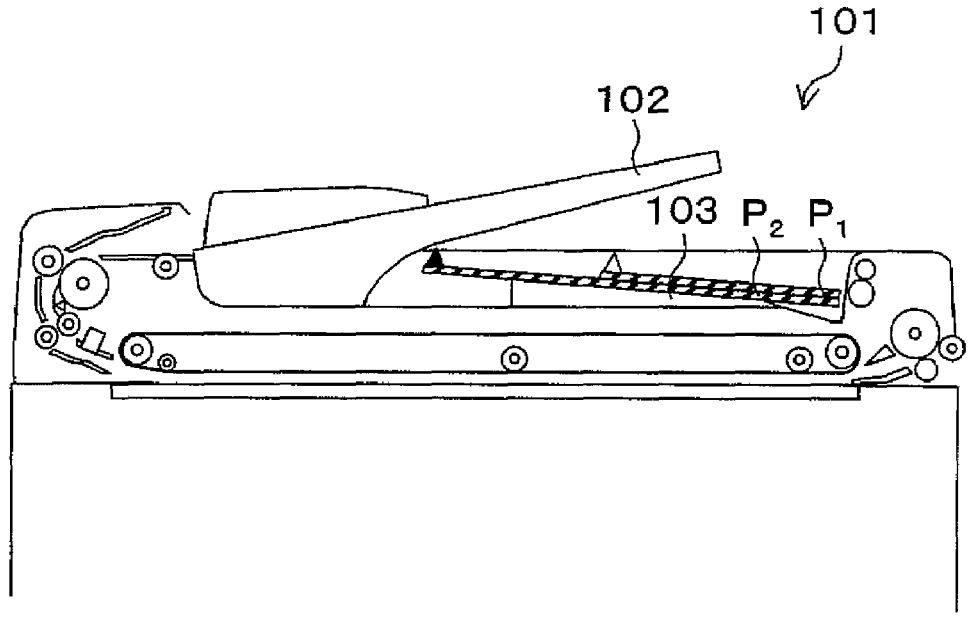
CONVENTIONAL ART FIG. 35
FIG. 35 is a cross-sectional view of the conventional sheet transport apparatus when finishing transporting the sheets, and shows a state after the state shown in FIG. 34.
Figure 36:
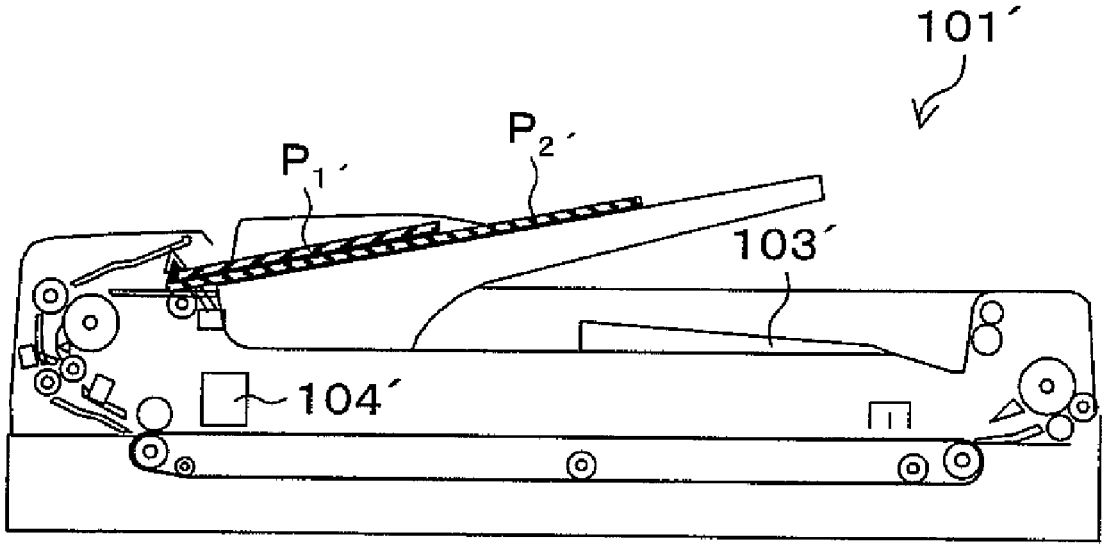
FIG. 36 is a cross-sectional view of an image forming apparatus provided with another conventional sheet transport apparatus, and shows the image forming apparatus before starting transporting sheets in a case where the sheets have different sheet lengths.
Figure 37:
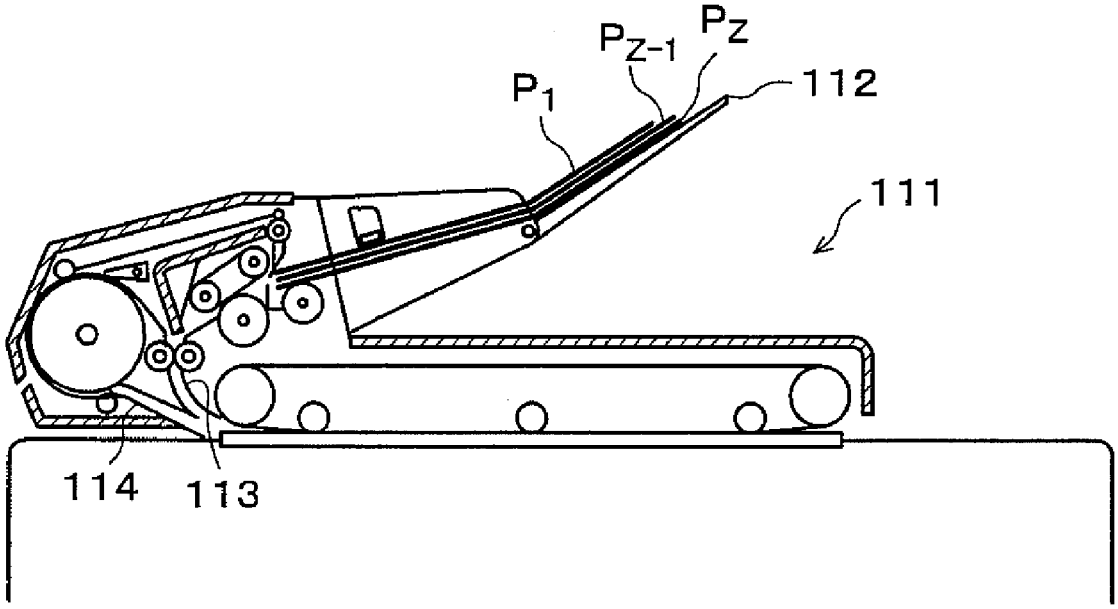
FIG. 37 is a cross-sectional view of a further conventional sheet transport apparatus.

The following will explain a further embodiment of the present invention with reference to FIG. 33.

Note that, in the following explanation, sheets having different lengths mean sheet having different lengths in a direction in which the sheets are transported. Further, in the present embodiment, recording of an image on a sheet corresponds to the predetermined processing as recited in the claims.

FIG. 33 is a cross-sectional view of an image forming apparatus (inkjet printer) 1, in accordance with the present invention. The image forming apparatus 1, is provided with a sheet transport section (sheet transport apparatus) 2", an image forming section 4', and the operation section 5 (not shown). Further, unlike the image forming apparatuses of First and Second Embodiments, the image forming apparatus 1" of the present embodiment is not arranged to form an image by reading the image that has been formed on a sheet, but arranged to record (form) an image on a recording sheet.

Note that, instead of providing the operation section 5 to the image forming apparatus 1", an apparatus such as a personal computer externally connected to the image forming apparatus 1" may perform the function of the operation section 5. Namely, the user gives an input through a keyboard with reference to a display screen of the personal computer and the like, and the input is sent to the image forming apparatus 1" via a printer driver and the like. Further, when the image forming apparatus 1" is provided with the operation section 5, the operation section 5 is arranged the same as the operation section 5 in Second Embodiment.

The sheet transport section 2" is the same as the sheet transport section 2' as explained in Second Embodiment except that an electrostatic adsorption roller 91, an electrostatic adsorption belt 92 in replacement of the transport belt 69, and the pickup roller 63 in replacement of the pickup roller 63' are provided, as shown in FIG. 33. Note that, the electrostatic adsorption belt 92 is provided below the inkjet line head 95 to be described later.

Further, the image forming section 4' is provided with the inkjet line head 95 and the charge eliminator 96. In accordance with image data received by the image forming section 4', the inkjet line head 95 discharges ink onto a sheet transported by the sheet transport section 2", so as to form an image on the sheet. Further, the charge eliminator 96 reduces the adsorbability of the sheet on which the image is formed, so as to allow the sheet to be easily separated from the electrostatic adsorption belt. Note that, the formed image dries before the sheet reaches a position at which the charge eliminator 96 is located.

A method for transporting sheets in the image forming apparatus 1, as arranged above is basically the same as the transporting method explained with reference to FIGS. 23 through 29 in Second Embodiment except that recording in ink is performed instead of the processing for reading an image. Specifically, if the control section 60 judges that the mixed processing is selected, the destination to which the sheets are ejected is set to the first eject tray 72. On the other hand, if the control section 60 judges that the mixed processing is not selected, the destination to which the sheets are ejected is set to the second eject tray 73.

Note that, the method for transporting sheets is the same as that in Second Embodiment, thus their description is omitted here.

With this, it is possible to provide an image forming apparatus capable of retaining the sheet order of the sheets ($S_{1a}$ and $S_{1b}$) when placed on the sheet supply tray 61, and aligning the leading edges of the sheets ($S_{1a}$ and $S_{1b}$).

Note that, when the mixed processing is performed in an arrangement where the pickup roller 63 is provided instead of the pickup roller 63', the image forming apparatus 1, may be arranged to eject the sheets to the second eject tray 73 through a path as shown in FIGS. 30 to 32 in Second Embodiment.

Incidentally, Embodiments 1 through 3 explained the cases where sheets having different lengths in a transporting direction (sheet lengths) are transported.

Figure 38:
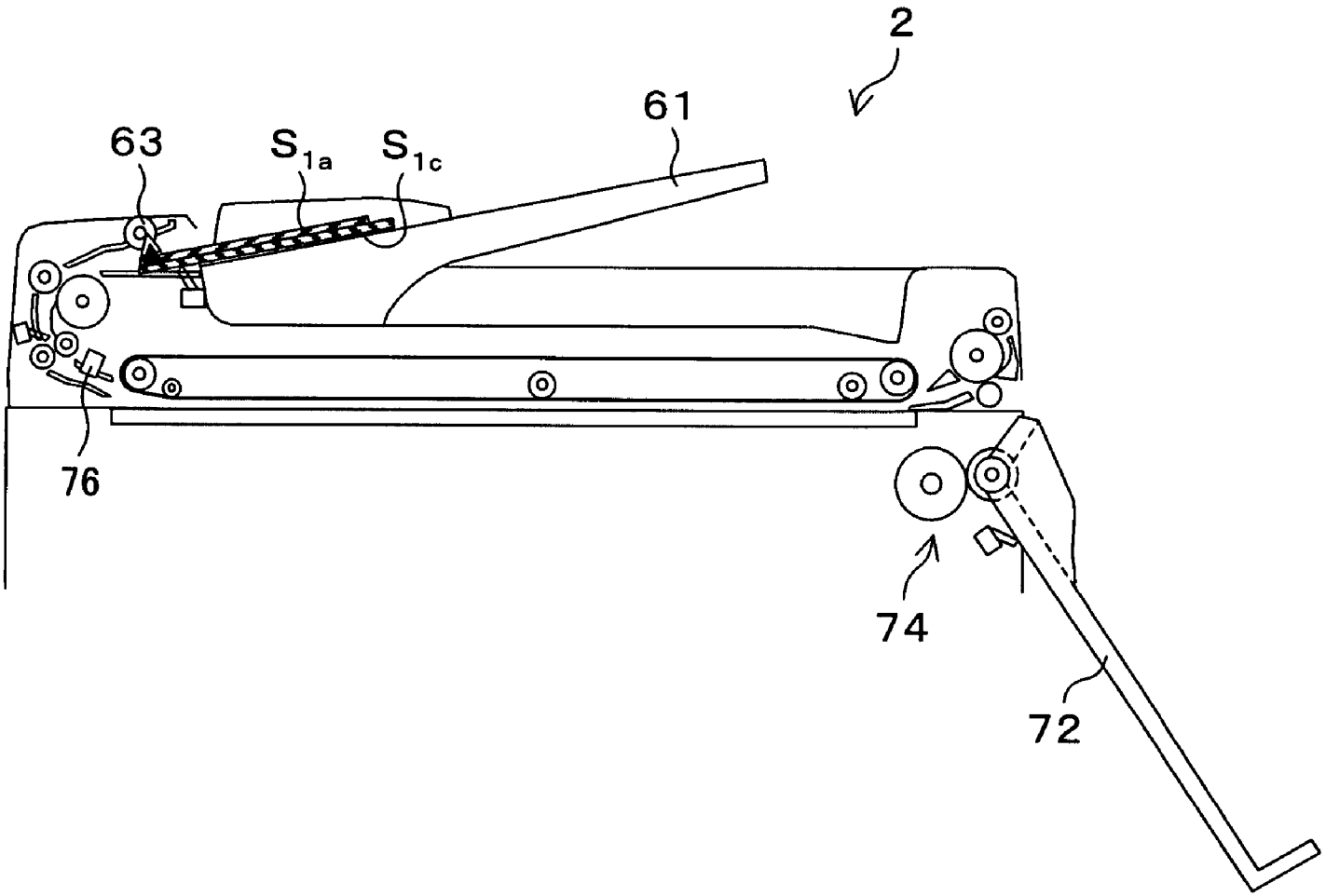
FIG. 38 is a cross-sectional view of the sheet transport apparatus shown in FIG. 1 before starting transporting sheets in a case where the sheets include an index sheet.
Figure 39:
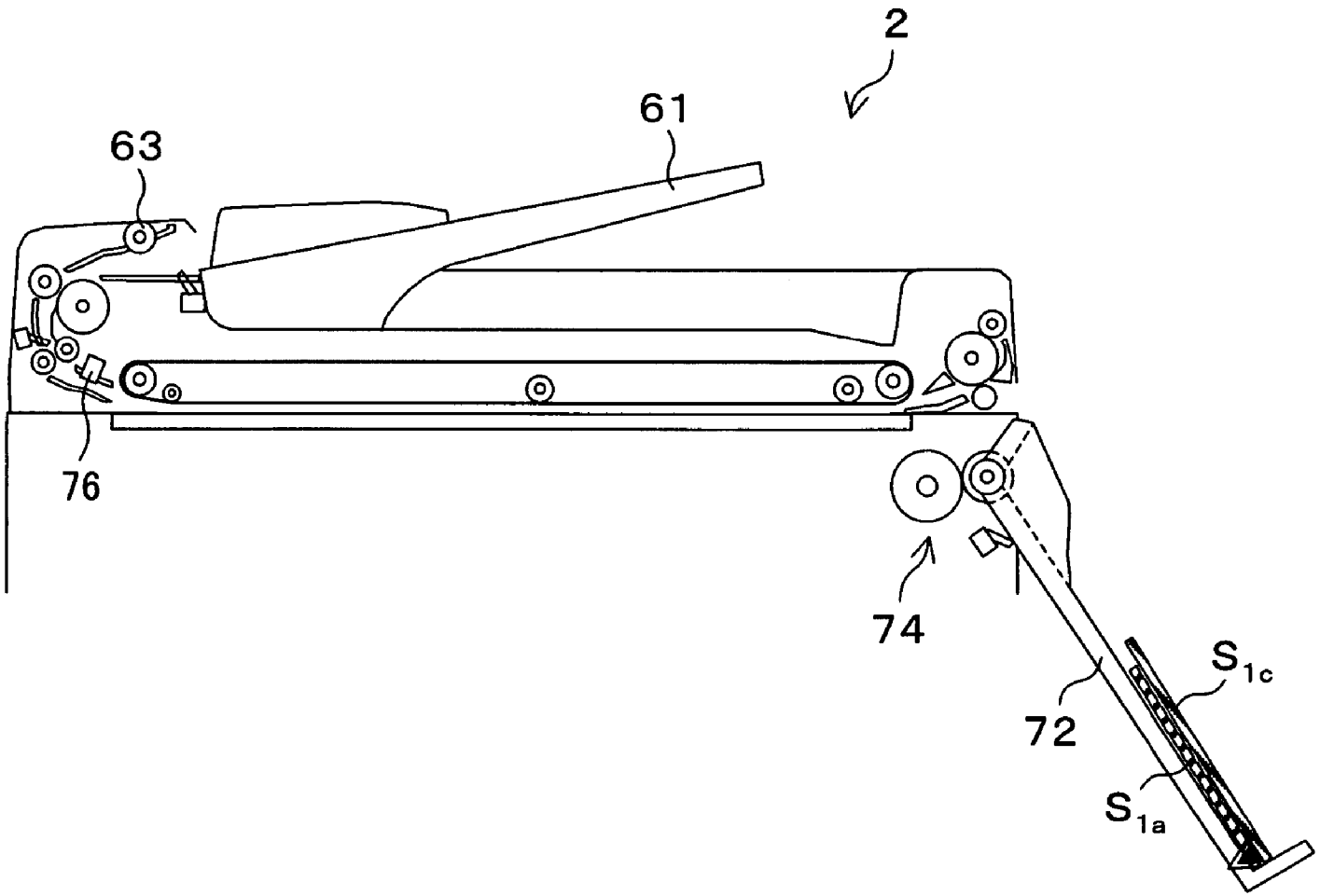
FIG. 39 is a cross-sectional view of the sheet transport apparatus when finishing transporting the sheets, and shows a state after the state shown in FIG. 38.

However, the present invention can be applied to a case where originals (sheets) including a sheet with an index are transported one sheet at a time, because a sheet with an index (tab) has a sheet length different from a sheet having a normal shape (rectangular sheet) used together with the sheet with an index. FIGS. 38 and 39 show an example of this case. Note that, hereinafter a sheet with an index will be referred to as an index sheet.

FIGS. 38 and 39 show a case where a sheet $S_{1a}$ having no protrusion (hereinafter referred to as sheet $S_{1a}$) and an index sheet $S_{1c}$ are transported (namely, where two sheets having different sheet lengths are transported). Further, FIGS. 38 and 39 show a case where the control section 60 judges that the mixed processing is selected. In this case, the first eject tray 72 is set to the second set position (downward), as shown in FIG. 38. Note that, the leading edge of the sheet $S_{1a}$ is indicated by the white triangle mark, and the leading edge of the index sheet $S_{1c}$ is indicated by the black triangle mark in FIGS. 38 and 39. Further, the sheet $S_{1a}$ is placed on the index sheet $S_{1c}$ in the sheet supply tray 61. Further, the sheet $S_{1a}$ and the index sheet $S_{1c}$ are placed on the sheet supply tray 61 in the face-up state, namely, in such a manner that the read surfaces of the sheet $S_{1a}$ and the index sheet $S_{1c}$ face upward.

First, the sheet $S_{1a}$ is transported to the predetermined position. Then, the sheet $S_{1a}$ is ejected to the first eject tray 72 which is in the second set position. Next, the index sheet $S_{1c}$ is transported to the predetermined position. After this, like the sheet $S_{1a}$, the index sheet $S_{1c}$ is ejected to the first eject tray 72, as shown in FIG. 39. With this, the processing ends.

Figure 40:
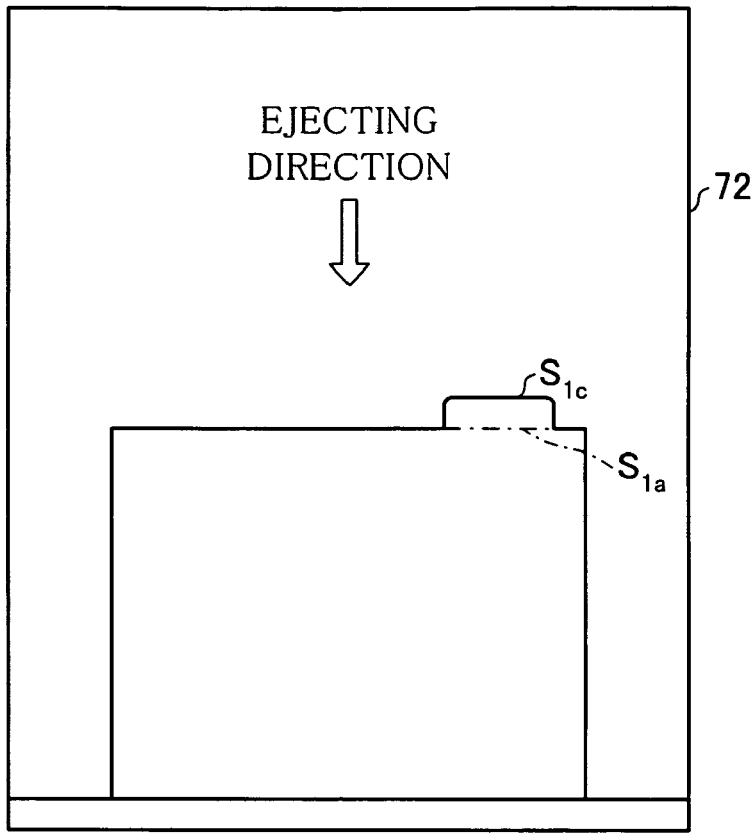
FIG. 40 is a diagram showing a state of the sheets ejected to an eject tray in the state shown in FIG. 39.

Here, notably, the sheet order of the sheet $S_{1a}$ and the index sheet $S_{1c}$ when placed on the sheet supply tray 61 is retained, and the leading edges (white triangle mark and black triangle mark in the drawings) of the sheet $S_{1a}$ and the index sheet $S_{1c}$ are aligned, as shown in FIGS. 39 and 40.

With this, the user can obtain from the first eject tray 72, the sheets in the same state as the sheets when placed on the sheet supply tray 61. Note that, in this case, the sheet $S_{1a}$ and the index sheet $S_{1c}$ are in the face-down state on the first eject tray 72.

Note that, the foregoing explanation described an example of processing in a case where an index sheet is mixed in the sheets (example corresponding to FIGS. 6 through 10 in First Embodiment). However, the processing is not limited to this, and various processing methods as shown in Embodiments 1 through 3 may be employed.

Next, a method for detecting an index sheet will be explained.

In the image forming apparatus 1 and the like, the sheet length detector 76 is used to detect the sheet length. Here, the image reading section 3 is provided with a plurality of sheet length detectors 76 located in a linear manner (line manner) in a direction perpendicular to the paper of FIG. 38, for example. With this, the image reading section 3 detects sheet lengths of a sheet with respect to a plurality of places on the sheet. With this arrangement, when the detected sheet lengths have a plurality of values with respect to a sheet, the control section can judge that the sheet is an index sheet. Further, the control section can judge that the sheet is not an index sheet if the detected lengths have only one value. Note that, the plurality of sheet length detectors may be arranged as a unit. Further, the plurality of sheet length detectors correspond to measurement means as recited in the claims.

Figure 41:
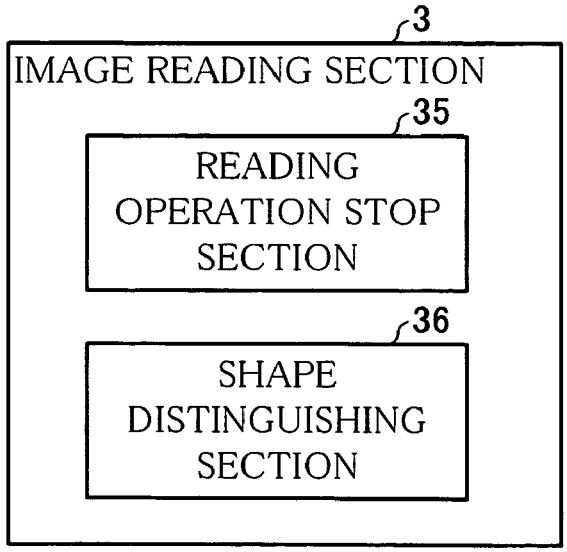
FIG. 41 is another functional block diagram of an image reading section of an image forming apparatus.
Figure 42:
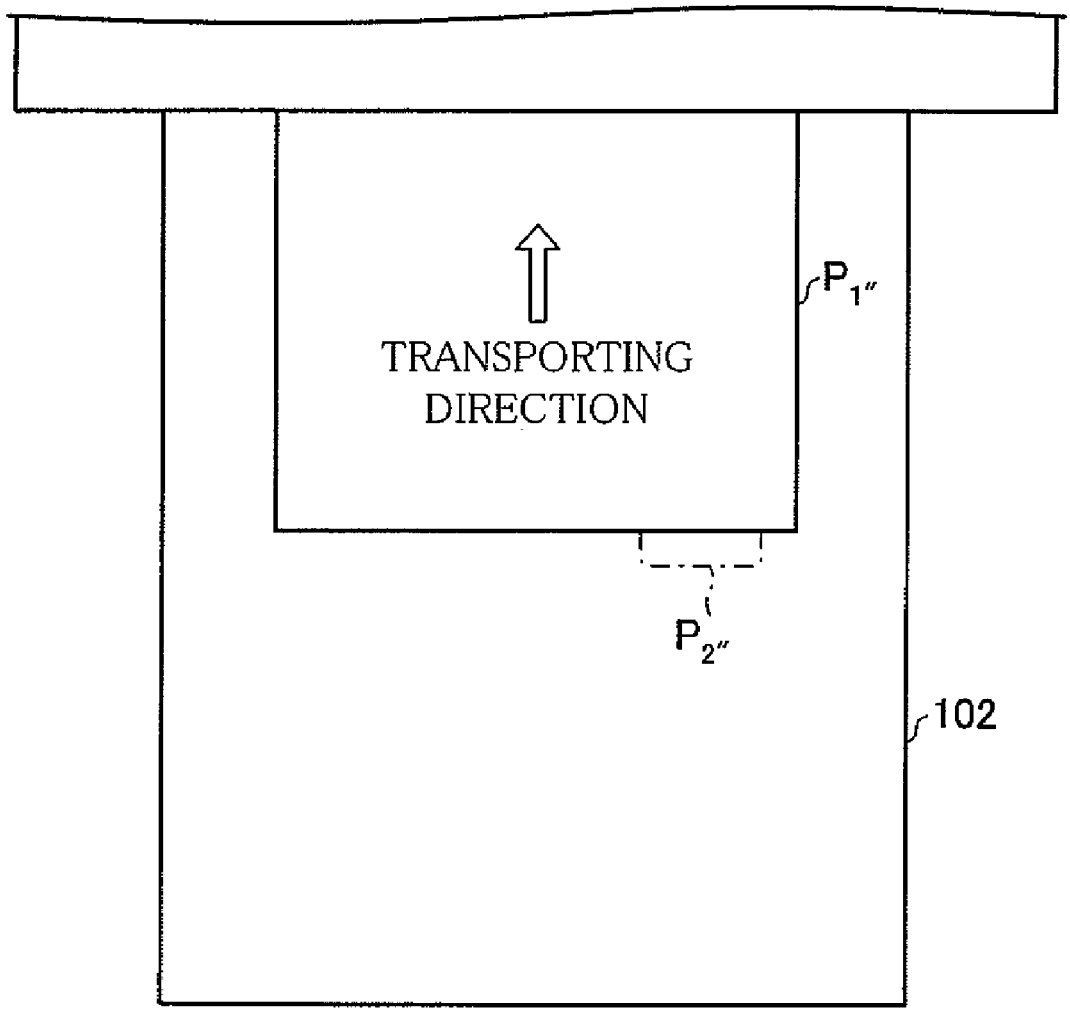
FIG. 42 is a diagram showing a state where sheets including an index sheet are placed on a sheet supply tray of the conventional sheet transport apparatus shown in FIG. 34.
Figure 43:
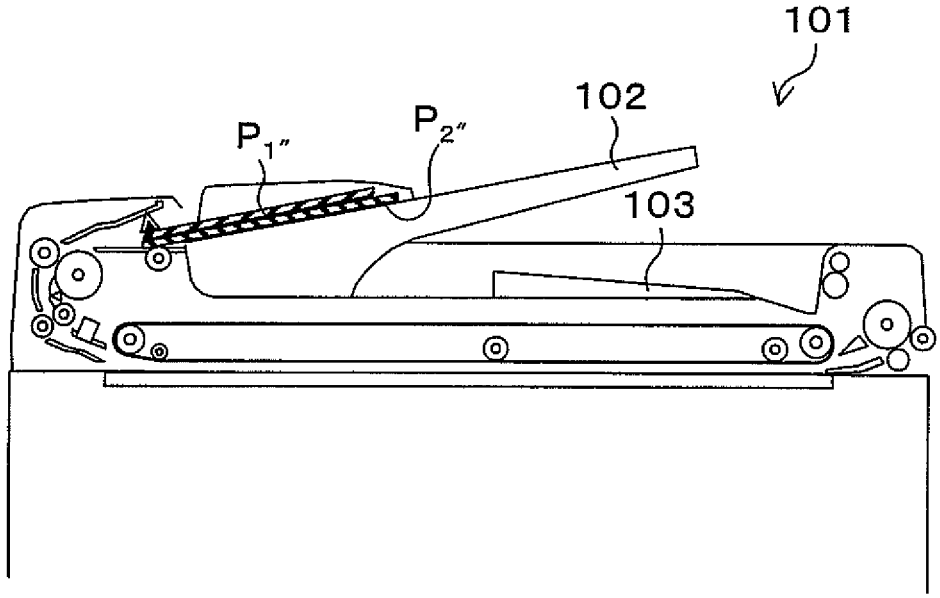
FIG. 43 is a cross-sectional view of the conventional sheet transport apparatus shown in FIG. 34 before starting transporting the sheets in a case where the sheets include an index sheet.
Figure 44:
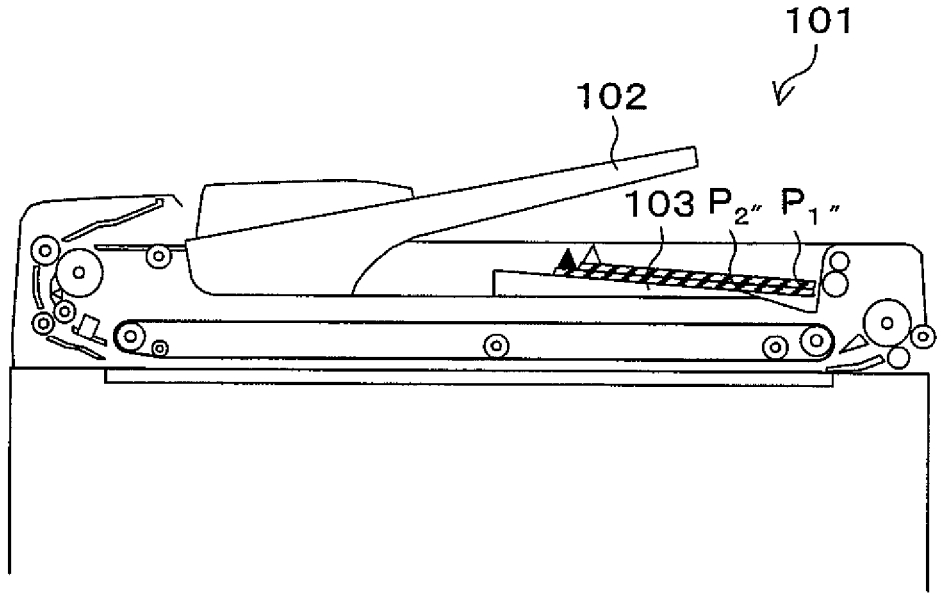
CONVENTIONAL ART FIG. 44
FIG. 44 is a cross-sectional view of the conventional sheet transport apparatus when finishing transporting the sheets, and shows a state after the state shown in FIG. 43.
Figure 45:
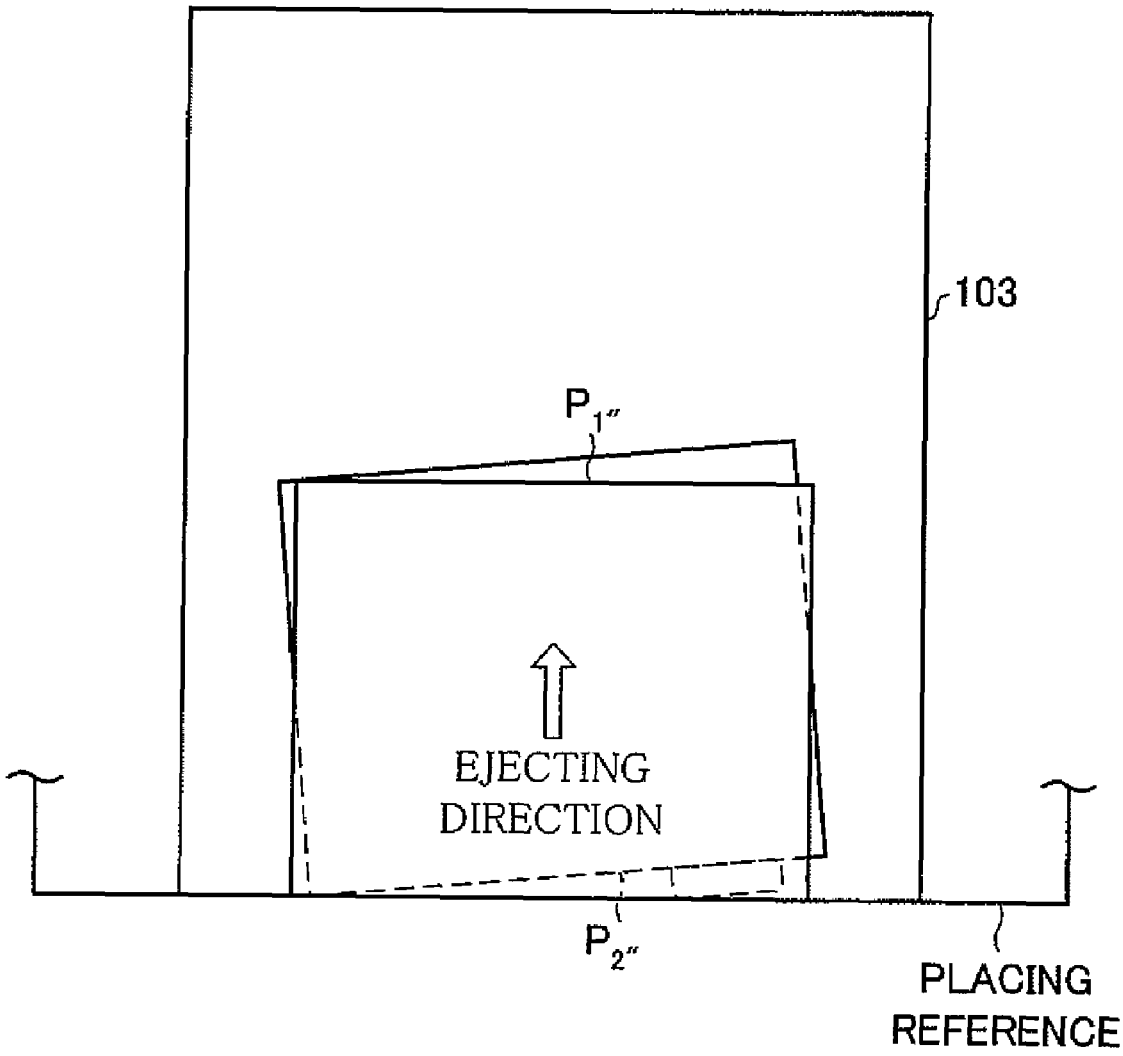
FIG. 45 is a diagram showing a state of the sheets ejected to an eject tray in the state shown in FIG. 44.
Figure 46:
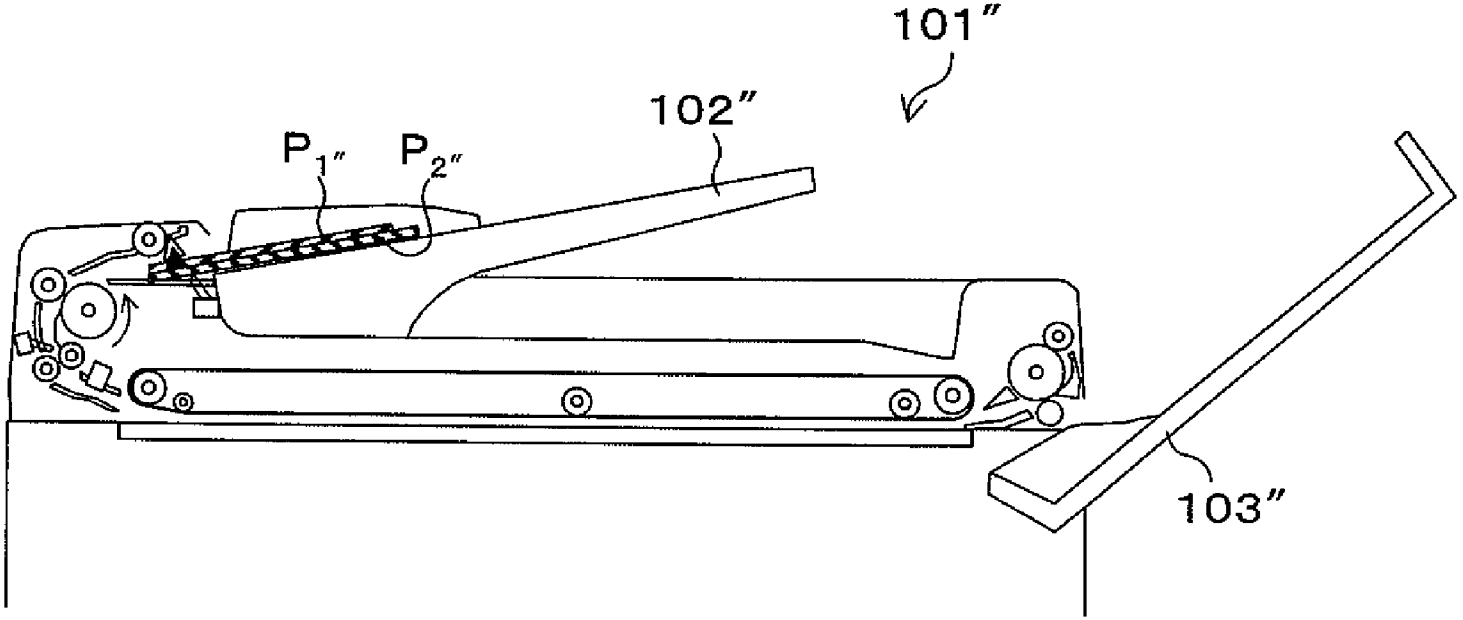
CONVENTIONAL ART FIG. 46
FIG. 46 is a cross-sectional view of yet another conventional sheet transport apparatus before starting transporting the sheets in a case where the sheets include an index sheet.
Figure 47:
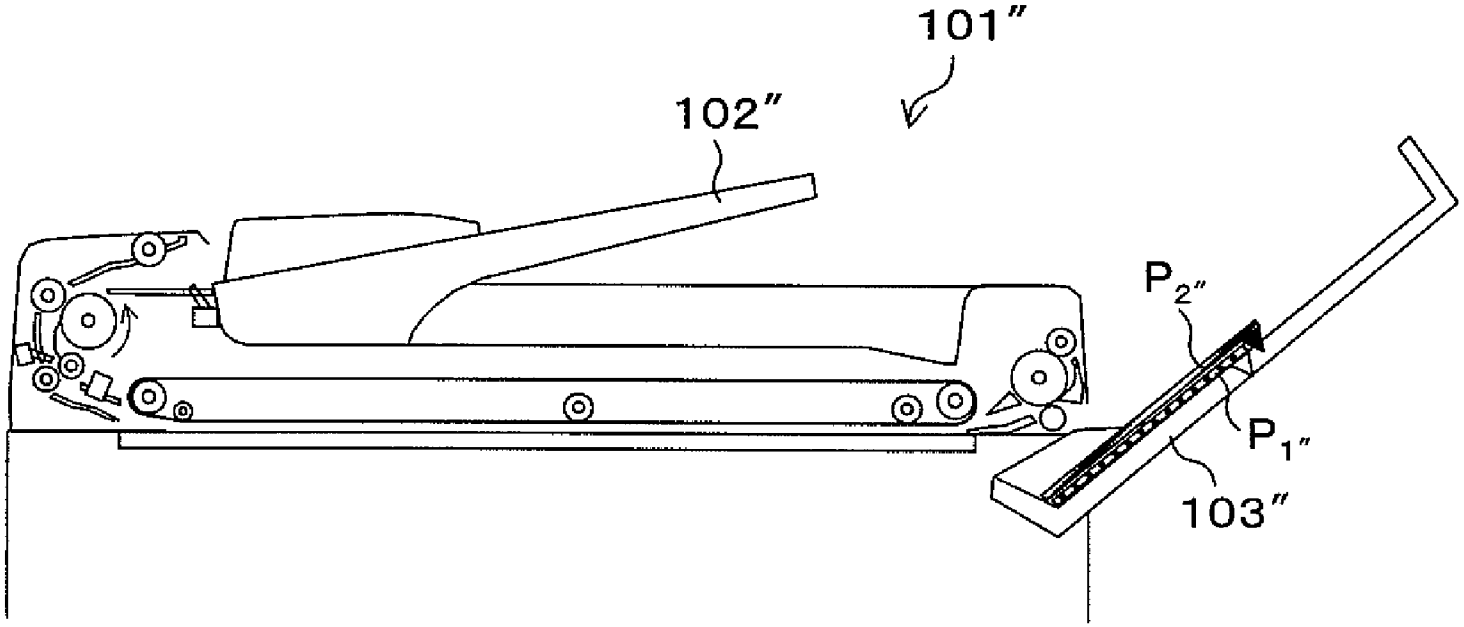
CONVENTIONAL ART FIG. 47
FIG. 47 is a cross-sectional view of the sheet transport apparatus when finishing transporting the sheets, and shows a state after the state shown in FIG. 46.

Further, instead of the plurality of sheet length detectors 76 as described above, the image reading section 3 may be provided with a shape distinguishing section (shape distinguishing means) 36 for distinguishing a shape of the edge of a sheet in a direction perpendicular to the transporting direction, as shown in FIG. 41. In this case, the control section may judge in accordance with a distinction result of the shape distinguishing section 36 whether or not the sheet is an index sheet.

Specifically, the image reading section 3 is arranged so that the CCD unit 34 reads the shape of the edge of the sheet, and the shape distinguishing section 36 distinguishes the shape of the edge of the sheet in accordance with the read result. For example, the transport belt 69 may be arranged to have a color different from the color of the sheet, such as black. With this, the shape distinguishing section 36 judges in accordance with the read result obtained by the CCD unit 34, the shape of the edge of the sheet. Further, the density of the transport belt 69 may be set differently from the density of the sheet. According to the circumstances, a unit for color images may be used as the CCD unit 34.

Further, instead of distinguishing the shape of the edge of the sheet in a direction perpendicular to the sheet transporting direction, the shape distinguishing section 36 may distinguish a shape of the sheet. The shape distinguishing section 36 may be at least arranged to distinguish the shape of the edge of the sheet in the direction perpendicular to the transporting direction.

Further, the user can give through the operation input section 52, an input as to whether or not to perform the mixed processing. In the case where an index sheet is included in the sheets, the user may also input through the operation section 52, an instruction to perform the mixed processing. Further, an index sheet processing mode may be independently provided as a processing mode in the mixed processing, and may be selected by the user. With this, it is possible to enhance the convenience.

As described above, a sheet transport apparatus of the present invention which includes (a) sheet supply means capable of supplying a plurality of sheets whose leading edges are aligned, one sheet at a time from a leading edge; (b) sheet transport means for transporting the sheets supplied from the sheet supply means; and (c) first sheet eject means to which the sheets are ejected by the sheet transport means after the sheets transported by the sheet transport means are subjected to predetermined processing, the sheets being ejected to the first sheet eject means in such a manner that an order of the sheets when placed on the sheet supply means is retained, is arranged so as to include alignment means for aligning the leading edges of the sheets ejected to the first sheet eject means by changing a positional relation in a vertical direction between an upstream side and a downstream side of the first sheet eject means in a sheet transporting direction, the first sheet eject means being located at a position to which the sheets are ejectable in such a manner that front and back surfaces of the sheets are not reversed after the sheets are subjected to the predetermined processing.

Further, the sheet transport apparatus of the present invention is arranged so that the positional relation in the vertical direction is changed by rotating the first sheet eject means.

With this arrangement, it is possible to change the positional relation in the vertical direction between the upstream side and the downstream side of the first sheet eject means in the sheet transporting direction by rotating the first sheet eject means.

Therefore it is possible to set the position of the first eject means so that the downstream side of the first sheet eject means is lower than the upstream side of the first sheet eject means in the sheet transporting direction.

Further, the sheet transport apparatus of the present invention is arranged so that the alignment means moves the first sheet eject means either to (i) a first set position where the downstream side of the first sheet eject means in the sheet transporting direction is higher than the upstream side of the first sheet eject means in the sheet transporting direction or (ii) a second set position where the downstream side of the first sheet eject means in the sheet transporting direction is lower than the upstream side of the first sheet eject means in the sheet transporting direction.

With this arrangement, the alignment means can set the first sheet eject means to (i) the first set position where the downstream side of the first sheet eject means in the sheet transporting direction is higher than the upstream side of the first sheet eject means in the sheet transporting direction and (ii) the second set position where the downstream side of the first sheet eject means in the sheet transporting direction is lower than the upstream side of the first sheet eject means in the sheet transporting direction.

Here, if the sheets have different sheet lengths in the sheet transporting direction, it is possible to align the leading edges of the sheets even after ejected to the first sheet eject means, by changing the set position of the first sheet eject means from the first set position to the second set position.

Further, the sheet transport apparatus of the present invention is arranged so as to include detecting means for detecting on an occasion of the transporting of the sheets, whether or not the sheets have different sheet lengths in the sheet transporting direction, the alignment means setting the first sheet eject means to the second set position when the detecting means detects that the sheets have different sheet lengths.

With this arrangement, the alignment means sets the first sheet eject means to the second set position when the detecting means detects on an occasion of the transporting of the sheets that the sheets have different sheet lengths in the transporting direction.

Therefore even if the sheets have different lengths in the transporting direction, the user does not need to set the position of the first sheet eject means so as to align the leading edges of the sheets.

Further, the sheet transport apparatus of the present invention is arranged so as to include first reception means for receiving a signal that designates either the first set position or the second set position as a position of the first sheet eject means, the alignment means setting the first sheet eject means to the second set position when the first reception means receives a signal that designates the second set position as the position of the first sheet eject means.

With this arrangement, the alignment means sets the first sheet eject means to the second set position when the first reception means receives a signal that designates the second set position as the position of the first sheet eject means.

Therefore, in a case where the user already knows that the sheets have different sheet lengths, and the user sends to the first reception means an instruction to set the position of the first sheet eject means to the second set position, for example, the alignment means can set the first sheet eject means to the second set position.

Namely, it is possible to set the position of the first sheet eject means to the second set position in accordance with the user's judgment, thereby aligning the leading edges of the sheets.

The sheet transport apparatus of the present invention is arranged so as to include detecting means for detecting on an occasion of the transporting of the sheets, whether or not the sheets have different sheet lengths in the sheet transporting direction; and first suspend means for temporarily suspending the ejecting of the sheets when the detecting means detects that the sheets have different sheet lengths and when the first sheet eject means is in the first set position.

With this arrangement, the first suspend means temporarily suspends the ejecting of the sheets when the detecting means detects that the sheets have different sheet lengths and when the first sheet eject means is in the first set position.

Therefore it is possible to prevent the sheets from being ejected to the first sheet eject means in such a manner that the leading edges of the sheets are not aligned.

Further, the sheet transport apparatus of the present invention is arranged so as to include second sheet eject means to which the sheets are ejected by the sheet transport means after the sheets transported by the sheet transport means are subjected to the predetermined processing; and second reception means for receiving a signal that designates either the first sheet eject means or the second sheet eject means as a destination to which the sheets are ejected, the destination to which the sheets are ejected being selected in accordance with a content of the signal received by the second reception means.

With this arrangement, the destination to which the sheets are ejected is selected in accordance with the content of the signal received by the second reception means.

Therefore, in a case where the sheets have different sheet lengths and the user sends to the second reception means an instruction to set the destination of the sheets to the first sheet eject means, the sheets can be ejected to the first sheet eject means which is in the second set position. As a result, it is possible to align the leading edges of the sheets.

Further, the sheet transport apparatus of the present invention is arranged so as to further include detecting means for detecting on an occasion of the transporting of the sheets, whether or not the sheets have different sheet lengths in the sheet transporting direction; and second suspend means for temporarily suspending the ejecting of the sheets when the detecting means detects that the sheets have different sheet lengths and when the destination to which the sheets are ejected is the second sheet eject means.

With this arrangement, the second suspend means temporarily suspends the ejecting of the sheets when the detecting means detects that the sheets have different sheet lengths and when the destination to which the sheets are ejected is the second sheet eject means.

Therefore, it is possible to prevent the sheets from being ejected to the second sheet eject means in such a manner that the leading edges of the sheets are not aligned in some cases depending on the arrangement and location of the second sheet eject means.

As described above, a sheet transport apparatus of the present invention which includes sheet supply means capable of supplying a plurality of sheets whose leading edges are aligned, one sheet at a time from a leading edge; sheet transport means for transporting the sheets supplied from the sheet supply means; and first sheet eject means to which the sheets are ejected by the sheet transport means after the sheets transported by the sheet transport means are subjected to predetermined processing, the sheets being ejected to the first sheet eject means in such a manner that an order of the sheets when placed on the sheet supply means is retained, is arranged so as to include alignment means for aligning the leading edges of the sheets ejected to the first sheet eject means by reversing a positional relation between the leading edges and trailing edges of the sheets after the sheets are subjected to the predetermined processing and before the sheets are ejected to the first sheet eject means, the first sheet eject means being located at a position to which the sheets are ejectable in such a manner that front and back surfaces of the sheets are not reversed after the sheets are subjected to the predetermined processing, a downstream side of the first sheet eject means in a sheet transporting direction being set higher than an upstream side of the first sheet eject means in the sheet transporting direction.

The sheet transport apparatus of the present invention is arranged so as to include second sheet eject means to which the sheets are ejected by the sheet transport means after the sheets transported by the sheet transport means are subjected to the predetermined processing; and second reception means for receiving a signal that designates either the first sheet eject means or the second sheet eject means as a destination to which the sheets are ejected, the destination to which the sheets are ejected being selected in accordance with a content of the signal received by the second reception means.

With this arrangement, in accordance with a content of the signal received by the second reception means, either the first sheet eject means or the second sheet eject means is selected as the destination to which the sheets are ejected.

Therefore, in a case where the sheets have different sheet lengths and the user sends to the second reception means an instruction to set the destination of the sheets to the first sheet eject means, it is possible to eject the sheets to the first sheet eject means in such a manner that the leading edges of the sheets are aligned by using the alignment means.

The sheet transport apparatus of the present invention is arranged so that the sheets are ejected to the second sheet eject means in such a manner that the front and back surfaces of the sheets are reversed after the sheets are subjected to the predetermined processing; and a downstream side of the second sheet eject means in the sheet transporting direction is set higher than an upstream side of the second sheet eject means in the sheet transporting direction.

There is a case where, because the order of the sheets when placed on the sheet supply means is not retained if the sheets are ejected to the first sheet eject means, an instruction to set the destination of the sheets to the second sheet eject means is sent to the second reception means so that the destination of the sheets is set to the second sheet eject means. With the foregoing arrangement, it is also possible to align the leading edges of the sheets on the upstream side of the second sheet eject means in the sheet transporting direction in such a case.

Further, the sheet transport apparatus of the present invention is arranged so that the plurality of sheets include a sheet that has a protrusion on an edge perpendicular to the sheet transporting direction.

A sheet that has a protrusion on an edge perpendicular to the transporting direction (sheet with an index (tab), for example) has a longer sheet length by the length of the protrusion than a sheet that is recognized by the user as a sheet of the same shape (same size) that does not have such an edge (hereinafter referred to as normal sheet). Namely, the sheet with a protrusion and the normal sheet respectively have different sheet lengths in the transporting direction.

Therefore even if the sheets include a sheet with a protrusion, it is possible to align the leading edges of the sheets.

Further, the sheet transport apparatus of the present invention is arranged so as to further include measurement means for measuring sheet lengths of each of the sheets in the sheet transporting direction with respect to a plurality of places on the each of the sheets.

With this arrangement, the measured sheet can be judged as a sheet with a protrusion if measurement results of the measurement means with respect to the measured places are different from one another.

Therefore it is possible to judge whether or not a sheet with a protrusion is mixed in the sheets.

Further, the sheet transport apparatus of the present invention is arranged so that the predetermined processing is processing for reading an image formed on the sheets.

With this arrangement, it is possible to use the sheet transport apparatus as a part of an image reading apparatus.

As described above, an image reading apparatus of the present invention is arranged so as to include the foregoing sheet transport apparatus.

As described above, an image reading apparatus of the present invention is arranged so as to include the sheet transport apparatus which includes the detecting means and the first suspend means; and first transmission means for sending to the first reception means, the signal that designates either the first set position or the second set position.

With this arrangement, the image reading apparatus is provided with the sheet transport means which includes the first reception means and the first suspend means.

Further, the first transmission means can send to the first reception means, the signal that designates either the first set position or the second set position.

Accordingly, if the first suspend means suspends the ejecting of the sheets and then the user sends to the first reception means an instruction to set the position of the first eject means to the second set position, the alignment section can set the first eject means to the second set position.

Therefore, by resuming the transporting of the sheets subsequently, it is possible to align the leading edges of the sheets.

Further, the image reading apparatus of the present invention is arranged so as to further include display means for at least displaying information as to alignment and misalignment of the sheets, the display means displaying that the leading edges of the sheets are not going to be aligned when the first suspend means temporarily suspends the ejecting of the sheets.

With this arrangement, the display means displays that the leading edges of the sheets are not going to be aligned when the first suspend means temporarily suspends the ejecting of the sheets.

Therefore, by means of the display means, the user can know in advance that the leading edges of the sheets will not be aligned if the sheets are kept ejected.

As described above, an image reading apparatus of the present invention is arranged so as to include the sheet transport apparatus which includes the detecting means and the second suspend means; and second transmission means for sending to the second reception means, a signal that designates either the first sheet eject means or the second sheet eject means.

With this arrangement, the image reading apparatus is provided with the sheet transport apparatus which includes the second reception means and the second suspend means.

Further, the second transmission means can send to the second reception means, a signal that designates either the first eject means or the second sheet eject means.

Accordingly, if the user sends to the second reception means an instruction to set the destination of the sheets to the first eject means when the second suspend means suspends the ejecting of the sheets, the destination of the sheets can be set to the first eject means.

Therefore, by resuming the transporting of the sheets subsequently, it is possible to align the leading edges of the sheets transported after the resuming of the transporting.

The image reading apparatus of the present invention is arranged so as to further include display means for at least displaying information as to alignment and misalignment of the sheets, the display means displaying that the leading edges of the sheets are not going to be aligned when the second suspend means temporarily suspends the ejecting of the sheets.

With this arrangement, the display means that the leading edges of the sheets are not going to be aligned when the second suspend means temporarily suspends the ejecting of the sheets.

Therefore, by means of the display means, the user can know in advance that the leading edges of the sheets will not be aligned if the sheets are kept ejected.

As described above, an image reading apparatus of the present invention is configured so as to include a sheet transport apparatus which is arranged so that the plurality of sheets include a sheet that has a protrusion on an edge perpendicular to the sheet transporting direction; and a shape distinguishing means for at least distinguishing a shape of an edge of each of the sheets in a direction perpendicular to the sheet transporting direction.

With this arrangement, the shape distinguishing means can distinguish a shape of an edge of each of the sheets in a direction perpendicular to the sheet transporting direction.

Therefore it is possible to judge whether or not the sheets include a sheet with a protrusion.

The sheet reading apparatus of the present invention is arranged so as to further include reading operation stop means for stopping the processing for reading an image even when the sheets are supplied from the sheet supply means.

With this arrangement, the image reading apparatus can only transport sheets without reading the image.

For example, there is a case where the trailing edges of the sheets instead of the leading edges of the sheets are aligned after the sheets are transported. In such a case, if the sheet transport apparatus transports again the sheets whose trailing edges are aligned, it is possible to align the leading edges of the sheets.

As described above, an image forming apparatus of the present invention is arranged so as to include the foregoing image reading apparatus.

The sheet transport apparatus of the present invention can be applied to various apparatuses including an image forming apparatus, an inkjet printer, and other apparatuses that transport sheets.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A sheet transport apparatus comprising:

(a) a sheet supply section to supply one sheet at a time by the leading edge from a plurality of sheets whose leading edges are aligned;

(b) a sheet transport section operatively connected to the sheet supply section for transporting the sheets supplied from the sheet supply section;

(c) a first eject tray into which the sheets are ejected by the sheet transport section after the sheets transported by the sheet transport section are subjected to predetermined processing; and (d) a detecting section for detecting on an occasion of the transporting of the sheets, whether or not the sheets have different sheet lengths in a sheet transporting direction, wherein the first eject tray is located in such a manner that front and back surfaces of the sheets being ejected are not reversed after the sheets are subjected to the predetermined processing and an order of the sheets is retained from when the sheets were placed on the sheet supply section, wherein the first eject tray includes a first eject tray operation section for aligning the leading edges of the sheets ejected to the first eject tray by changing a positional relation in a vertical direction between an upstream side and a downstream side of the first eject tray in the sheet transporting direction, wherein the first eject tray operation section moves the first eject tray either to (i) a first set position where the downstream side of the first eject tray in the sheet transporting direction is higher than the upstream side of the first eject tray in the sheet transporting direction or (ii) a second set position where the downstream side of the first eject tray in the sheet transporting direction is lower than the upstream side of the first eject tray in the sheet transporting direction, and wherein when the detecting section detects that the sheets have different sheet lengths, the first eject tray operation section sets the first eject tray to the second set position so that the leading edges of the sheets ejected to the first eject tray are aligned at the downstream side of the first eject tray in the sheet transporting direction, and when the detecting section does not detect that the sheets have different sheet lengths, the first eject tray operation section sets the first eject tray to the first set position so that trailing edges of the sheets ejected to the first eject tray are aligned at the upstream side of the first eject tray in the sheet transporting direction.

2. The sheet transport apparatus as set forth in claim 1, further comprising:

a first reception section for receiving a signal that designates either the first set position or the second set position as a position of the first sheet eject tray; and the first eject tray operation section setting the first eject tray to the second set position when the first reception section receives a signal that designates the second set position as the position of the first eject tray.

3. The sheet transport apparatus as set forth in claim 2, further comprising:

a first sheet transport suspend section for temporarily suspending the ejecting of the sheets when the detecting section detects that the sheets have different sheet lengths and when the first eject tray is in the first set position.

4. The sheet transport apparatus as set forth in claim 2, further comprising:

a second eject tray to which the sheets are ejected by the sheet transport section after the sheets transported by the sheet transport section are subjected to the predetermined processing; and a second reception section for receiving a signal that designates either the first eject tray or the second eject tray as a destination to which the sheets are ejected, wherein the destination to which the sheets are ejected is selected in accordance with a content of the signal received by the second reception section.

5. The sheet transport apparatus as set forth in claim 4, further comprising:

a second sheet transport suspend section for temporarily suspending the ejecting of the sheets when the detecting section detects that the sheets have different sheet lengths and when the destination to which the sheets are ejected is the second eject tray.

6. The sheet transport apparatus as set forth in claim 1, wherein:

the positional relation in the vertical direction is changed by rotating the first eject tray.

7. The sheet transport apparatus as set forth in claim 6, further comprising:

a first reception section for receiving a signal that designates either the first set position or the second set position as a position of the first eject tray; and the first eject tray operation section setting the first eject tray to the second set position when the first reception section receives a signal that designates the second set position as the position of the first eject tray.

8. The sheet transport apparatus as set forth in claim 7, further comprising:

a first sheet transport suspend section for temporarily suspending the ejecting of the sheets when the detecting section detects that the sheets have different sheet lengths and when the first eject tray is in the first set position.

9. The sheet transport apparatus as set forth in claim 7, further comprising:

a second eject tray to which the sheets are ejected by the sheet transport section after the sheets transported by the sheet transport section are subjected to the predetermined processing; and a second reception section for receiving a signal that designates either the first eject tray or the second eject tray as a destination to which the sheets are ejected, wherein the destination to which the sheets are ejected is selected in accordance with a content of the signal received by the second reception section.

10. The sheet transport apparatus as set forth in claim 9, further comprising:

a second sheet transport suspend section for temporarily suspending the ejecting of the sheets when the detecting section detects that the sheets have different sheet lengths and when the destination to which the sheets are ejected is the second eject tray.

11. The sheet transport apparatus as set forth in claim 6, further comprising:

a second eject tray to which the sheets are ejected by the sheet transport section after the sheets transported by the sheet transport section are subjected to the predetermined processing; and a second reception section for receiving a signal that designates either the first eject tray or the second eject tray as a destination to which the sheets are ejected, wherein the destination to which the sheets are ejected is selected in accordance with a content of the signal received by the second reception section.

12. The sheet transport apparatus as set forth in claim 11, further comprising:

a second sheet transport suspend section for temporarily suspending the ejecting of the sheets when the detecting section detects that the sheets have different sheet lengths and when the destination to which the sheets are ejected is the second eject tray.

13. The sheet transport apparatus as set forth in claim 1, further comprising:

a second eject tray to which the sheets are ejected by the sheet transport section after the sheets transported by the sheet transport section are subjected to the predetermined processing; and a second reception section for receiving a signal that designates either the first eject tray or the second eject tray as a destination to which the sheets are ejected, wherein the destination to which the sheets are ejected is selected in accordance with a content of the signal received by the second reception section.

14. The sheet transport apparatus as set forth in claim 13, further comprising:

a second sheet transport suspend section for temporarily suspending the ejecting of the sheets when the detecting section detects that the sheets have different sheet lengths and when the destination to which the sheets are ejected is the second eject tray.

15. The sheet transport apparatus as set forth in claim 1, wherein: the plurality of sheets include a sheet that has a protrusion on an edge perpendicular to the sheet transporting direction.

16. The sheet transport apparatus as set forth in claim 15, further comprising:

a sheet length detector for measuring sheet lengths of each of the sheets in the sheet transporting direction with respect to a plurality of places on each of the sheets.

17. The sheet transport apparatus as set forth in claim 1, wherein:

the predetermined processing is processing for reading an image formed on the sheets.

18. The sheet transport apparatus as set forth in claim 1, wherein the detecting section includes:

a sheet length detector for detecting a sheet length of each of the transported sheets; and a judgment section for judging that the sheets have different sheet lengths when a sheet length of a first sheet detected by the sheet length detector is not equal to a sheet length of a second sheet that has been transported before the first sheet and that is detected by the sheet length detector.

19. The sheet transport apparatus as set forth in claim 1, further comprising:

a first sheet transport suspend section for temporarily suspending the transporting of the sheets in a transport route when the detecting section detects that the sheets have different sheet lengths and when the first eject tray is in the first set position; and a suspend release section for ejecting, to the first eject tray, the sheets temporarily suspended in the transport route when the suspend release section detects that the first eject tray operation section moves the first eject tray to the second set position.

20. An image reading apparatus comprising:

(a) a sheet transport apparatus that includes:

(1) a sheet supply section to supply one sheet at a time by the leading edge from a plurality of sheets whose leading edges are aligned;

(2) a sheet transport section operatively connected to the sheet supply section for transporting the sheets supplied from the sheet supply section;

(3) a first eject tray into which the sheets are ejected by the sheet transport section after the sheets transported by the sheet transport section are subjected to processing for reading an image formed on the sheets, and (4) a detecting section for detecting on an occasion of the transporting of the sheets, whether or not the sheets have different sheet lengths in a sheet transporting direction, wherein the first eject tray is located in such a manner that front and back surfaces of the sheets being ejected are not reversed after the sheets are subjected to the processing for reading an image formed on the sheets and an order of the sheets is retained from when the sheets were placed on the sheet supply section, wherein the first eject tray includes a first eject tray operation section for aligning the leading edges of the sheets ejected to the first eject tray by changing a positional relation in a vertical direction between an upstream side and a downstream side of the first eject tray in the sheet transporting direction, wherein the first eject tray operation section moves the first eject tray either to (i) a first set position where the downstream side of the first eject tray in the sheet transporting direction is higher than the upstream side of the first eject tray in the sheet transporting direction or (ii) a second set position where the downstream side of the first eject tray in the sheet transporting direction is lower than the upstream side of the first eject tray in the sheet transporting direction, and wherein when the detecting section detects that the sheets have different sheet lengths, the first eject tray operation section sets the first eject tray to the second set position so that the leading edges of the sheets ejected to the first eject tray are aligned at the downstream side of the first eject tray in the sheet transporting direction, and when the detecting section does not detect that the sheets have different sheet lengths, the first eject tray operation section sets the first eject tray to the first set position so that trailing edges of the sheets ejected to the first eject tray are aligned at the upstream side of the first eject tray in the sheet transporting direction;

(b) an image reading section operatively connected to the sheet transport apparatus such that images on the sheets transported by the sheet transport apparatus are processed for reading by the image reading section; and (c) an operation section operatively connected to the image reading section (i) to communicate user control signals to the image reading section and to the sheet transport apparatus, and (ii) to communicate status information from the image reading section and to the sheet transport apparatus to the user.

21. The sheet reading apparatus as set forth in claim 20, further comprising:

a reading operation stop section for stopping the processing for reading an image even when the sheets are supplied from the sheet supply section.

22. An image reading apparatus comprising:

(a) a sheet transport apparatus that includes:

(1) a sheet supply section to supply one sheet at a time by the leading edge from a plurality of sheets whose leading edges are aligned;

(2) a sheet transport section operatively connected to the sheet supply section for transporting the sheets supplied from the sheet supply section;

(3) a first eject tray into which the sheets are ejected by the sheet transport section after the sheets transported by the sheet transport section are subjected to predetermined processing, and wherein the first eject tray is located in such a manner that front and back surfaces of the sheets being ejected are not reversed after the sheets are subjected to the predetermined processing and an order of the sheets is retained from when the sheets were placed on the sheet supply section, and wherein the first eject tray includes a first eject tray operation section for aligning the leading edges of the sheets ejected to the first eject tray by changing a positional relation in a vertical direction between an upstream side and a downstream side of the first eject tray in the sheet transporting direction by moving the first eject tray either to (i) a first set position where the downstream side of the first eject tray in the sheet transporting direction is higher than the upstream side of the first eject tray in the sheet transporting direction, or (ii) a second set position where the downstream side of the first eject tray in the sheet transporting direction is lower than the upstream side of the first eject tray;

(4) a detecting section for detecting on an occasion of the transporting of the sheets by the sheet transport section, whether or not the sheets have different sheet lengths in the sheet transporting direction;

(5) the first eject tray operation section wherein when the detecting section detects that the sheets have different sheet lengths, the first eject tray operation section sets the first eject tray to the second set position so that the leading edges of the sheets ejected to the first eject tray are aligned at the downstream side of the first eject tray in the sheet transporting direction, and when the detecting section does not detect that the sheets have different sheet lengths, the first eject tray operation section sets the first eject tray to the first set position so that trailing edges of the sheets ejected to the first eject tray are aligned at the upstream side of the first eject tray in the sheet transporting direction; and (6) a control section with a first reception section to receive transmission from a first transmission section of an operation section such that the transmission designates either the first set position of the first eject tray or the second set position of the first eject tray;

(b) the operation section operatively connected to an image reading section and the sheet transport apparatus including:

(1) a first sheet transport suspend section for temporarily suspending the ejecting of the sheets when the detecting section detects that the sheets have different sheet lengths while the first eject tray is in the first set position; and (2) the first transmission section to send a signal to the first reception section of the control section such that the signal designates either the first set position or the second set position of the first eject tray;

(c) the image reading section operatively connected to the sheet transport apparatus and the operation section such that images on the sheets transported by the sheet transport apparatus are processed for reading by the image reading section.

23. The image reading apparatus as set forth in claim 22, further comprising:

a display for at least displaying information as to alignment and misalignment of the sheets, the display displaying that the leading edges of the sheets are not going to be aligned when the first sheet transport suspend section temporarily suspends the ejecting of the sheets.

24. The sheet reading apparatus as set forth in claim 22, further comprising:

a reading operation stop section for stopping the processing for reading an image even when the sheets are supplied from the sheet supply section.

25. An image reading apparatus comprising:

(a) a sheet transport apparatus that includes:

(1) a sheet supply section to supply one sheet at a time by the leading edge from a plurality of sheets whose leading edges are aligned;

(2) a sheet transport section operatively connected to the sheet supply section for transporting the sheets supplied from the sheet supply section;

(3) a first eject tray into which the sheets are ejected by the sheet transport section after the sheets transported by the sheet transport section are subjected to predetermined processing, wherein the first eject tray is located in such a manner that front and back surfaces of the sheets being ejected are not reversed after the sheets are subjected to the predetermined processing and an order of the sheets is retained from when the sheets were placed on the sheet supply section, and wherein the first eject tray includes a first eject tray operation section for aligning the leading edges of the sheets ejected to the first eject tray by changing a positional relation in a vertical direction between an upstream side and a downstream side of the first eject tray in sheet transporting direction by moving the first eject tray either to (i) a first set position where the downstream side of the first eject tray in the sheet transporting direction is higher than the upstream side of the first eject tray in the sheet transporting direction, or (ii) a second set position where the downstream side of the first eject tray in the sheet transporting direction is lower than the upstream side of the first eject tray;

(4) a detecting section for detecting on an occasion of the transporting of the sheets by the sheet transport section, whether or not the sheets have different sheet lengths in the sheet transporting direction;

(5) the first eject tray operation section wherein when the detecting section detects that the sheets have different sheet lengths, the first eject tray operation section sets the first eject tray to the second set position so that the leading edges of the sheets ejected to the first eject tray are aligned at the downstream side of the first eject tray in the sheet transporting direction, and when the detecting section does not detect that the sheets have different sheet lengths, the first eject tray operation section sets the first eject tray to the first set position so that trailing edges of the sheets ejected to the first eject tray are aligned at the upstream side of the first eject tray in the sheet transporting direction; and (6) a control section with a second reception section to receive transmission from a second transmission section of an operation section such that the transmission designates either the first eject tray or a second eject tray;

(7) the second eject tray into which the sheets are ejected by the sheet transport section after the sheets transported by the sheet transport section are subjected to the predetermined processing;

(b) the operation section operatively connected to an image reading section and the sheet transport apparatus including:

(1) a second sheet transport suspend section for temporarily suspending the ejecting of the sheets when the detecting section detects that the sheets have different sheet lengths while the destination to which the sheets are to be ejected is the second eject tray; and (2) a second transmission section to send a signal to the second reception section of the control section such that the signal designates either the first eject tray or the second eject tray;

(c) the image reading section operatively connected to the sheet transport apparatus and the operation section such that images on the sheets transported by the sheet transport apparatus are processed for reading by the image reading section.

26. The image reading apparatus as set forth in claim 25, further comprising:

a display displaying that the leading edges of the sheets are not going to be aligned when the second sheet transport suspend section temporarily suspends the ejecting of the sheets.

27. The sheet reading apparatus as set forth in claim 25, further comprising:

a reading operation stop section for stopping the processing for reading an image even when the sheets are supplied from the sheet supply section.

28. An image forming apparatus comprising:

an image reading apparatus, wherein the image reading apparatus includes a sheet transport apparatus, said sheet transport apparatus including:

a sheet supply section to supply one sheet at a time by the leading edge from a plurality of sheets whose leading edges are aligned;

a sheet transport section operatively connected to the sheet supply section for transporting the sheets supplied from the sheet supply section;

a first eject tray into which the sheets are ejected by the sheet transport section after the sheets transported by the sheet transport section are subjected to processing for reading an image formed on the sheets; and a detecting section for detecting on an occasion of the transporting of the sheets, whether or not the sheets have different sheet lengths in a sheet transporting direction, wherein the first eject tray is located in such a manner that front and back surfaces of the sheets being ejected are not reversed after the sheets are subjected to the processing for reading an image formed on the sheets and an order of the sheets is retained from when the sheets were placed on the sheet supply section, wherein the first eject tray includes a first eject tray operation section for aligning the leading edges of the sheets ejected to the first eject tray by changing a positional relation in a vertical direction between an upstream side and a downstream side of the first eject tray in the sheet transporting direction, wherein the first eject tray operation section moves the first eject tray either to (i) a first set position where the downstream side of the first eject tray in the sheet transporting direction is higher than the upstream side of the first eject tray in the sheet transporting direction or (ii) a second set position where the downstream side of the first eject tray in the sheet transporting direction is lower than the upstream side of the first eject tray in the sheet transporting direction, and wherein when the detecting section detects that the sheets have different sheet lengths, the first eject tray operation section sets the first eject tray to the second set position so that the leading edges of the sheets ejected to the first eject tray are aligned at the downstream side of the first eject tray in the sheet transporting direction, and when the detecting section does not detect that the sheets have different sheet lengths, the first eject tray operation section sets the first eject tray to the first set position so that trailing edges of the sheets ejected to the first eject tray are aligned at the upstream side of the first eject tray in the sheet transporting direction.

* * * * *